US008042598B2

(12) United States Patent
Bredemus et al.

(10) Patent No.: US 8,042,598 B2
(45) **Date of Patent: *Oct. 25, 2011**

(54) REDUCED VISIBILITY INSECT SCREEN

(75) Inventors: Alex Bredemus, Eagen, MN (US); Kurt Dalquist, Lindstrom, MN (US); Patrick J. Gronlund, Somerset, WI (US); Ray Meyer, St. Paul, MN (US); Michael J. Deaner, Osceloa, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/326,325

(22) Filed: Dec. 2, 2008

(65) Prior Publication Data

US 2009/0104829 A1 Apr. 23, 2009

Related U.S. Application Data

(63) Continuation of application No. 11/859,132, filed on Sep. 21, 2007, now abandoned, which is a continuation of application No. 10/973,688, filed on Oct. 26, 2004, now abandoned, which is a continuation-in-part of application No. 10/823,235, filed on Apr. 13, 2004, now Pat. No. 7,195,053, which is a continuation of application No. 10/259,221, filed on Sep. 26, 2002, now Pat. No. 6,880,612, which is a continuation-in-part of application No. 10/068,069, filed on Feb. 6, 2002, now Pat. No. 6,763,875.

(51) Int. Cl.
*E06B 9/52* (2006.01)

(52) U.S. Cl. ..... 160/371; 428/336; 442/125; 245/8

(58) Field of Classification Search ..... 160/371; 428/336; 442/131, 132, 133, 181, 189, 125; 139/420 A; 245/8; 174/35 MS
See application file for complete search history.

(56) References Cited

U.S. PATENT DOCUMENTS

| | | | |
|---|---|---|---|
| 1,887,646 | A | 11/1932 | Johnston |
| 2,092,749 | A | 9/1937 | Bradshaw |
| 2,281,635 | A | 5/1942 | Strauss |

(Continued)

FOREIGN PATENT DOCUMENTS

| | | | |
|---|---|---|---|
| CA | 2443136 | A1 | 8/2003 |

(Continued)

OTHER PUBLICATIONS

The 1958 Wire Industry Encyclopaedic Handbook, A Comprehensive Reference Book for the Wire-Drawing and Wire Fabricating Industries, May 2, 1958, p. 1, 2, 418-421, 438, and 439, The Wire Industry Limited, London, England.

(Continued)

*Primary Examiner* — Blair M. Johnson
(74) *Attorney, Agent, or Firm* — Womble Carlyle Sandridge & Rice PLLC

(57) ABSTRACT

An insect screen of increased invisibility can be created by using small wire diameter elements and/or increasing the mesh density of the screen. The combination of small wire diameter and increased mesh density provide a screen with a higher Dalquist Rating that becomes invisible at closer distances. A "sweet spot" exists at which a screen with a combination high mesh density and small wire diameter is less visible, while still providing the strength, durability, and quality desired. Further, screens with properties in proximity to this sweet spot also provide a marked increase in invisibility.

27 Claims, 38 Drawing Sheets

U.S. PATENT DOCUMENTS

| | | | |
|---|---|---|---|
| 2,297,729 A | 10/1942 | Thomas | |
| 2,333,618 A | 11/1943 | Strauss | |
| 2,334,754 A | 11/1943 | Dreyfus | |
| 2,353,224 A | 11/1943 | Dreyfus | |
| 2,353,225 A | 7/1944 | Dreyfus | |
| 2,364,404 A | 12/1944 | Thomas | |
| 2,381,542 A | 8/1945 | Hyatt et al. | |
| 2,526,327 A | 10/1950 | Carlson | |
| 2,573,639 A | 10/1951 | Coler | |
| 2,665,754 A | 1/1954 | Claussen et al. | |
| 2,746,135 A | 5/1956 | Harris | |
| 2,870,526 A | 1/1959 | Adler | |
| 3,022,543 A | 2/1962 | Baird, Jr. et al. | |
| 3,210,903 A | 10/1965 | Herolf | |
| 3,255,810 A | 6/1966 | Rowbottam | |
| 3,276,942 A | 10/1966 | Ewing | |
| 3,321,003 A | 5/1967 | Boerner | |
| 3,414,902 A | 12/1968 | Shaw, Jr. | |
| 3,417,794 A | 12/1968 | Lynch et al. | |
| 3,480,069 A | 11/1969 | Handwerker | |
| 3,519,779 A | 7/1970 | Dolomont | |
| 3,520,053 A | 7/1970 | Hinton et al. | |
| 3,552,476 A | 1/1971 | Le Tarte | |
| 3,622,470 A | 11/1971 | Gowman | |
| 3,632,269 A | 1/1972 | Doviak et al. | |
| 3,632,486 A | 1/1972 | Herrmann | |
| 3,760,860 A | 9/1973 | Kelarakis | |
| 3,763,917 A | 10/1973 | Antinone | |
| 3,795,268 A | 3/1974 | Hendriks | |
| 3,843,570 A | 10/1974 | Murayama | |
| 3,867,294 A | 2/1975 | Pall et al. | |
| 3,868,789 A | 3/1975 | Gates | |
| 3,911,990 A | 10/1975 | Hoover et al. | |
| 3,915,667 A | 10/1975 | Ricks | |
| 3,927,496 A | 12/1975 | Kersavage | |
| 3,970,537 A | 7/1976 | Froman et al. | |
| 4,002,188 A | 1/1977 | Hanks | |
| 4,033,881 A | 7/1977 | Pall | |
| 4,048,360 A | 9/1977 | Jonda | |
| 4,063,998 A | 12/1977 | Henke | |
| 4,083,324 A | 4/1978 | Krumweide | |
| 4,083,325 A | 4/1978 | Krumweide | |
| 4,097,342 A | 6/1978 | Cooke et al. | |
| 4,104,712 A | 8/1978 | Hafner | |
| 4,130,622 A | 12/1978 | Pawlak | |
| 4,137,353 A | 1/1979 | Fariello | |
| 4,143,209 A | 3/1979 | Gerspacher et al. | |
| 4,154,688 A | 5/1979 | Pall | |
| 4,164,400 A | 8/1979 | Wald | |
| 4,169,770 A | 10/1979 | Cooke et al. | |
| 4,211,816 A | 7/1980 | Booker et al. | |
| 4,226,905 A | 10/1980 | Harbourne | |
| 4,231,768 A | 11/1980 | Seibert et al. | |
| 4,234,914 A | 11/1980 | Boesen | |
| 4,239,564 A | 12/1980 | Krumweide | |
| 4,241,123 A | 12/1980 | Shih | |
| 4,247,737 A | 1/1981 | Johnson et al. | |
| 4,248,924 A | 2/1981 | Okita | |
| 4,253,737 A | 3/1981 | Thomsen et al. | |
| 4,255,496 A | 3/1981 | Haemers | |
| 4,285,748 A | 8/1981 | Booker et al. | |
| 4,298,666 A | 11/1981 | Taskier | |
| 4,302,334 A | 11/1981 | Jakabhazy et al. | |
| 4,304,113 A | 12/1981 | Takei et al. | |
| 4,318,785 A | 3/1982 | Gunjima et al. | |
| 4,337,155 A | 6/1982 | Sasaki et al. | |
| 4,347,290 A | 8/1982 | Haemers | |
| 4,361,725 A | 11/1982 | Dagnelie et al. | |
| 4,376,140 A | 3/1983 | Kimoto et al. | |
| 4,384,047 A | 5/1983 | Benzinger et al. | |
| 4,395,622 A | 7/1983 | Dran et al. | |
| 4,399,019 A | 8/1983 | Kruper et al. | |
| 4,399,183 A | 8/1983 | Withers | |
| 4,402,830 A | 9/1983 | Pall | |
| 4,412,255 A | 10/1983 | Kuhlman et al. | |
| 4,414,280 A | 11/1983 | Silva et al. | |
| 4,446,198 A | 5/1984 | Shemenski et al. | |
| 4,464,263 A | 8/1984 | Brownell | |
| 4,468,702 A | 8/1984 | Jandrell | |
| 4,502,595 A | 3/1985 | Wheeldon | |
| 4,518,661 A | 5/1985 | Rippere | |
| 4,525,430 A | 6/1985 | Bourgois | |
| 4,555,811 A | 12/1985 | Shimalla | |
| 4,562,675 A | 1/1986 | Baigas, Jr. et al. | |
| 4,587,997 A | 5/1986 | Brooks | |
| 4,588,630 A | 5/1986 | Shimalla | |
| 4,592,943 A | 6/1986 | Cancian et al. | |
| 4,606,392 A | 8/1986 | Weidenhaupt et al. | |
| 4,609,465 A | 9/1986 | Miller | |
| 4,645,718 A | 2/1987 | Dambre | |
| 4,651,367 A | 3/1987 | Osher et al. | |
| 4,651,513 A | 3/1987 | Dambre | |
| 4,661,376 A | 4/1987 | Liang | |
| 4,668,577 A | 5/1987 | Ohta et al. | |
| 4,677,033 A | 6/1987 | Coppens et al. | |
| 4,679,387 A | 7/1987 | Weidenhaupt et al. | |
| 4,683,175 A | 7/1987 | Bakewell et al. | |
| 4,686,342 A | 8/1987 | Collier et al. | |
| 4,688,619 A | 8/1987 | Kessler | |
| 4,704,337 A | 11/1987 | Coppens et al. | |
| 4,737,392 A | 4/1988 | Dambre | |
| 4,759,806 A | 7/1988 | Dambre | |
| 4,772,092 A | 9/1988 | Hofer et al. | |
| 4,774,124 A | 9/1988 | Shimalla et al. | |
| 4,778,633 A | 10/1988 | Kiang et al. | |
| 4,807,680 A | 2/1989 | Weidenhaupt et al. | |
| 4,819,085 A | 4/1989 | Liang | |
| 4,828,000 A | 5/1989 | Lievens et al. | |
| 4,828,653 A | 5/1989 | Traini et al. | |
| 4,829,760 A | 5/1989 | Dambre | |
| 4,869,389 A | 9/1989 | Cerrone, Jr. | |
| 4,932,457 A | 6/1990 | Duncan | |
| 4,952,249 A | 8/1990 | Dambre | |
| 4,980,227 A | 12/1990 | Sekiguchi et al. | |
| 4,993,187 A | 2/1991 | Schweiss et al. | |
| 5,012,041 A * | 4/1991 | Sims et al. | 174/381 |
| 5,037,455 A | 8/1991 | Scheineson et al. | |
| 5,066,085 A | 11/1991 | Gimbutas et al. | |
| 5,139,076 A | 8/1992 | Langdon | |
| 5,141,046 A | 8/1992 | Duncan | |
| 5,198,287 A | 3/1993 | Samson et al. | |
| 5,211,214 A | 5/1993 | Shaw | |
| 5,299,616 A | 4/1994 | Sholtz | |
| 5,312,467 A | 5/1994 | Wolfe | |
| 5,392,835 A | 2/1995 | Wildt | |
| 5,453,252 A | 9/1995 | Truett | |
| 5,462,649 A | 10/1995 | Keeney et al. | |
| 5,476,578 A | 12/1995 | Forand et al. | |
| 5,478,372 A | 12/1995 | Stark | |
| 5,492,551 A | 2/1996 | Wolfe | |
| 5,554,467 A | 9/1996 | Trokhan et al. | |
| 5,562,986 A | 10/1996 | Yamamoto et al. | |
| 5,563,364 A | 10/1996 | Alhamad | |
| 5,569,455 A | 10/1996 | Fukui et al. | |
| 5,645,936 A | 7/1997 | Frankfort et al. | |
| 5,657,065 A | 8/1997 | Lin | |
| 5,670,234 A | 9/1997 | Suehr et al. | |
| 5,679,232 A | 10/1997 | Fedor et al. | |
| 5,679,233 A | 10/1997 | Van Anglen et al. | |
| 5,728,632 A | 3/1998 | Sugie | |
| 5,770,144 A | 6/1998 | James et al. | |
| 5,775,400 A | 7/1998 | Wilkinson | |
| 5,776,343 A | 7/1998 | Cullen et al. | |
| 5,785,792 A | 7/1998 | Locke et al. | |
| 5,792,298 A | 8/1998 | Sauer et al. | |
| 5,824,352 A | 10/1998 | Yang et al. | |
| 5,828,494 A | 10/1998 | Stremple | |
| 5,837,120 A | 11/1998 | Forand et al. | |
| 5,863,440 A | 1/1999 | Rink et al. | |
| 5,873,999 A | 2/1999 | Gaiser | |
| 5,895,623 A | 4/1999 | Trokhan et al. | |
| 5,908,704 A | 6/1999 | Friedman et al. | |
| 5,912,077 A | 6/1999 | Tamaru et al. | |
| 5,916,469 A | 6/1999 | Scoles et al. | |
| 5,925,420 A | 7/1999 | Lee | |
| 5,935,475 A | 8/1999 | Scoles et al. | |
| 5,951,727 A | 9/1999 | Spies et al. | |

| | | | | |
|---|---|---|---|---|
| 5,977,430 | A | 11/1999 | Roe et al. | |
| 5,985,112 | A | 11/1999 | Fischer | |
| 5,988,036 | A | 11/1999 | Mangolds et al. | |
| 5,996,129 | A | 12/1999 | Lopez | |
| 5,997,642 | A | 12/1999 | Solayappan et al. | |
| 6,001,118 | A | 12/1999 | Daniel et al. | |
| 6,013,063 | A | 1/2000 | Roe et al. | |
| 6,022,607 | A | 2/2000 | James et al. | |
| 6,024,553 | A | 2/2000 | Shimalla | |
| 6,096,371 | A | 8/2000 | Haaland et al. | |
| 6,109,331 | A | 8/2000 | Story, Jr. | |
| 6,125,905 | A | 10/2000 | Woodside et al. | |
| 6,149,781 | A | 11/2000 | Forand | |
| 6,164,361 | A | 12/2000 | Meyer | |
| 6,183,872 | B1 | 2/2001 | Tanaka et al. | |
| 6,186,215 | B1 | 2/2001 | DeYoung et al. | |
| 6,235,388 | B1 | 5/2001 | Yamamoto et al. | |
| 6,240,817 | B1 | 6/2001 | James et al. | |
| 6,250,040 | B1 | 6/2001 | Green et al. | |
| 6,263,949 | B1 | 7/2001 | Guthrie, Jr. | |
| 6,312,640 | B1 | 11/2001 | Shimalla | |
| 6,315,547 | B1 | 11/2001 | Shimalla | |
| 6,326,015 | B1 | 12/2001 | Tucci et al. | |
| 6,331,223 | B1 | 12/2001 | Wylie et al. | |
| 6,341,444 | B1 | 1/2002 | Cina et al. | |
| 6,429,750 | B2 | 8/2002 | Curran, Sr. et al. | |
| 6,479,143 | B1 | 11/2002 | Tamaru et al. | |
| 6,497,946 | B1 | 12/2002 | Kretman et al. | |
| 6,517,594 | B2 | 2/2003 | Olander et al. | |
| 6,716,774 | B2 | 4/2004 | Porter et al. | |
| 6,763,875 | B2 * | 7/2004 | Gronlund et al. | 160/371 |
| 6,880,612 | B2 * | 4/2005 | Pylkki et al. | 160/371 |
| 7,195,053 | B2 * | 3/2007 | Pylkki et al. | 160/371 |
| 2001/0042348 | A1 | 11/2001 | Lundahl | |
| 2002/0134709 | A1 | 9/2002 | Riddle | |
| 2002/0137410 | A1 | 9/2002 | Porter et al. | |
| 2003/0041522 | A1 | 3/2003 | Cauchon | |
| 2003/0145960 | A1 | 8/2003 | Gronlund et al. | |
| 2003/0150569 | A1 | 8/2003 | Pylkki et al. | |
| 2003/0173042 | A1 | 9/2003 | Haas | |
| 2004/0140067 | A1 | 7/2004 | Kelley et al. | |
| 2004/0203303 | A1 | 10/2004 | McGregor et al. | |
| 2005/0056389 | A1 | 3/2005 | Kelley et al. | |
| 2006/0169426 | A1 * | 8/2006 | McGregor et al. | 160/371 |
| 2008/0289780 | A1 * | 11/2008 | McGregor et al. | 160/371 |

FOREIGN PATENT DOCUMENTS

| | | | |
|---|---|---|---|
| DE | 200 20 267 | U1 | 5/2001 |
| EP | 0009846 | A1 | 4/1980 |
| FR | 2272629 | A1 | 12/1975 |
| GB | 449162 | | 6/1936 |
| GB | 1522605 | | 8/1978 |
| GB | 2086254 | A | 5/1982 |
| GB | 2161194 | A | 1/1986 |
| GB | 2178765 | A | 2/1987 |
| GB | 2237246 | A | 5/1991 |
| JP | 51-60773 | A | 5/1976 |
| JP | 56-96977 | A | 8/1981 |
| JP | 58-19660 | | 4/1983 |
| JP | 60-028547 | A2 | 2/1985 |
| JP | 62-140615 | | 6/1987 |
| JP | 62-291312 | | 12/1987 |
| JP | 4155088 | | 5/1992 |
| JP | 09-501407 | A | 2/1997 |
| JP | 09-195646 | A2 | 7/1997 |
| JP | 2000-027568 | A2 | 1/2000 |
| NL | 9500121 | A | 11/1995 |
| WO | WO 99/49170 | A1 | 9/1999 |
| WO | WO 03/067015 | A1 | 8/2003 |

OTHER PUBLICATIONS

Laramore, L., "Introduction to Photographic Principles," May 1965, 202-205, Dover Publications, New York, NY USA.

The Ludlow-Saylor Wire Company, Manufacturers of The Perfect Double Crimped Wire Cloth and Rex-Tang Screen for All Purposes, Aug. 1, 1924, p. 116-117, Catalogue No. 47, Saint Louis, Mo., U.S.A.

The Ludlow-Saylor Wire Company, Manufacturers of The Perfect Double Crimped Wire Cloth and Rex-Tang Screen for Mining and All Other Purposes, Jul. 14, 1938, p. 14, 15 and 61, Catalogue No. 46, Saint Louis, Mo., U.S.A.

Pogue, B. et al., "Absorbance of Opaque Microstructures in Optically Diffuse Media," Applied Optics, Sep. 1, 2001, pp. 4616-4621, vol. 40, No. 25, Optical Society of America, USA.

Robison, G. T., "Powder Coating Ups Quality of Window Screen," Products Finishing, Sep. 1976, 42-47, Gardner Publications, Inc., Cincinnati, Ohio, USA.

Swanson, J. G., "Celebrating the Past, Focusing on the Future," Window & Door, Feb. 2003, 2 pages, National Glass Association, McLean, Virginia, USA.

United States District Court, District of Minnesota, Civil Action No. 05-824 JMR/FLN, *Andersen Corporation* v. *Pella Corporation* and *W. L. Gore & Associates, Inc.,* Defendant Pella's Answer and Affirmative Defenses to Plaintiff's First Amended Complaint, Dec. 22, 2005, 9 pgs.

United States District Court, District of Minnesota, Civil Action No. 05-824 JMR/FLN, *Andersen Corporation* v. *Pella Corporation* and *W. L. Gore & Associates, Inc.,* Expert Report of Bruce H. Stoner, Jr., May 10, 2006, 27 pgs.

Standard Specification for Insect Screening and Louver Cloth Woven from Vinyl-Coated Glass Yarns, ASTM D3656-04, 2004, pp. 1-6, ATSM International, West Conshohocken, Pennsylvania.

* cited by examiner

Note: Number on chart refer to sample numbers in Table 5.

REDUCED VISIBILITY INSECT SCREEN

CROSS REFERENCE TO RELATED APPLICATIONS

This patent application is a continuation of U.S. patent application Ser. No. 11/859,132, filed Sep. 21, 2007, now abandoned which is a continuation of U.S. patent application Ser. No. 10/973,688, filed Oct. 26, 2004, now abandoned which is a continuation-in-part of U.S. patent application Ser. No. 10/823,235, filed Apr. 13, 2004, now U.S. Pat. No. 7,195,053, which is a continuation of U.S. patent application Ser. No. 10/259,221, filed Sep. 26, 2002, now U.S. Pat. No. 6,880,612, which is a continuation-in-part of U.S. patent application Ser. No. 10/068,069, filed Feb. 6, 2002, now U.S. Pat. No. 6,763,875, all of which are hereby incorporated herein by reference as if repeated in their entirety.

FIELD OF THE INVENTION

The invention relates generally to insect screens, such as, for example, for windows and doors, that are less visible or more transparent than conventional insect screens. A screen or screening is a mesh of thin linear elements that permit ventilation but exclude insects and other pests. To the ordinary observer, screens according to the invention are less visible in the sense that they interfere less with the clarity and brightness of an object or scene being observed through the screen.

BACKGROUND OF THE INVENTION

Generally, insect screens are installed on or in openings for windows and doors in homes to promote ventilation while excluding insects. Insect screens are, however, widely regarded as unattractive. From the inside of a window, some screens obstruct or at least detract from the view to the outside. From the outside, many people believe that screens detract from the overall appearance of a home or building. Homebuilders and realtors frequently remove screens from windows and/or doors when selling homes because of the improved appearance of the home from the outside. Homeowners often remove screens from windows and/or doors that are not frequently opened to improve the view from the inside and the appearance of the window and/or door.

A wide variety of insect screen materials and geometries are available in the prior art. Fiberglass, metallic and synthetic polymer screens are known. These screens suffer from reduced visual appeal due to relatively low light transmission, high reflection, or both. Standard residential insect screens include a mesh with horizontal and vertical elements. The most common insect screens have about 18 elements per inch in one direction and 16 elements per inch the other direction, often expressed as being an 18×16 mesh. Some conventional screens have an 18×14 mesh. The typical opening size is about 0.040 inch by 0.050 inch. Screens designed to exclude gnats and other very small insects usually include screen elements in a 20×20 mesh. The most common materials for the screen elements are aluminum and vinyl-coated fiberglass. Stainless steel, bronze and copper are also used for insect screen elements. Typical element diameters for insect screens are 0.011 inch for aluminum, bronze, and some stainless steel offerings, 0.016 inch for fiberglass, and 0.009 inch for galvanized steel and stainless steel.

Some products on the market advertise a black or charcoal colored screen mesh that is allegedly less visible from the inside of a house. Color coating changes and material changes have made some incremental improvements in the visual appeal of screening to the average observer, but most observers continue to object to the darkening effect and/or loss of clarity that current insect screening causes in observing scenes from inside and outside.

SUMMARY OF THE INVENTION

Briefly described, the present invention is an insect screen formed with unique attributes that render the screen significantly less visible or, in other words, more transparent, than screens of the prior art. We have found unique combinations of features for the elements used to form insect screening that maximize transmission and minimize reflection, thus resulting in reduced visibility of the screening itself and enhanced viewing through the screening. The visual awareness of the insect screen is substantially reduced while the ability to observe details of a viewed scene through the screen is greatly enhanced.

A reduced visibility insect screening is disclosed where the transmittance of the screening is at least about 0.75 and the reflectance of the screening is about 0.04 or less.

In an alternative embodiment, an insect screening material includes screen elements having a diameter of about 0.005 inch (about 0.127 mm) or less. The screen elements have a tensile strength of at least about 5500 psi (about 37.921 mega Pascals). Again, the transmittance of the screening is at least about 0.75 and the reflectance of the screening is about 0.04 or less.

In another embodiment of the invention, a screening is described including screen elements having a diameter of about 0.005 inch (about 0.127 mm) or less and a coating on the screen elements having a matte black finish. The transmittance of the screening is at least about 0.75 and the reflectance of the screening is about 0.04 or less.

In further alternative embodiments, the transmittance of the screening is at least about 0.80 or the reflectance of the screening is about 0.03 or less, or 0.02 or less. The screening may have an open area of at least about 75%, or at least about 80%. The screening may define mesh openings having a largest dimension not greater than about 0.060 inch (about 1.524 mm).

The screen elements may have a diameter less than about 0.005 inch (about 0.127 mm), and may have a tensile strength greater than about 5500 psi (about 37.921 mega Pascals). The screen elements may be made of a metal such as steel, stainless steel, aluminum and aluminum alloy, or a polymer such as polyethylene, polyester and nylon. Alternatively, the screen elements may be made of an ultra high molecular weight polyethylene or an amide such as polyamide, polyaramid and aramid.

In one embodiment, the screen elements include a coating, specifically a black matte coating such as electroplated black zinc. In one embodiment the screen elements are made of stainless steel with an electroplated black zinc coating.

Continued testing on screens such as those detailed in the present disclosure revealed that several factors in combination influence the invisibility of a screen. The results from the testing were surprising and, in many instances, counter-intuitive. These results include the surprising conclusion that for a fixed wire diameter, an increase of the mesh density of the screen resulted in increased invisibility of the screen. As detailed hereinbelow, an increase in the mesh density provided an increase in the Dalquist Rating, a measure of viewing clarity, and a better screen Invisibility Distance Rating. These results provide that a "sweet spot" exists at which a screen with a combination high mesh density and small wire diameter is less visible, while still providing the strength, durability, performance (i.e. insect control), and quality desired. Further, screens with properties in proximity to this sweet spot also provide a marked increase in invisibility over conventional screening. The visual effect produced by a screen placed in the line of sight between a viewer and an object being viewed depends not only on the properties of the screen itself, but on illumination conditions and the position of the screen relative to the viewer.

BRIEF DESCRIPTION OF THE DRAWINGS

The invention may be more completely understood by considering the Detailed Description of various embodiments of the invention that follows in connection with the accompanying drawings.

DETAILED DESCRIPTION OF THE PREFERRED EMBODIMENTS

Figure 1:
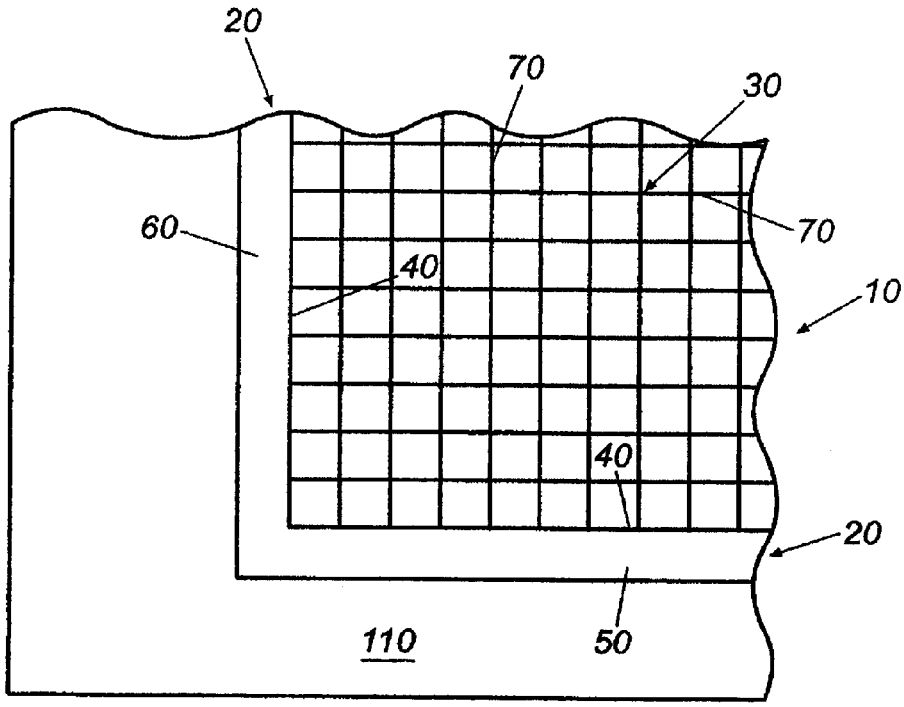
FIG. 1 is a fragmentary view of an insect screen in accordance with the invention.

Reference is made herein to the drawings, wherein like reference numerals refer, where appropriate, to like elements throughout the several views. We have discovered unique combinations of features for insect screening that result in a screen having markedly increased transparency or, to say it another way, markedly reduced visibility. More specifically, we have found that by reducing the size of, and selecting proper color and texture for, the screen elements used in the screening control reflection and transmission, the self-visibility of the screening is markedly reduced. The insect screening of the invention maintains comparable mechanical properties to prior art insect screening, but is substantially improved in that it is significantly less visible to an observer than prior art screens. The insect screening of the invention can be used in the manufacture of original screens and can be used in replacement screens for windows, doors, patio doors, vehicles and many other structures where insect screening is used. The insect screening of the invention can be combined with metal frames, wooden frames, composite frames, or the like and can be joined to fenestration units with a variety of joinery techniques including adhesives, mechanical fasteners such as staples or tacks, splines, binding the screening material into recesses in the screen member frame or other common screen joining technology. When properly installed in conventional windows, doors, frames, window or door openings, and/or other building openings, the ordinary observer viewing from the interior or the exterior through the insect screening of the invention is substantially less aware of the screening itself and has a substantially clearer view of the scene on the other side of the screen.

We have found that combinations of reduced element size in the screening, increased mesh density, and/or coating on the screen elements combine to provide the improved visual properties of the insect screening of the invention. The selected materials disclosed for the screening of the invention are not limiting. Many different materials can satisfy the requirements of the invention.

Screen within Frame and on Fenestration Unit

FIG. 1 is a fragmentary drawing of a portion of an insect screen 10 in accordance with the present invention. The insect screen 10 consists of a frame 20 including a frame perimeter 40 defining a frame opening. An insect screening 30 fills the opening defined by the frame perimeter 40. The frame 20 supports the screening 30 on all sides of the screening 30. The frame 20 is preferably sufficiently rigid to support the screening tautly and to allow handling when the screen 10 is placed in or removed from a window or door unit or opening.

Figure 2:
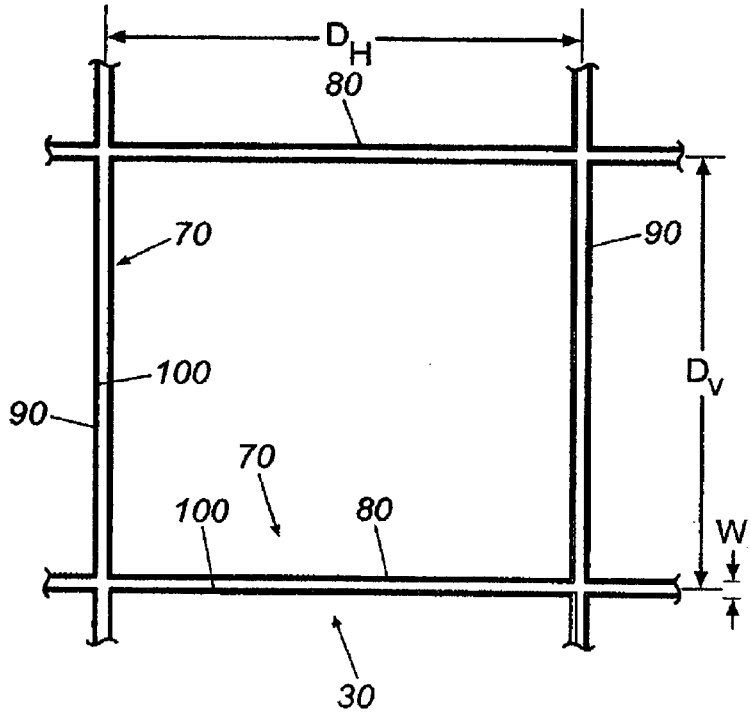
FIG. 2 is a fragmentary view of a portion of the insect screen shown in FIG. 1.

FIG. 2 is a fragmentary view of a portion of the insect screening shown in FIG. 1. The spaces between screen elements 70 define openings or holes in the screening 30. In a preferred embodiment, the screen elements 70 include horizontal elements 80 and vertical elements 90. Preferably, the horizontal and vertical elements 80, 90 are constructed and arranged to form a mesh where a horizontal metal element intersects a vertical metal element perpendicularly. The intersecting horizontal and vertical metal elements 80, 90 may be woven together. Alternatively, the intersecting horizontal and vertical metal elements 80, 90 may be fused together, although they may or may not be woven.

Figure 3:
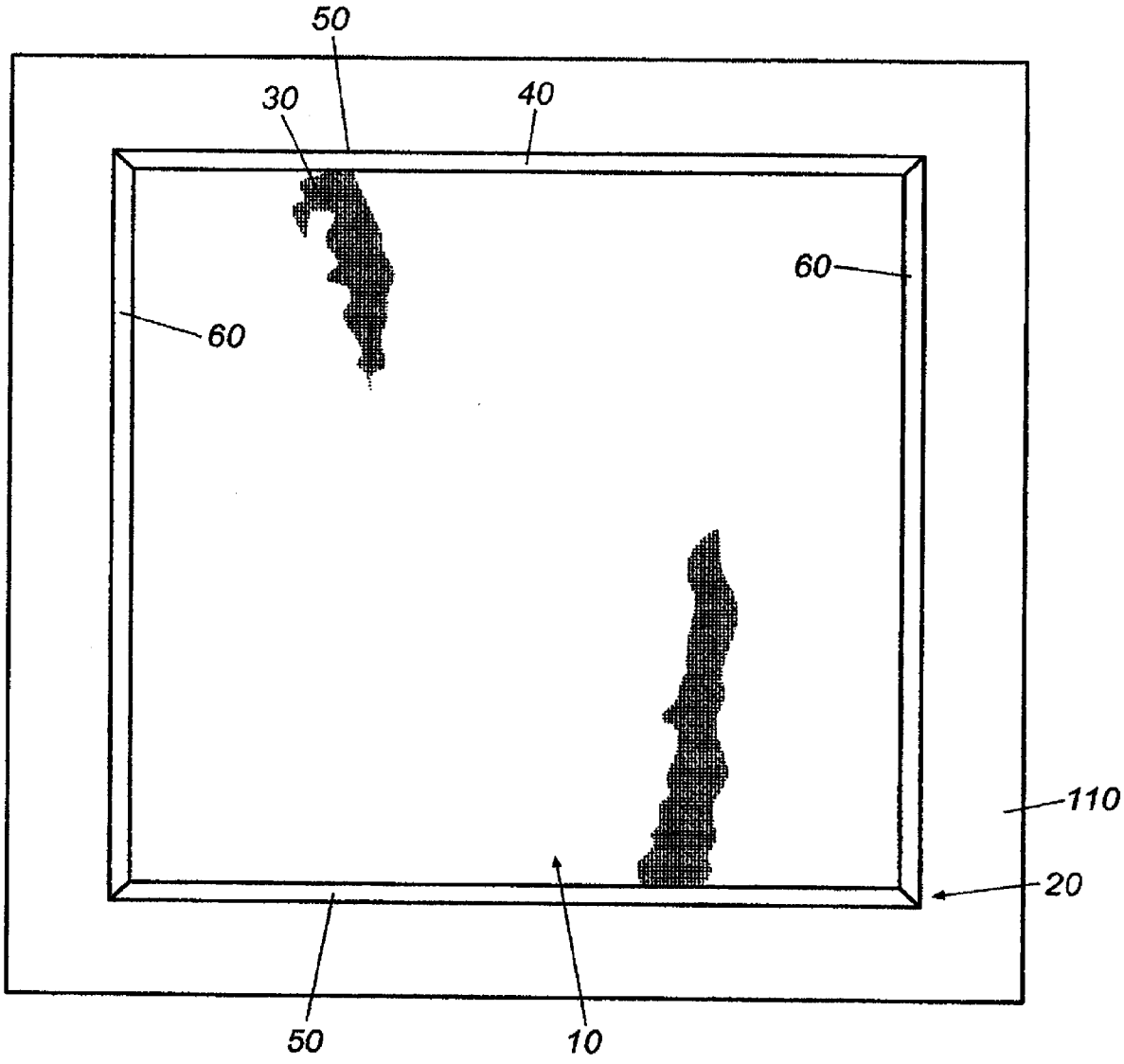
FIG. 3 is a perspective view of the insect screen shown in fragmentary view in FIG. 1.

FIG. 3 is a perspective view of the insect screen shown in FIG. 1 positioned in a fenestration unit 110. The frame 20 includes two pairs of opposed frame members. A first pair of opposed frame members 50 is oriented along a horizontal frame axis. A second pair of opposed frame members 60 is oriented along a vertical frame axis. The four frame members 50, 60 form a square or rectangle shape. However, the frame may be any shape.

Goal of Making Screen Less Visible

When light interacts with a material, many things happen that are important to the visibility of insect screening. The visibility of screening can be influenced by light transmission, reflection, scattering and variable spectral response resulting from element dimensions, element coatings, open area relative to the screen area, and the dimensions of the mesh openings. In order to reduce the visibility of the screening, the transmittance is maximized, the reflectance is minimized, the remaining reflection is made as diffuse as possible, and any spectral reflectance is made as flat or colorless as possible. To accomplish this, it is beneficial to use screen elements with the smallest dimensions or diameters while still meeting the strength and insect exclusion requirements.

In measuring to what degree an insect screening has achieved reduced visibility, the inventors have found that transmittance and reflectance are important factors for visibility of a screen when viewed from the exterior of a home. Because the sun is a much stronger light source than interior lighting, visibility of the screen from the exterior of the home is more difficult to reduce than visibility from the interior, as discussed further herein. Also, in single hung windows, the presence of an insect screen on the bottom half of the window contrasts with bare sash on the top half of the window to make the screening stand out.

Figure 4:
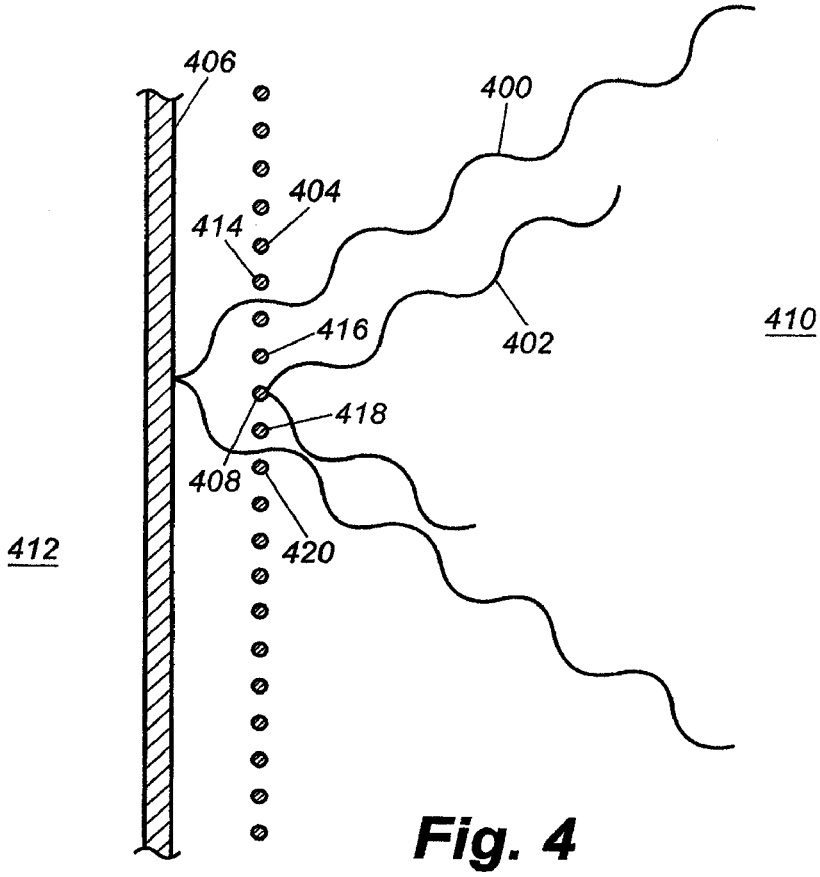
FIG. 4 is a diagram illustrating light paths in reflection from a window unit with a screen.

FIG. 4 shows light paths for one typical viewing situation involving an observer outside a building viewing a screen and window. FIG. 4 shows a cross sectional view of screen 404 and glass 406 in the window. The window separates an exterior viewing location 410 from an interior scene 412, where the screen 404 is on the exterior side of the glass 406. Screen units are commonly positioned on the exterior of the glass, for example, in double-hung windows, sliding windows and sliding doors. Screening 404 is comprised of many elements, including elements 408, 414, 416, 418, and 420. FIG. 4 generally illustrates the path of light ray 400 and light ray 402 as they interact with screen 404 and glass 406. Light rays 402 and 404 are from the sun, which typically dominates the effects of any interior lights during a sunny day. The paths of light ray 400 and light ray 402 depict the ways in which reflectance and transmission affect the visibility of a screen for an outside observer of an exterior screen.

For example, light 402 travels toward glass 406 and reflects off element 408 in a direction away from glass 406. Reflectance is the ratio of light that is reflected by an object compared to the total amount of light that is incident on the object. Solid, non-incandescent objects are generally viewed in reflection. (It is also possible to view an object in an aperture mode where it is visible due to its contrast with a light source from behind it. A smaller screen element size decreases the visibility of a screen viewed in the aperture mode.) Accordingly, objects generally appear less visible if they reflect lower amounts of light. A perfectly reflecting surface would have a quantity of 1 for reflectance, while a perfectly absorbing surface would have a quantity of 0 for reflectance.

Another quality that affects the visibility of screening is transmittance. When looking through screening, a viewer sees light emanating from or reflected from objects on the other side of the screening. As transmittance of the screening decreases, the viewer sees less light from the objects on the other side of the screening, and the presence of the screening becomes more apparent. Transmittance is defined as the ratio of light transmitted through a body relative to the total amount of light incident on the body. A value of 0 for transmittance corresponds to an object which light cannot penetrate. A value of 1 for transmittance corresponds to a perfectly transparent object. In the case of a window in a home viewed through an exterior insect screen by an outside observer, the light seen has traveled through the screen twice, as shown in FIG. 4. For example, the light 400 travels away from the viewer and through the screen 404. Next, the light is reflected off the window 406 and travels back through the screen 404 toward the outside viewer's eye.

Reducing the visibility of an exterior screen to an outside viewer is considered the most difficult because the intensity of sunlight is so much greater than lights within a building. If the visibility of an exterior screen for an exterior viewer is minimized, the screen will also be less visible for an inside viewer of an exterior screen, and for an inside and outside viewer of an interior screen. However, another important optical feature for invisibility of a screen to an inside viewer is a small element size, as will be further discussed. If the reflectance is minimized, the transmittance is maximized, and the screen element diameter is sufficiently small, the screening will be much less perceptible to inside viewers than conventional screens.

To achieve an insect screen that has reduced visibility, it is desirable to design insect screens with a low reflectance and high transmittance. Material choices and characteristics like color and texture can reduce reflectance. For example, dark matte colors reflect less light than light glossy colors or shiny surfaces. Reducing the cross-sectional area of the material and increasing the distance between the screen elements can increase transmittance. However, material that is too thin may not be strong enough to function properly in a typical dwelling. Similarly, insects may be able to pass through the screen if the distance between the elements is too large. Therefore, it is desirable to obtain a combination of strength, optical and mechanical characteristics within functional limits to achieve a screen with reduced visibility.

Inside and Outside Viewers

Figure 5:
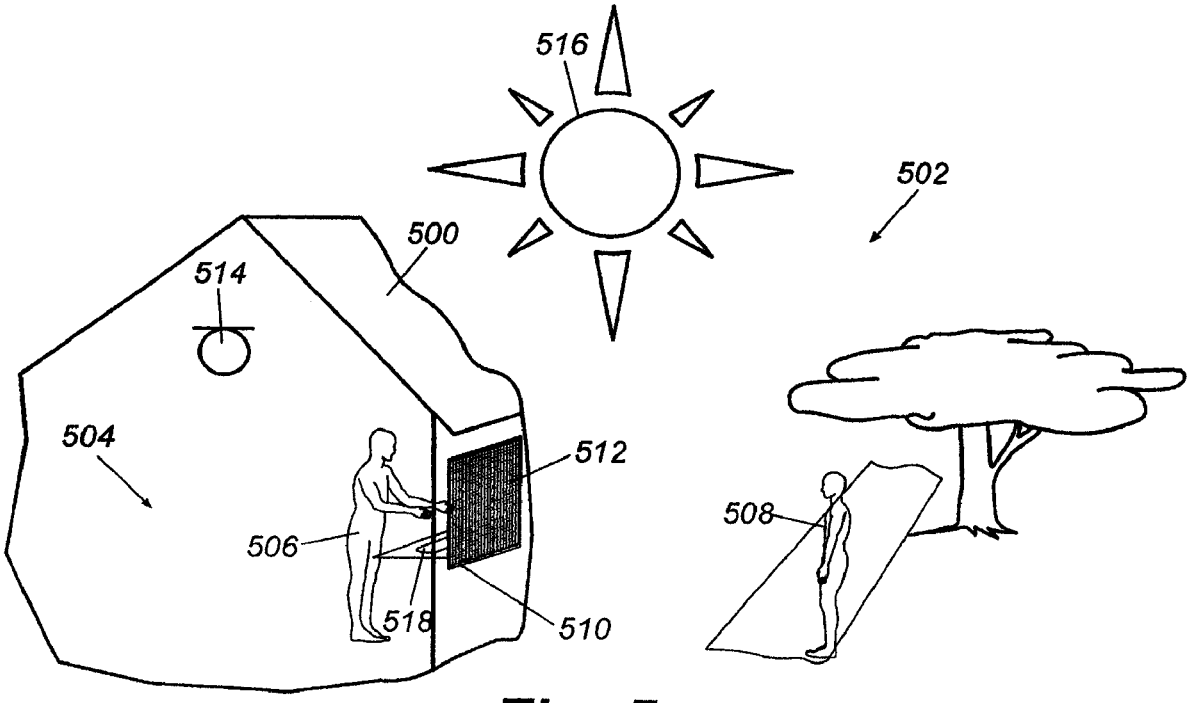
FIG. 5 is an illustration of inside and outside viewing perspectives of an insect screen on a window unit.

With reference to FIG. 5, a cross-sectional view of a dwelling 500 is shown to illustrate how inside and outside observers view screens. Dwelling 500 separates the outside 502 from the inside 504. An inside viewer 506 is illustrated inside 504 of the dwelling 500 while an outside viewer 508 is illustrated outside 502. Window 510 is located in a wall of dwelling 500 and also separates the inside 504 from the outside 502. Screen 512 covers the window 510 on the outside 502 side of window 510.

The inside viewer 506 in FIG. 5 is separated from window 510 by the width of sink 518, which represents a typical close range interior viewing distance, frequently about 2 feet. The closer the viewer 506 stands to the screen 512, the more obvious the screen 512 will appear. For example, at 12 inches, which is a relatively close range interior viewing distance, the normal visual resolution of the human eye is about 0.0035 inch (about 0.0888 mm). Elements having a diameter of less than about 0.0035 inch will likely not be perceived by a viewer of normal eyesight at a distance of 12 inches (30.48 cm). Therefore, the perceived visibility is affected by the diameter of the screen elements and the distance between the viewer 506 and the screen 512. At about 24 inches, the normal visual resolution is about 0.007 inch. For this reason, elements having a diameter of about 0.007 inch will not be resolvable to a viewer at about 24 inches from the screening.

Inside a building or dwelling, interior lighting fixtures such as light 514 provide the primary interior light source that would reflect from the screen. Outside of the dwelling, the sun 516 provides a much stronger light source that will reflect off the screen 512. Accordingly, the reflectance of the screen will generally be of greater importance to the visibility of the screen to the outside viewer 508 than to the inside viewer 506, because much more light is incident on the screen from the exterior 502 than from the interior 504. However, the shape of the elements, which are normally round, may cause sunlight to be reflected into the interior of the building, impacting the visibility of the screen to an inside viewer.

The transmittance of the screen affects visibility of the screen for both the inside viewer 506 and the outside viewer 508. The inside viewer 506 views the exterior scene by the sunlight that is reflected off the outside objects and then transmitted through the screening 512. The less light transmitted through the screening 512, the more the inside viewer's perception of the exterior view is negatively affected by the screening. As discussed above in relation to FIG. 4, when looking through the screening, the exterior viewer sees light reflecting from or emanating from the objects on the interior side of the screening. As the transmittance of the screening decreases, the presence of the screening becomes more apparent.

The perspective of inside and outside viewers has been discussed so far with respect to a screen that is on the exterior side of a window. This is the configuration used in most double hung windows, sliding windows, and sliding doors. However, many window units have screens on the interior side of the window, such as casement windows or awning windows. Where the screen is inside of the glass, the reflectance and transmittance of the insect screening will still impact the visibility of the screen. Generally, screens on the outside of the glass are the most obvious type to the outside viewer, so this is the harder configuration to address for outside viewing. As discussed above, the size of the individual screen elements has an important impact on the visibility of a screen to an inside observer. If a screening possesses reflectance and transmittance qualities that are acceptable for outside viewing, and a sufficiently small element diameter, the screening will also be less visible to the inside observer than conventional insect screens, whether the screen is on the inside or outside of the glass.

Specular Versus Diffuse Reflectance

Figure 9:
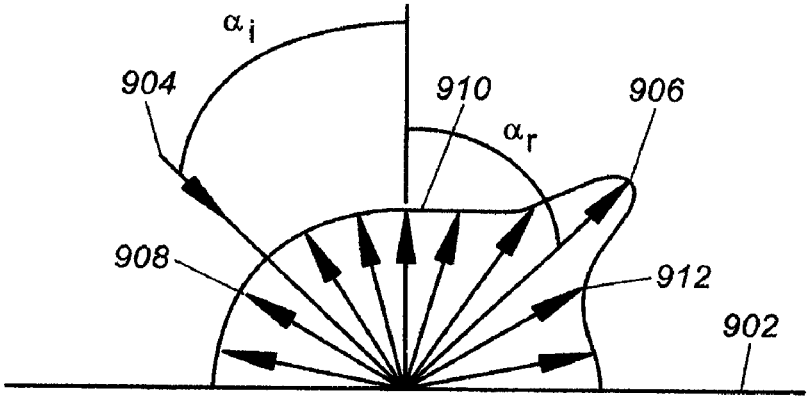
FIG. 9 is a diagram showing specular and diffuse reflections from a matte surface.

FIG. 9 illustrates two types of reflection that occur from surfaces: specular reflection and diffuse reflection. In specular reflection, light has an angle of reflection measured from the normal to the surface that is equal to the angle of incidence of the beam measured from the normal, where the reflected beam is on the opposite side of the normal to the surface from the incident beam. In diffuse reflection, an incident beam of light is reflected at a range of angles that differ significantly from the angle of incidence of the incident parallel beam of light.

In FIG. 9, light rays are shown interacting with a surface 902. Light ray 904 is incident on the surface 902 at an angle of incidence $\alpha_i$. A portion of the light ray 904 is specularly reflected as light ray 906, where the angle of reflection $\alpha_r$ is equal to the angle of incidence $\alpha_i$. However, light rays 908, 910, and 912 are examples of diffusely reflected light rays that are reflected at a range of different reflection angles.

For reducing the visibility of screening, diffuse reflection is preferred over specular reflection because diffuse reflection disperses the power of the incident light over multiple angles. In specular reflection, the light beam is generally redirected to the reflection angle while maintaining much of its power. Providing a dull or roughened surface increases diffuse reflection from a screen mesh.

Reflectance & Transmittance Testing Procedure

Measurements for reflectance and transmittance may be made with an integrating sphere spectrophotometer. For the purposes of the data presented herein, a Macbeth Color-Eye 7000 spectrophotometer manufactured by GretagMacbeth of Germany, was used to obtain transmittance and reflectance measurements for wavelengths of 360 to 750 nm.

Figure 15:
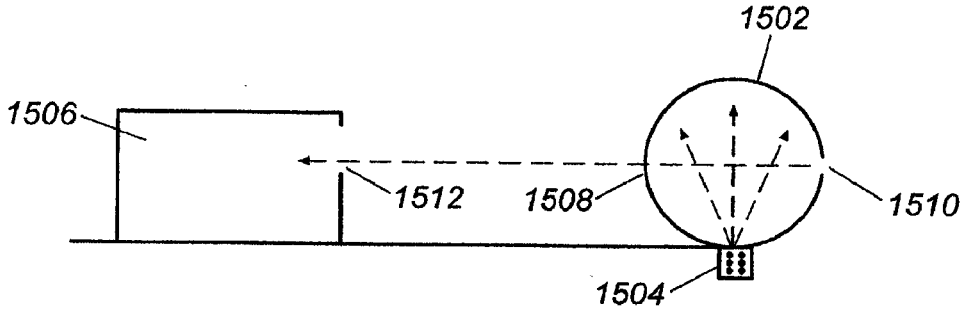
FIG. 15 is a diagram of an integrating sphere spectrophotometer for measuring the reflectance and transmittance of a screen material.

The spectrophotometer shown in FIG. 15 contains an integrating sphere 1502 useful when measuring samples in reflection or transmission. Integrating sphere 1502 contains front port 1510 and exit port 1508. The front port 1510 measures about 25.4 mm in diameter.

A xenon flash lamp 1504 is located at the base of the integrating sphere. Detector 1506 measures the amount of light emitted from integrating sphere 1502. Detector 1506 contains viewing lens 1512 for viewing the light. Viewing lens 1512 contains a large area view.

For reflectance measurement, the spectrophotometer is set to a measurement mode of: CRILL, wherein the letters correspond to the following settings for the machine: C—Reflection, specular included; R—Reflection; I—Included Specular, I—Included LIV; L—Large Lens; L—Large Aperture. When measuring reflectance, the sample is held flat against the front port 1510. Next, a light trap is placed behind the sample to prevent stray light from entering integrating sphere 1502. The light source 1504 emits light into the integrating sphere 1502. Some of the light is reflected off the sample and exits the integrating sphere 1502 through the exit port 1508. Once the light exits the exit port 1508, it enters the detector 1506 through viewing lens 1512. The spectrophotometer produces a number that is a ratio indicating the light reflected by the sample relative to the light reflected by a perfectly reflective surface.

For a transmittance measurement, the spectrophotometer is set to a measurement mode of: BTIILL, wherein the letters correspond to the following settings for the machine: B—Barium; T—Transmittance; I—Included Specular, I—Included LIV; L—Large Lens; L—Large Aperture. The front port 1510 of the spectrophotometer is blocked with an object coated with barium oxide, identical to the interior surface of the sphere 1502. When measuring the transmittance of a sample, it is necessary to hold the sample flat against the exit port 1508 of the integrating sphere 1502. The light source 1504 emits light into the integrating sphere 1502. Some of the light exits the integrating sphere 1502 through exit port 1508. Once the light that is transmitted through the sample enters the detector 1506 through viewing lens 1512, the spectrophotometer produces a number that is a ratio indicating the light transmitted by the sample relative to the light transmitted where there is no sample.

Data collected for reflectance and transmittance for a number of screen samples will be described below with respect to FIGS. 6 and 7.

Data for Reflectance and Transmittance

Table 1 contains average values of test data for optical qualities of insect screening embodiments.

TABLE 1

Optical Data for Examples

| Sample | Description | Transmittance | Reflectance |
|---|---|---|---|
| 1 | Black Zn Cr | 0.828 | 0.006 |
| 2 | Flat Paint | 0.804 | 0.012 |
| 3 | Glossy Paint | 0.821 | 0.014 |
| 4 | Black Ink | 0.874 | 0.013 |
| 5 | PVD Cr(x)C(y) | 0.887 | 0.019 |
| 6 | Stainless Steel Base | 0.897 | 0.044 |

Examples of the present invention will now be described. Six different samples were prepared and tested for optical qualities related to the present invention.

Figure 10:
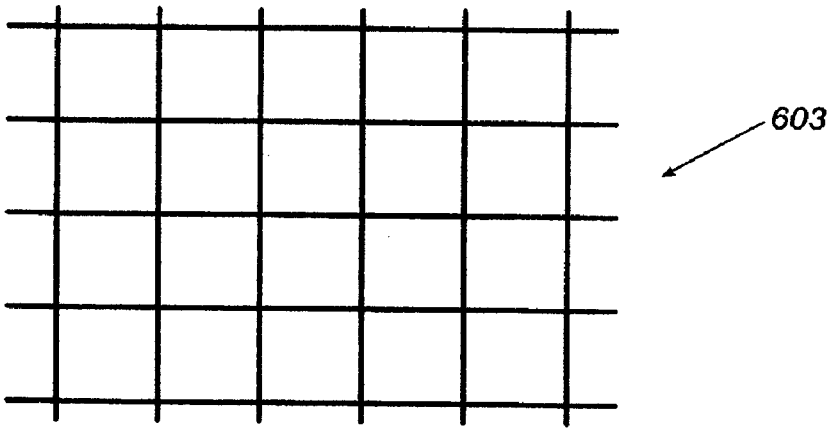
FIG. 10 is a photograph taken through a microscope of uncoated screen elements.

Each of Samples 1-6 was formed by starting with a base screening of stainless steel elements having a diameter of 0.0012 inch. The elements are made of type 304 stainless steel wire. The base screening has 50 elements per inch in both horizontal and vertical directions. It is a woven material and has openings with a dimension of 0.0188 inch by 0.0188 inch. The open area of this base material is about 88% relative to the area of a given screen sample, measured experimentally using a technique that will be described further herein. This material is commercially available from TWP, Inc. of Berkley, Calif. Sample 6 is the base screening without any coating. FIG. 10 is a photograph of Sample 6 taken through a microscope.

Figure 11:
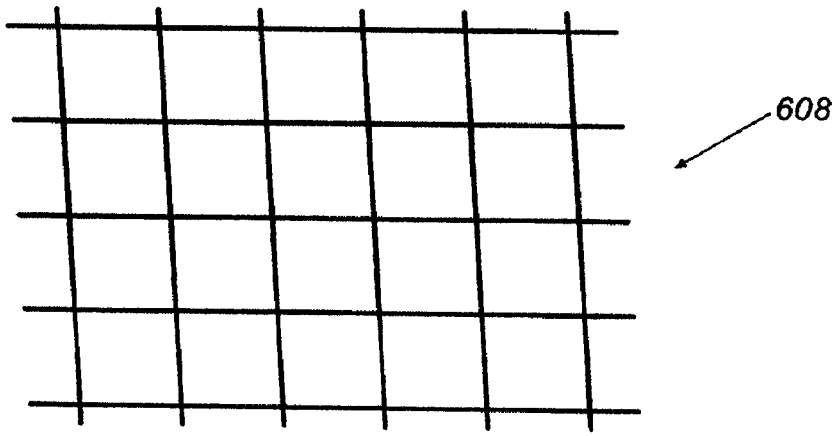
FIG. 11 is a photograph taken through a microscope of stainless steel screen elements coated with a coating of electrodeposited black zinc.

To form Sample 1, the base screening was coated by electroplating it with zinc and then a conversion coating of silver chromate was applied. The zinc reacts with the silver chromate to form a black film on the surface of the screen elements. Sample 1 is shown in FIG. 11. The black zinc coating bonds the horizontal and vertical screen elements together at their intersections. The coating increases the thickness of the screen element and therefore reduces the transmittance of the resulting screening by about 0.07 compared to the uncoated screening of Sample 6. The black finish decreases reflectance of incident light dramatically compared to the uncoated Sample 6.

Figure 12:
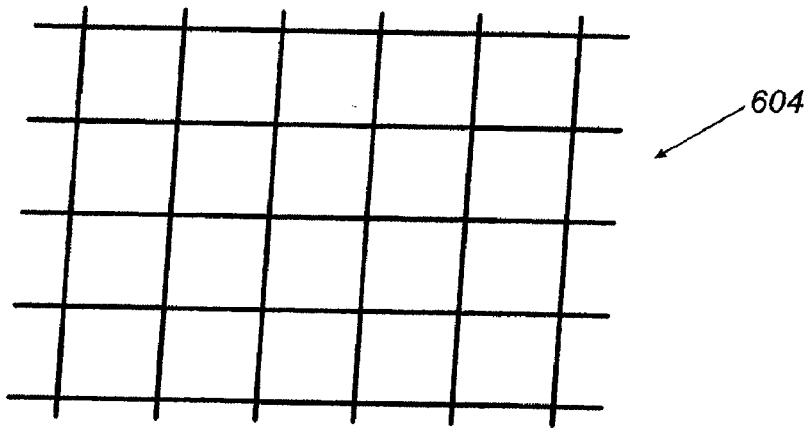
FIG. 12 is a photograph taken through a microscope of stainless steel screen elements coated with flat paint.
Figure 13:
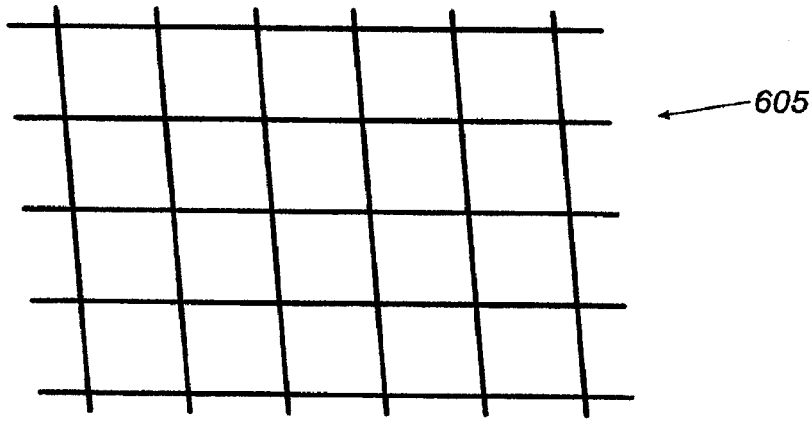
FIG. 13 is a photograph taken through a microscope of stainless steel screen elements coated with gloss paint.

To form Samples 2 and 3, the base screening was coated with about two to three coats of flat black paint and glossy black paint, respectively. As the paint was being applied manually, the painter visually inspected the surface and attempted to apply a uniform coating of paint. Depending on the speed of the spray apparatus passing over the various portions of the surface, two or three coats were applied to different areas of Samples 2 and 3, based on the painter's visual observations, to achieve a fairly even application of paint. Photographs of Samples 2 and 3 taken through a microscope are shown in FIGS. 12 and 13, respectively. The paint coating joins the horizontal and vertical screen elements together at their intersections and provides a black finish. The coating increases the thickness of the screen element and therefore reduces the transmittance of the resulting screening compared to the uncoated screening of Sample 6. The black color of both Samples 2 and 3 decreases reflectance of incident light compared to the uncoated Sample 6, with the flat black paint of Sample 2 having a lower reflectance than the glossy paint.

Sample 4 was coated with black ink. The application of ink to the screening does not significantly bond or join the horizontal and vertical screen elements together at their intersections. The coating of ink increases the thickness of the screen element a small amount and therefore reduces the transmittance of the resulting screening compared to the uncoated screening of Sample 6. The black finish decreases the reflectance of incident light compared to the uncoated Sample 6.

Figure 14:
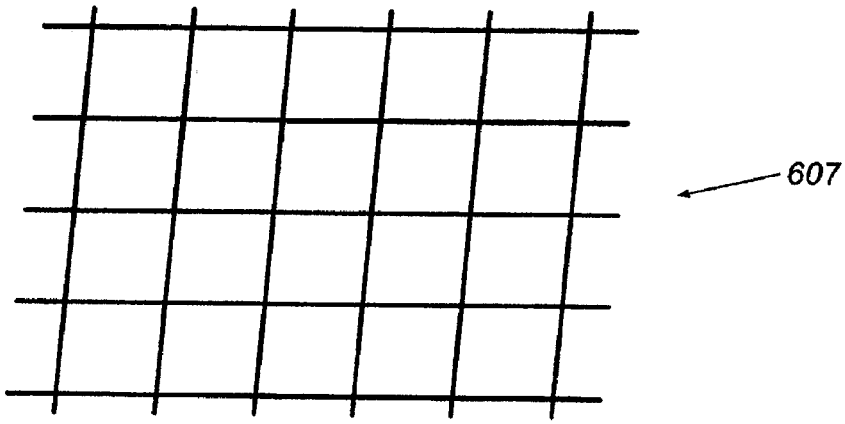
FIG. 14 is a photograph taken through a microscope of stainless steel screen elements coated with chromium carbide through a physical vapor deposition (PVD) process.

Sample 5 was coated with chromium carbide by physical vapor deposition (PVD). A photograph taken through a microscope of Sample 5 is shown in FIG. 14. The chromium carbide coating does not bond the horizontal and vertical screen elements together at their intersections, but does provide a black finish. The coating increases the thickness of the screen element very slightly and therefore reduces the transmittance of the resulting screening compared to the uncoated screening of Sample 6. The black finish decreases reflectance of incident light compared to the uncoated Sample 6.

Several commercially available insect screenings were tested for their optical qualities as a basis for comparison to the samples of the invention. The following table contains average values of actual test data from each material.

TABLE 2

Optical Data for Comparative Examples

| Sample | Description (material, color, manufacturer, trade name if any) | Transmittance | Reflectance |
|---|---|---|---|
| A | Al Gray, Andersen Windows | 0.658 | 0.025 |
| B | FG, Black, Andersen Windows | 0.576 | 0.029 |
| C | FG, Black, Phifer | 0.625 | 0.025 |
| D | Al, metallic, Phifer, Brite-Kote ™ | 0.779 | 0.095 |
| E | Al, Charcoal, Phifer, Pet Screen ® | 0.741 | 0.019 |
| F | Polyester, Black, Phifer, Pet Screen ® | 0.363 | 0.024 |
| G | FG, Gray, Phifer | 0.652 | 0.060 |

Samples A, D and E are made of aluminum elements. Samples B, C, and G are made of vinyl-coated fiberglass elements. Sample F is made of a polyester material.

Figure 6:
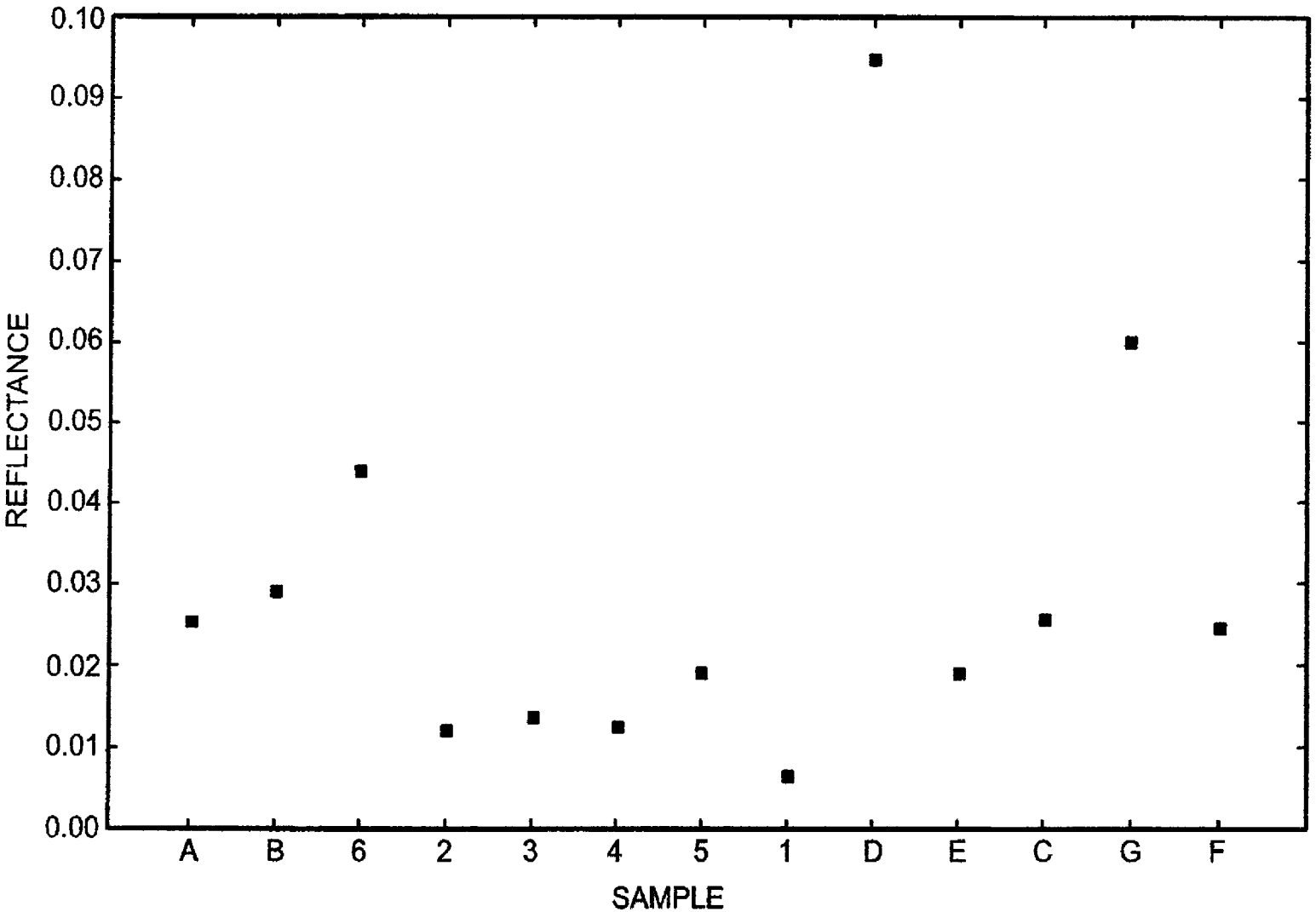
FIG. 6 is a graph showing the reflectance for embodiments of the invention and comparative example screen embodiments.

FIG. 6 shows a comparison of reflectance values for both commercially available screening Samples A-G and screenings of the present invention Samples 1-6. Lower values for reflectance correspond to screening that appears more invisible because less light is reflected in the direction of the viewer. Samples 1-4 have the lowest values for reflectance. The least reflective commercially available Sample E has an average reflectance value of 0.019, which is equivalent to the average value of the second-most reflective Sample 5.

Figure 7:
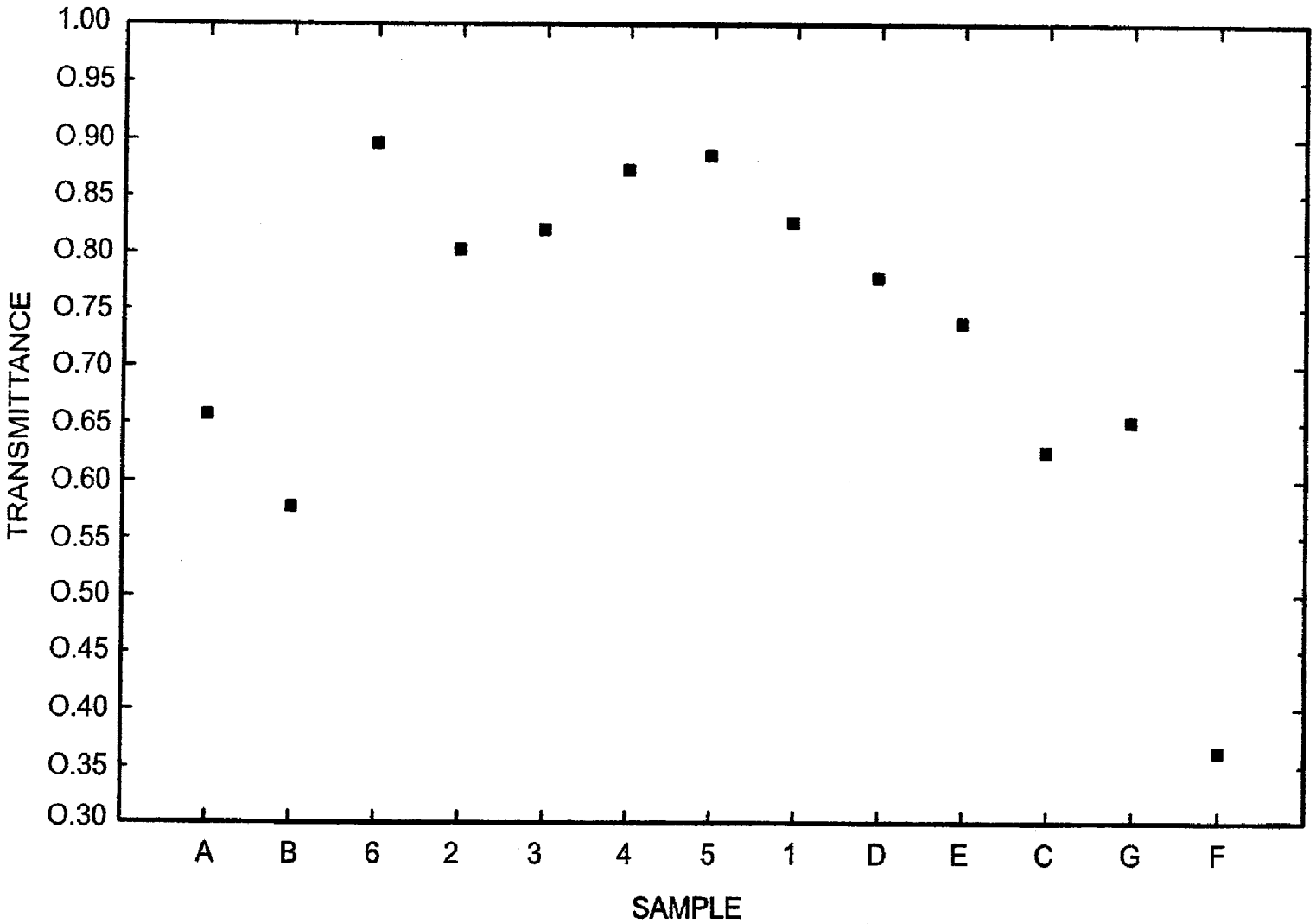
FIG. 7 is a graph showing the transmittance for embodiments of the invention and comparative example screen embodiments.

FIG. 7 shows a comparison of transmittance values for the screen materials set forth in the tables above. Higher values for transmittance correspond to screens with preferred optical qualities. Screening Samples 1-6 have higher transmittance values than the commercially available Samples A-G.

Figure 8:
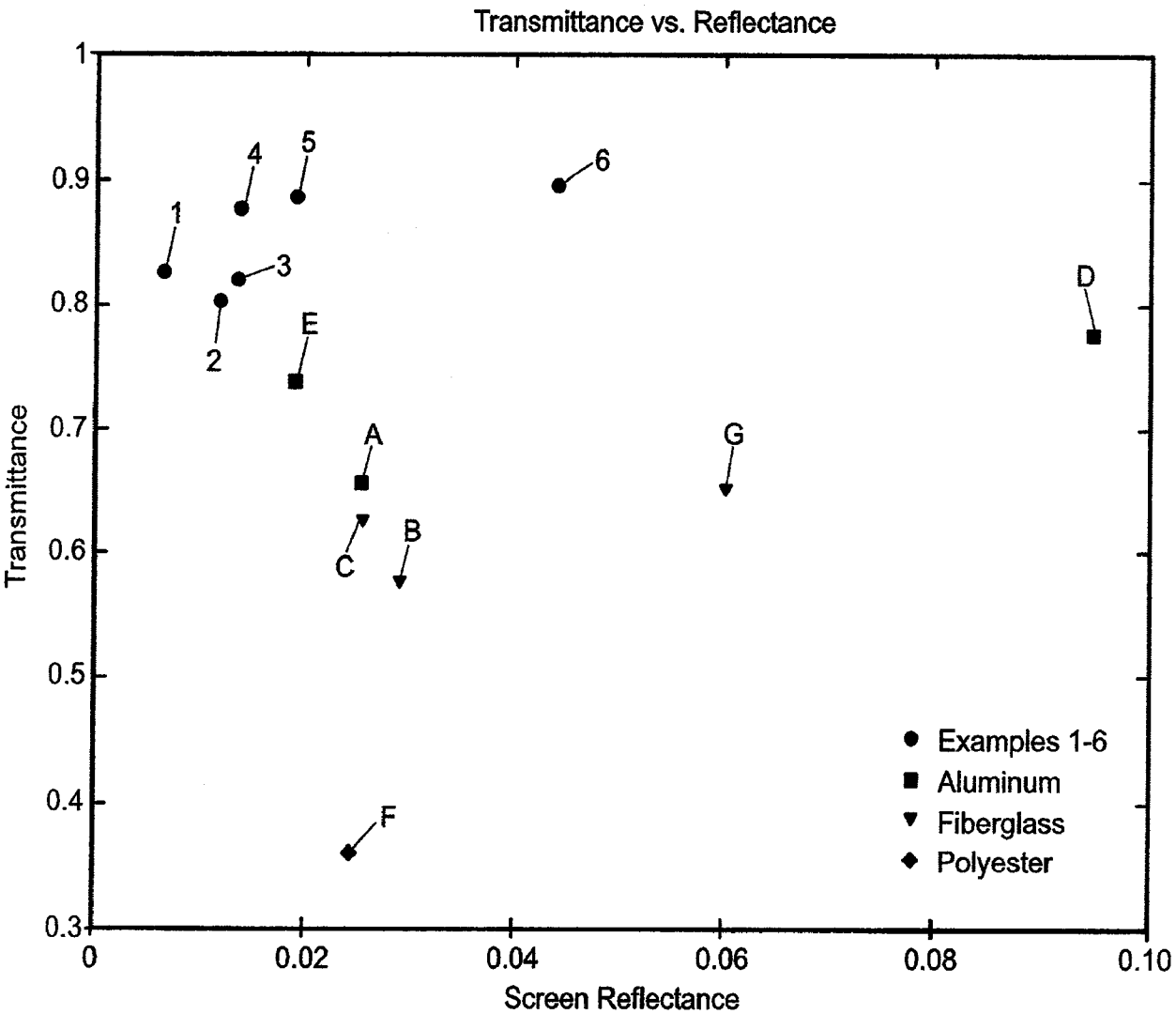
FIG. 8 is a graph showing the transmittance versus the reflectance for embodiments of the invention and comparative example screens.

FIG. 8 is a graph of transmittance versus reflectance for the screen materials set forth in the tables above. Samples 1-5 all have a transmittance of at least about 0.80 and a reflectance of no more than about 0.020. None of the comparative samples have a transmittance greater than 0.78. None of the comparative samples have both a transmittance of greater than 0.75 or 0.80 and a reflectance of less than 0.020, 0.025, 0.030 or 0.040, while samples 1-5 have those qualities.

Percent Open Area

The percent open area also relates to the invisibility of an insect screen. Assuming a square mesh, the percent open area (POA) can be computed as follows:

$$POA=((W/(D+W)))^{2}*100$$

where:

D=element diameter, and W=opening width.

Many commercially available screenings have a rectangular mesh. The POA for a rectangular mesh can be computed as follows:

$$POA=(1-N*D)(1-n*d)*100$$

where:

N=number of elements per inch in a first direction,

D=element diameter of the elements extending in the first direction, n=number of elements per inch in a second direction, and d=element diameter of the elements extending in the second direction Generally, screens appear less visible if they contain a larger percentage of open area. For example, Sample 6 has about 88% open area, corresponding to 50 elements per inch in either direction, screen elements of woven 0.0012-inch (0.03-mm) type 304 stainless steel wire, and openings sized 0.0188 inch (0.5 mm)×0.0188 inch (0.5 mm).

In contrast, standard insect screening has about 70% open area and often has opening sizes of 0.05 inch by 0.04 inch. Standard gnat-rated insect screens often have a percent open area of about 60% and opening sizes of about 0.037 inch by 0.037 inch with elements of about 0.013 diameter.

Decreasing the wire diameter can increase the percent open area. It is desirable to select a wire diameter that allows for the largest percent open area while maintaining suitable strength. Screening is commercially available made of unwelded 5056 aluminum wire of 0.011-inch (0.279 mm) diameter. The term unwelded indicates that the horizontal and vertical elements are not bonded or welded together at their intersections. Importantly, type 304 stainless steel wire has almost three times the tensile strength of 5056 aluminum wire. Accordingly it is possible to use a smaller wire diameter of 0.0066 inch (0.1676 mm) of type 304 stainless steel to achieve tensile strength similar to the 5056-aluminum screening.

Additional materials may be selected within the scope of the present invention to increase the percent open area by decreasing the diameter of the screen elements. These materials include, but are not limited to: steel, aluminum and its alloys, ultra high molecular weight (UHMW) polyethylene, polyesters, modified nylons, and aramids. It is also possible to use an array of man-made fibers for generalized use in the industrial arts. An example of this material is sold under the trademark KEVLAR®.

Generally, the percent open area corresponds roughly to the percentage of transmittance through a particular screening. However, accepted techniques for calculating percent open area like those expressed above do not account for the elements crossing each other in the screening, and therefore over-estimate the percent open area by a few percent. The amount of error inherent in these calculations depends on the thickness of the wire.

Strength of Screen Elements

Figure 18:
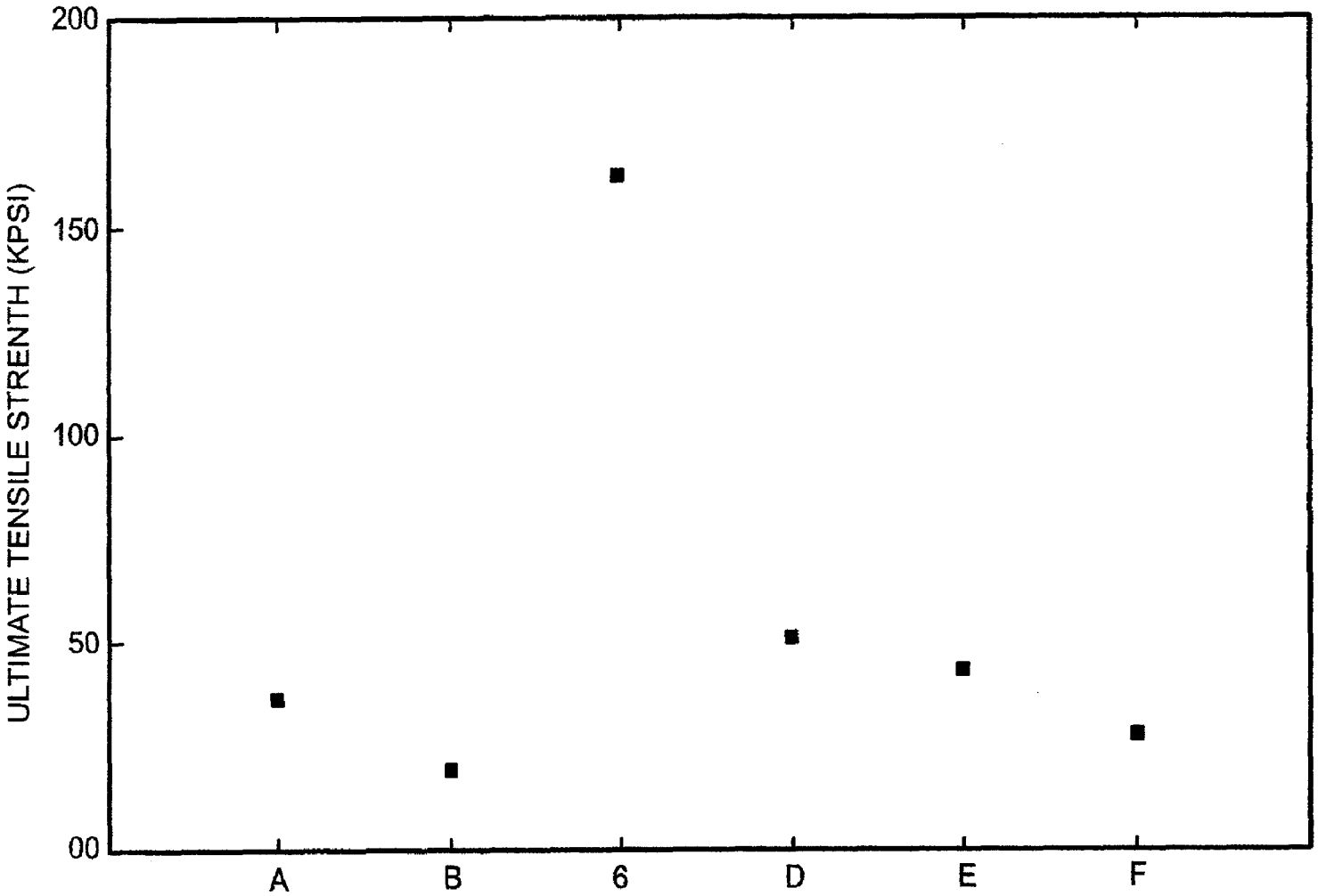
FIG. 18 is a graph showing the single element ultimate tensile strength for embodiments of the invention and comparative example screen embodiments.

FIG. 18 illustrates the single element ultimate tensile strength for elements of Sample 6 and comparative Samples A, B, D, E and F. Samples 1-5 consist of the same material as Sample 6 but with a coating added. Therefore Samples 1-5 have ultimate tensile strengths that are about the same as for Sample 6. The electroplated zinc coating applied to Sample 1 may in fact increase the ultimate tensile strength of those elements.

As discussed above, the diameter of the elements in Sample 6 is much smaller than commercially available insect screen elements. Therefore, inventive elements must have a higher tensile strength than elements used in prior screening materials to achieve similar strength specifications as prior screening materials. In FIG. 18, ultimate tensile strength is charted in Ksi or 1000×psi. The tensile strength for the elements of Sample 6 is about 162 Ksi, which is over three times stronger than Sample D, which is the strongest element in the commercially available Samples A, B, D, E and F. A minimum desirable tensile strength for the screen elements is about 5500 psi or more, or about 6000 psi or more. Preferably, at least about a tenth of pound of force is required to cause a single screen element to break. About 0.16-pound force is required to break a 0.0012-inch stainless steel element of Sample 6.

Snag Resistance

Snag resistance is a measure of how a screen reacts to forces that could cause a break, pull, or tear in the screen elements, such as clawing of the screening by a cat. Snag resistance is important because birds, household animals, and projectiles come into contact with screens.

Figure 16:
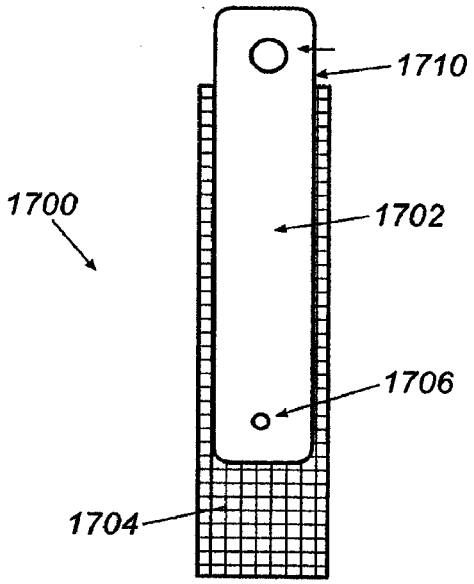
FIG. 16 is a front view of a test fixture for measuring the snag resistance of a screen material.
Figure 17:
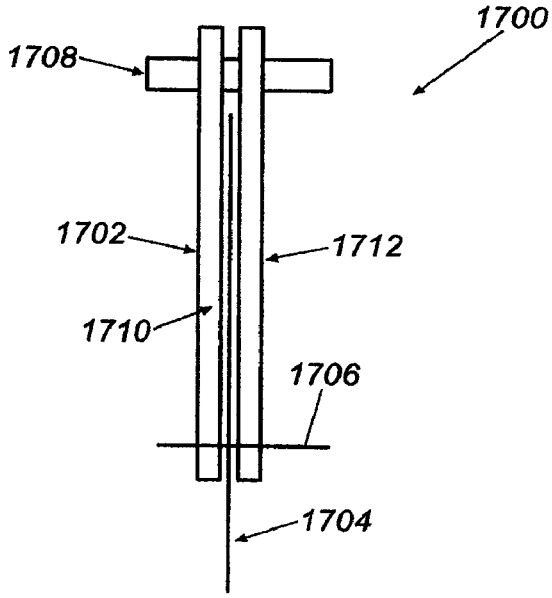
FIG. 17 is a side view of the test fixture of FIG. 16.

FIGS. 16 and 17 show a test fixture 1700 used to measure snag resistance. Test fixture 1700 includes a screen guide 1702 made from two 0.5×6-inch pieces of fiberglass laminate material 1710 and 1712. The pieces 1710 and 1712 are approximately 0.060 inches thick and arc used to guide the screen cloth 1704 during the test by placing the screen cloth 1704 between pieces 1710 and 1712 of screen guide 1702. The pieces 1710 and 1712 contain an upper clearance hole to attach the screen guide 1702 to an instrument that measures the maximum load. Pieces 1710 and 1712 also contain a lower clearance hole to support a snagging mandrill 1706.

When preparing a sample of screening 1704 for a test, a 2-inch×6-inch sample strip of screen 1704 is cut out so that the warp and weft directions lie with and perpendicular to the test direction. The warp direction is along the length of a woven material while the weft direction is across the length of the woven material. The screen guide 1702 is hung from a load cell gooseneck and a snagging mandrill 1706 is carefully passed through the screen 1704. The test is started and the snag mandrill 1706 is moved through the screen 1704 at the rate of 0.5 inch/minute and continued until 0.5 inch is traveled. At this point, the test is terminated and the sample is removed. Care must be taken not to damage the sample when removing it from the test fixture. Several measurements may be recorded, including the maximum load obtained and the load at a specific extension divided by the extension (lb-force/in).

Samples were also visually inspected to determine the failure mode. Three failure modes are generally possible with insect screens. The first failure mode is element breakage because the joints hold and the sections of element between the joints break. The second failure mode is joint breakage. This occurs when the elements hold and the joints break. The third failure mode occurs when the elements break and the joints slip. This third failure mode is a combination of element breakage and joint breakage. Generally, element breakage is the preferred failure mode because it disturbs less surface area on the screen.

Figure 19:
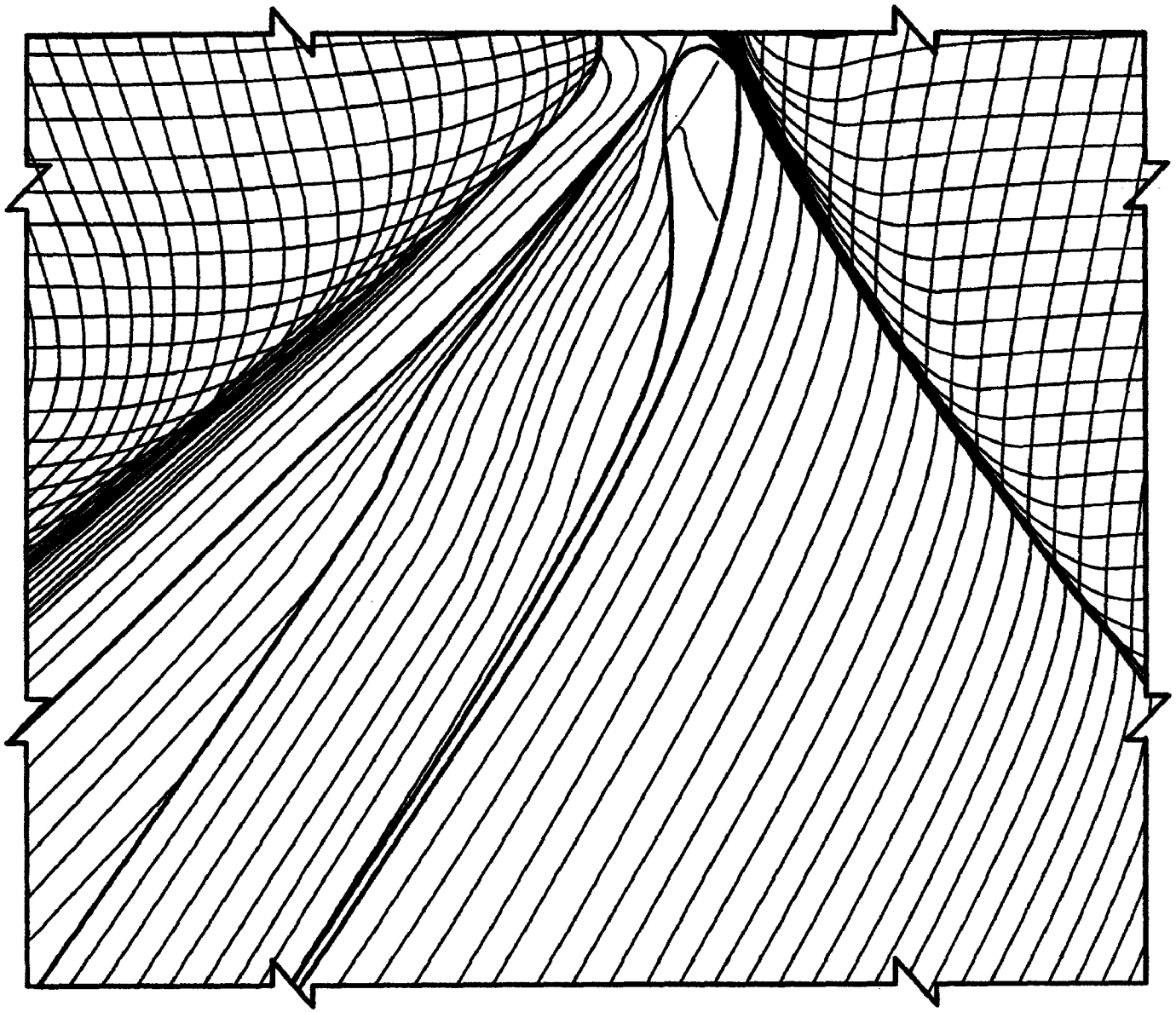
FIG. 19 is a depiction of a snag on an unbonded insect screening.

FIG. 19 illustrates a screen with unbonded elements corresponding to Sample 6 after undergoing the snag resistance test described above. The screen elements appear to have slid together due to the force of the snagging mandrill 1706. FIG. 19 is generally an example of the joint breakage failure mode. As no coating forms a bond at the intersections of the elements in Sample 6, any joint strength is due to frictional forces between the elements in the weave.

Figure 20:
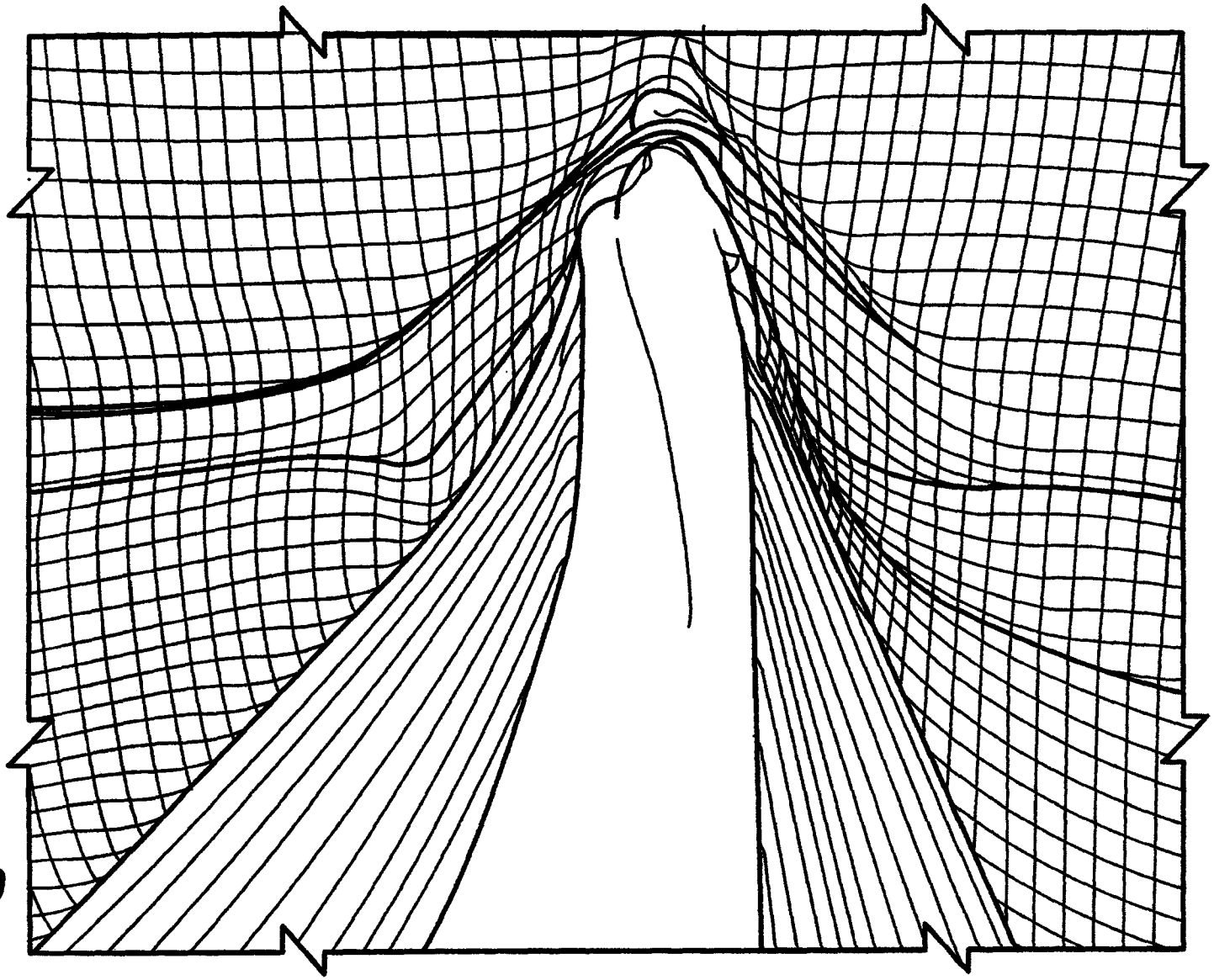
FIG. 20 is a depiction of a snag on an insect screening having a paint coating.
Figure 21:
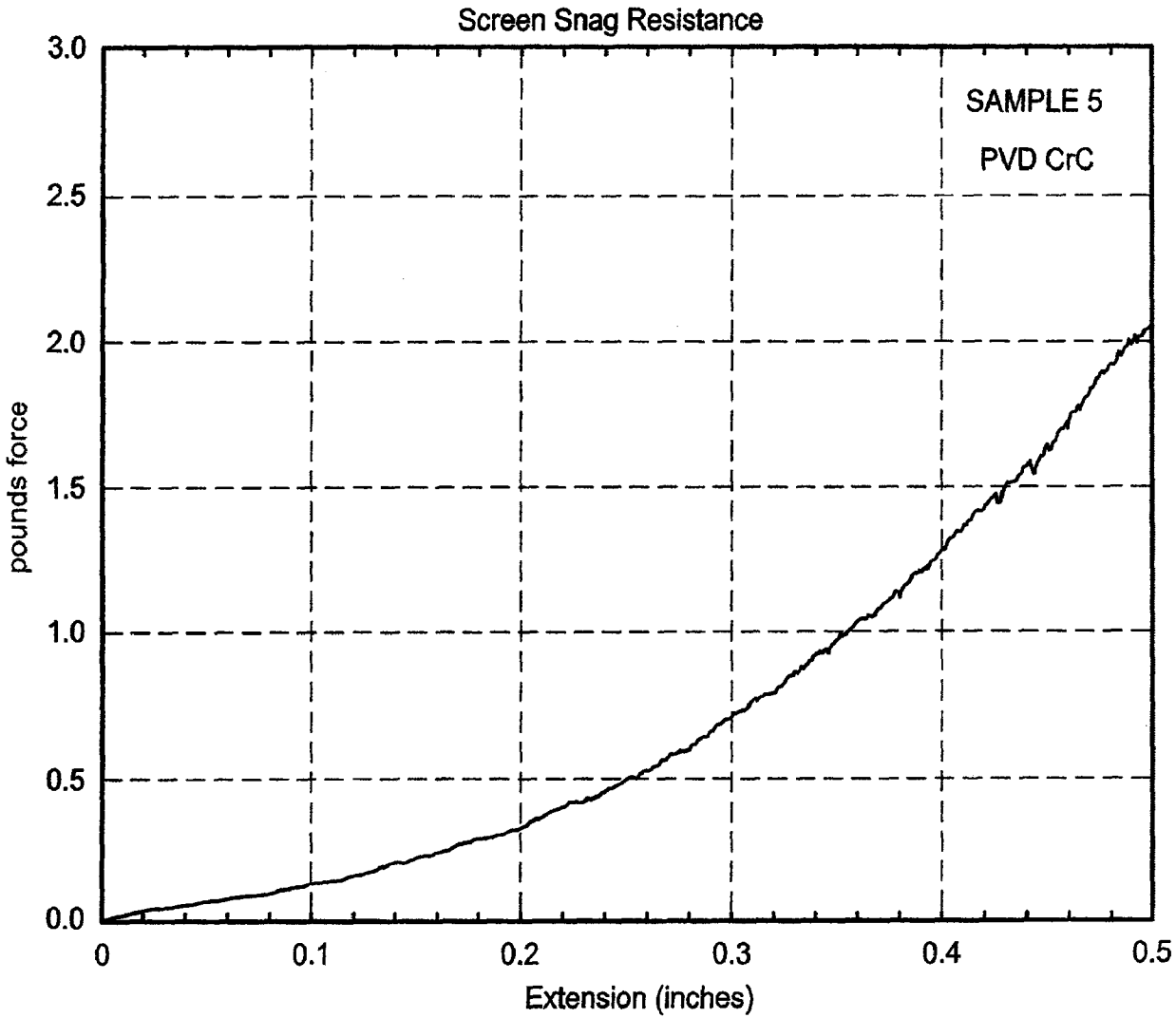
FIGS. 21-25 are graphs plotting pounds of force applied to a rigid element versus inches of travel as the element moved against a screen mesh fabric for a snag resistance test for five different examples of the invention.
Figure 22:
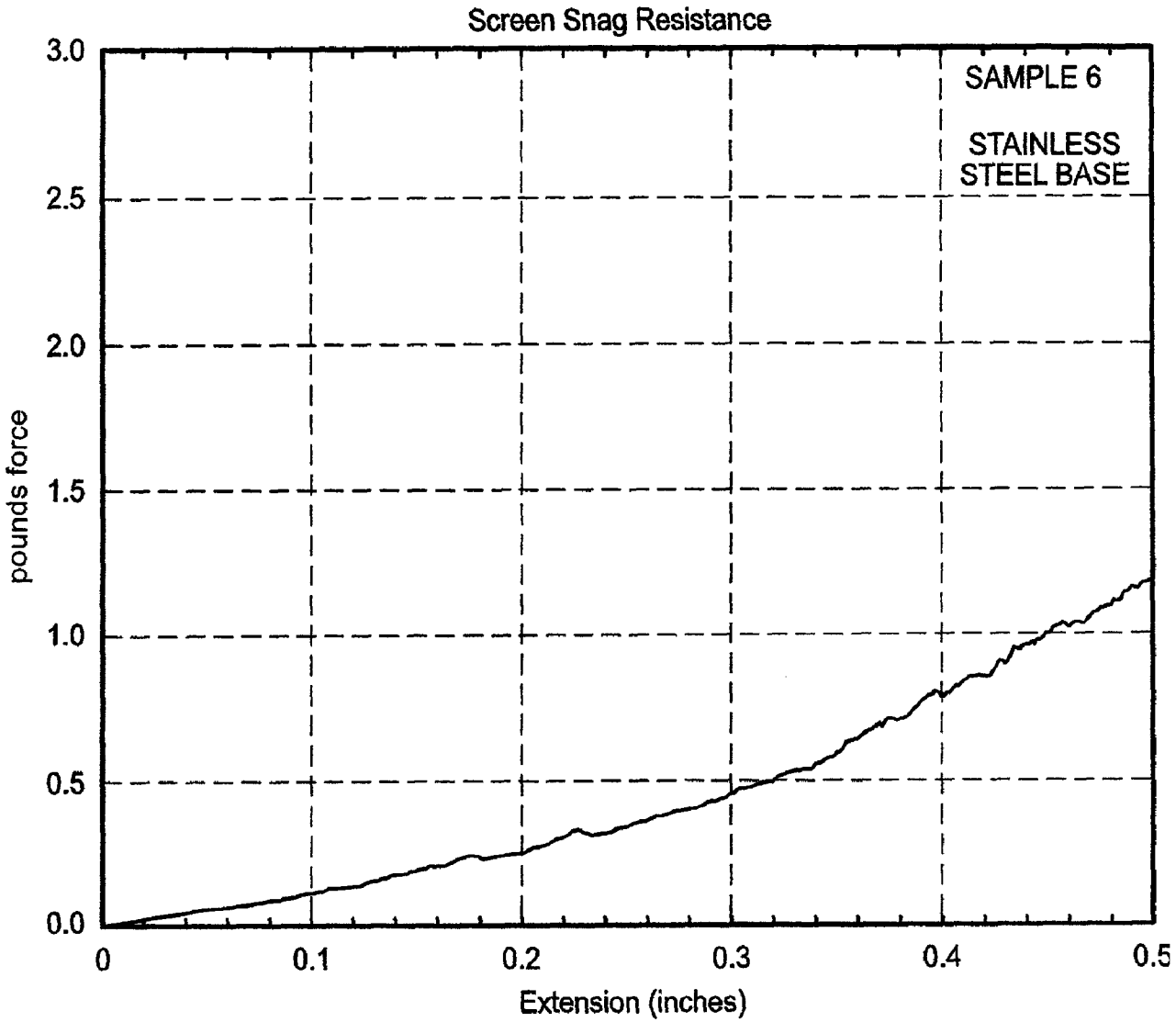
Figure 23:
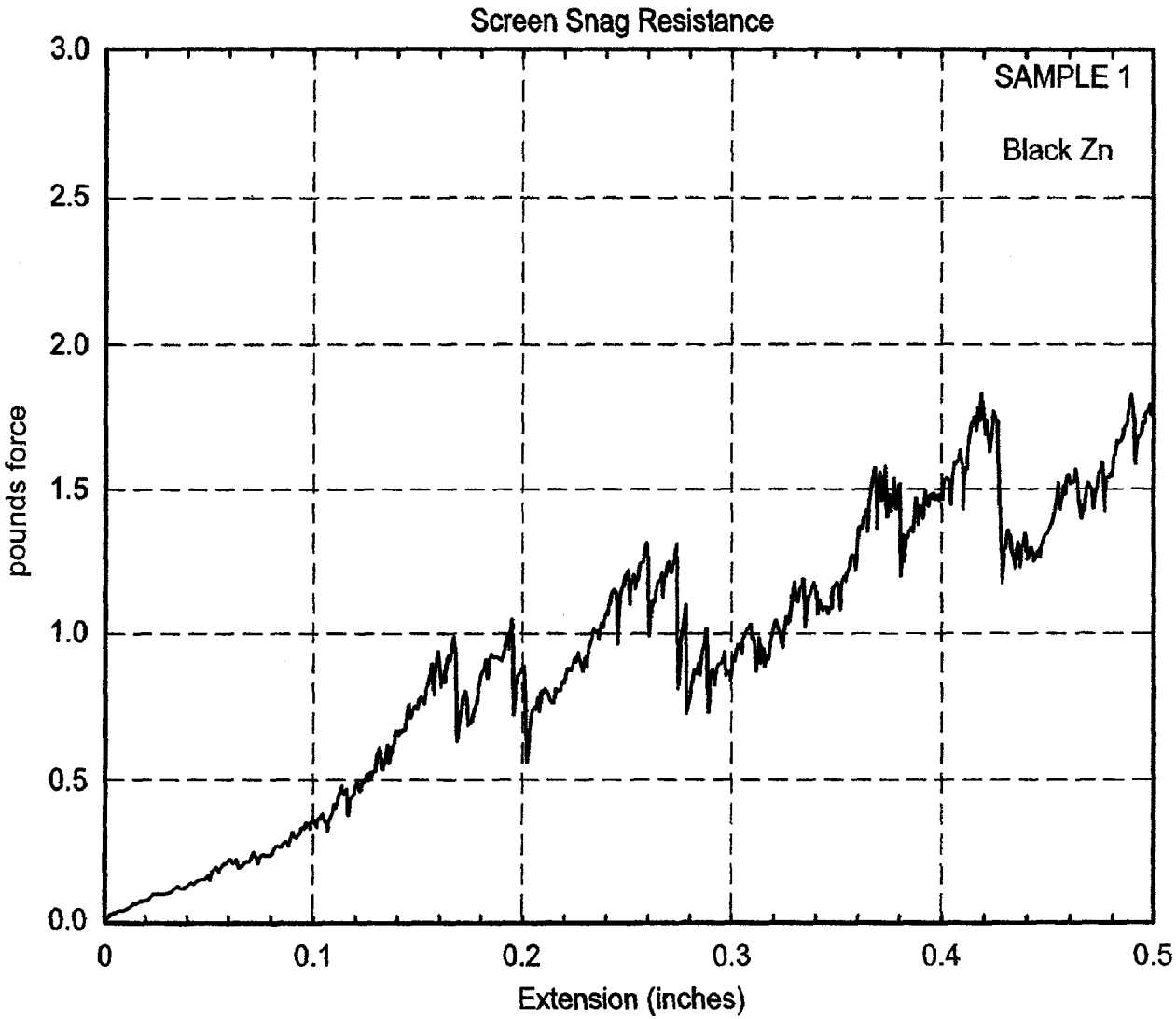
Figure 24:
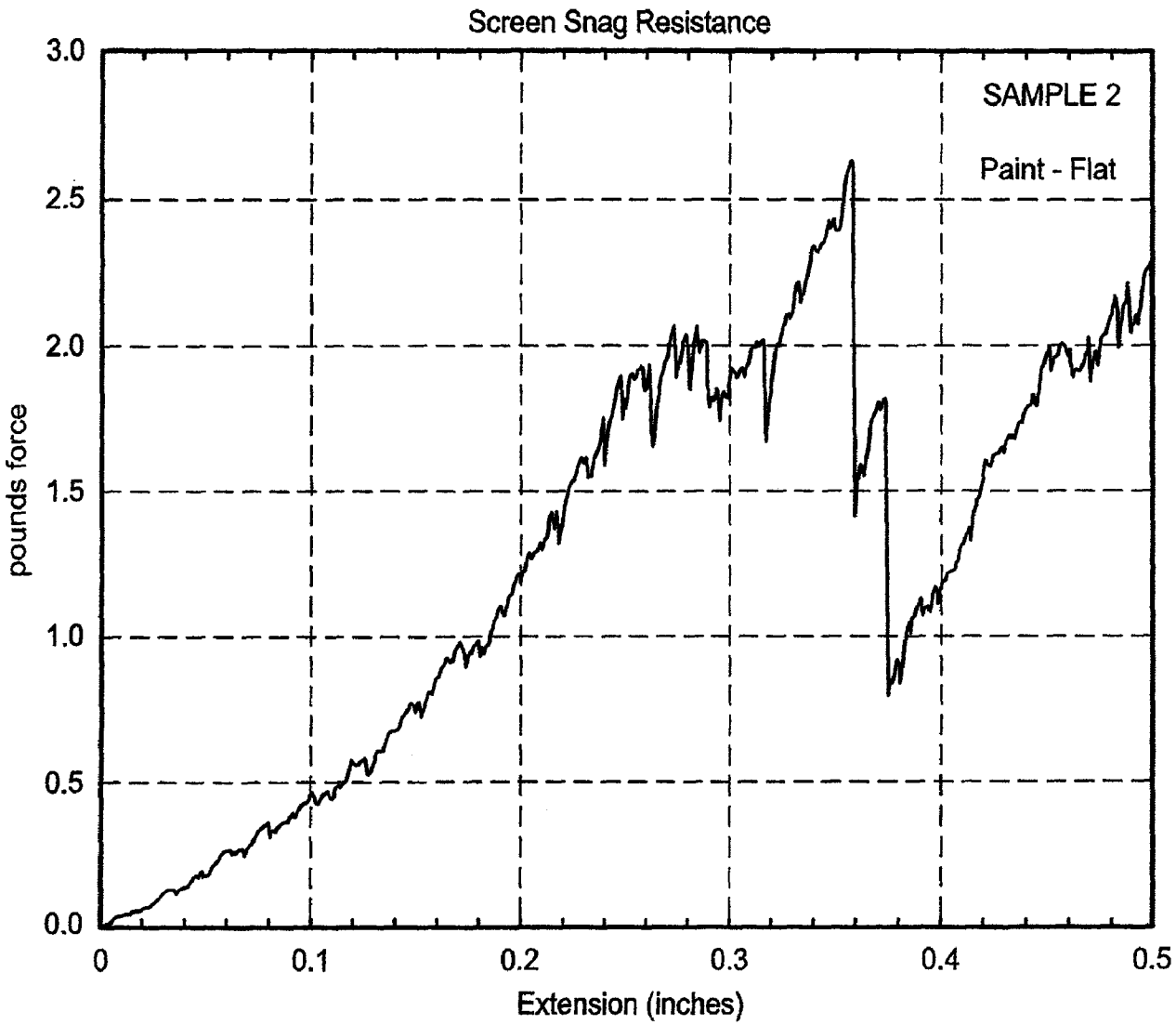
Figure 25:
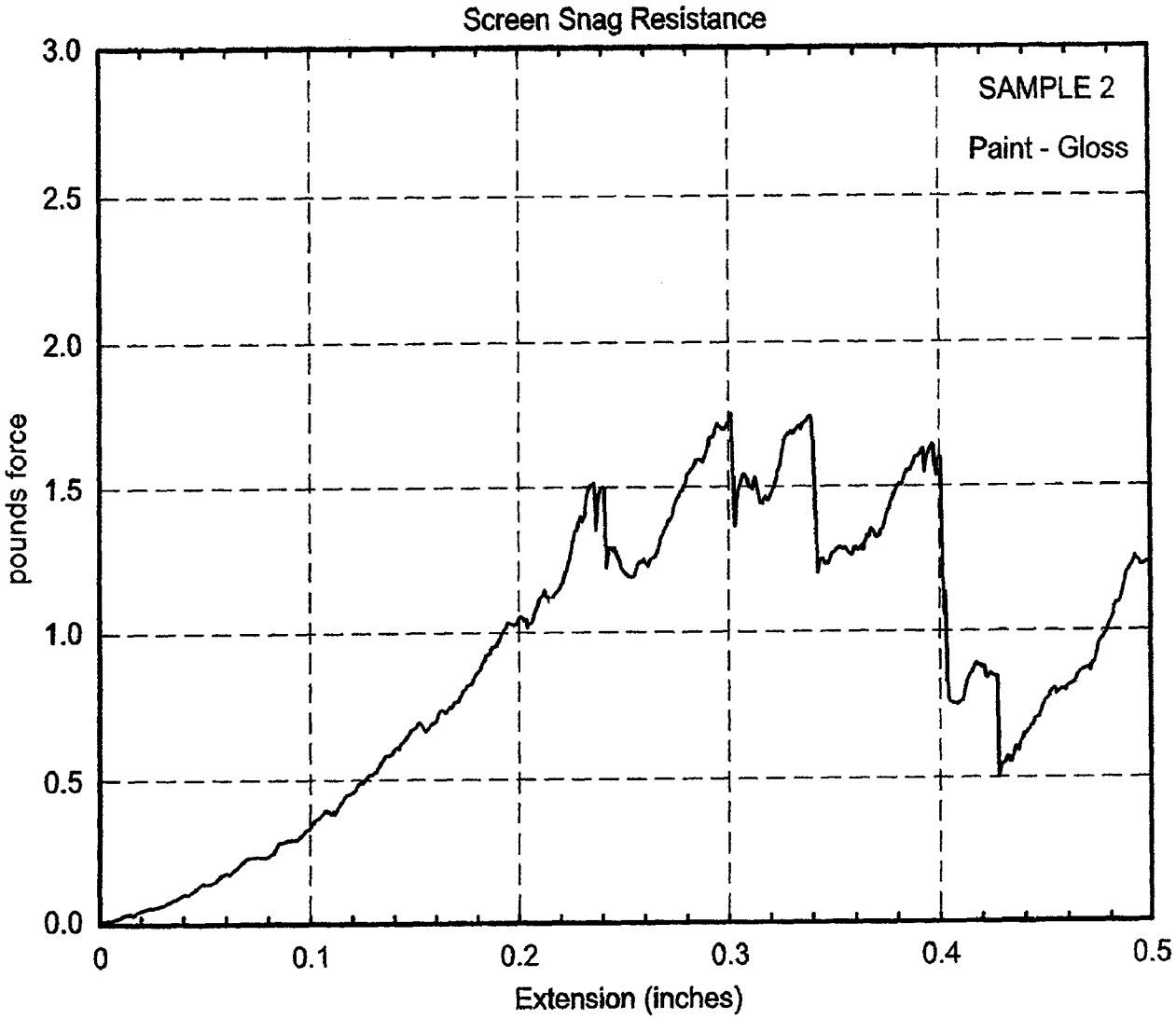

Conversely, FIG. 20 shows a screen with elements coated and joined at their intersections by paint after undergoing the snag resistance test. Unlike the unbonded elements shown in FIG. 19, the painted elements appear to have broken at several locations rather than merely sliding together. FIG. 20 is an example of the element breakage and joint breakage failure mode discussed above. The failure mode shown in FIG. 20 is preferred over the failure mode shown in FIG. 19 because less surface area is disturbed on the screen, creating a more desirable appearance, and a less visible screening, after a snag.

To achieve an element breakage mode, the joint strength needs to be sufficient to cause the elements to give way before the joints when a snagging force is applied to the screening. On the other hand, it may be desirable in some situations to select element and joint strength so that joint breakage occurs before element breakage, resulting in a more resilient screen. When a force is applied to this type of screening, the element stays intact while the bonds break or slip. The force on the element is then distributed to the other adjacent bonds.

FIGS. 21-25 illustrate the screen snag resistance of Samples 1-3 and 5-6 in terms of pounds of force versus displacement of the snag mandrill 1706. Samples 5 and 6, shown on FIGS. 21 and 22, respectively, show a relatively smooth curve compared to Samples 1-3, shown on FIGS. 23-25, respectively. A smooth curve indicates that the joints between elements are very weak or not bonded. Sample 4 would likely have results similar to Sample 6 in FIG. 22, as the ink coating does not form significant bonds. The joints on Samples 1-3 are much stronger than the joints on Samples 5 and 6. Accordingly, the graph lines on FIGS. 23-25 for Samples 1-3 have several jagged edges. Each sharp drop in the graph corresponds to an element break or a bond break. Sample 2 was able to withstand the largest amount of force of all the samples before an element or bond break.

Size and Spacing of Exemplary Screen Elements

In FIG. 2, a width or diameter W of the screen elements 70 is illustrated. The width W may be less than about 0.007 inch or 0.0035 inch to fall beneath the visual acuity of a normal viewer at either 24 inches or 12 inches, respectively. The smaller the screen element that meets strength requirements, the less visible will be the insect screening. In another embodiment, W is about 0.001 inch (about 0.0254 mm) to about 0.0015 inch (about 0.0381 mm), or about 0.0012 inch. Stainless steel wire, for example, can be provided in this size range and be sufficiently strong for use in insect screening. Each screen element 70 has a length to span the distance between opposed frame members 50, 60 (FIG. 1).

The plurality of screen elements 70 includes a plurality of horizontal screen elements 80 and a plurality of vertical screen elements 90. The horizontal screen elements 80 are spaced apart from each other a distance $D_V$ and the vertical screen elements 90 are spaced apart from each other a distance $D_H$. The spacing depends on the types of insects the user wishes to exclude. Opening sizes are chosen to exclude the types of insects that the screening is designed to keep out. Preferably, the largest values for $D_H$ and $D_V$ are selected that still exclude the targeted insects, so that transmittance is maximized and reflection is minimized.

A screen mesh that excludes most insects is typically constructed with a $D_V$ and $D_H$ of about 0.040 inch (about 1.016 mm) or 0.050 inch (about 1.27 mm). For a screen mesh for excluding smaller insects, like gnats or no-see-Ums, a smaller mesh opening is necessary, such as a square opening with a $D_H$ and $D_V$ of about 0.037 or 0.04 inch (about 1 mm).

In embodiments of the present invention, $D_H$ and $D_V$ may be less than about 0.060 inch (about 1.523 mm), less than about 0.050 inch (about 1.27 mm), less than about 0.040 inch (about 1.016 mm), or less than about 0.030 inch (about 0.7619 mm). $D_V$ and $D_H$ may be equal to form a square opening, or they may differ so that the mesh opening is rectangular. For example, $D_V$ may be about 0.050 inch (about 1.27 mm) while $D_H$ is about 0.040 inch (about 1.016 mm). All other permutations of the above mentioned dimensions for $D_H$ and $D_V$ are also contemplated. Typically, the vertical and horizontal screen elements are positioned to be perpendicular to each other and aligned with the respective frame members.

Table 3 below lists experimentally measured screen element dimensions for Samples 1-3 and 6. The percent black area is the percentage of the screening that is occupied by the screen elements. The percent open area and the black area add to 100 for a specific screening.

TABLE 3

Dimension Data for Examples

| Screen Sample | 1 Experimentally Measured Percent Black Area | 2 Percent Open Area | 3 Avg. Element Diameter (mm) +/−0.002 | 4 Avg. Element Diameter (mils) +/−0.08 | 5 Avg. Coating Thickness (mm) +/−0.001 | 6 Avg. Coating Thickness (mils) +/−0.1 |
|---|---|---|---|---|---|---|
| 1 Black Zn | 17.0% | 83% | 0.039 | 1.5 | 0.004 | 0.15 |
| 2 Flat Paint | 19.6% | 80.4% | 0.045 | 1.8 | 0.007 | 0.15 |
| 3 Glossy Paint | 18.4% | 81.6% | 0.042 | 1.7 | 0.0006 | 0.24 |

TABLE 3-continued

| Dimension Data for Examples | | | | | | |
|---|---|---|---|---|---|---|
| Screen Sample | 1 Experimentally Measured Percent Black Area | 2 Percent Open Area | 3 Avg. Element Diameter (mm) +/−0.002 | 4 Avg. Element Diameter (mils) +/−0.08 | 5 Avg. Coating Thickness (mm) +/−0.001 | 6 Avg. Coating Thickness (mils) +/−0.1 |
| 6 Stainless Steel Base | 14.1% | 85.9% | 0.033 | 1.3 | — | — |

The experimental measurements of Samples 1-3 and 6 in Table 3 were measured by backlighting a sample of each screening and taking a digital photograph. The percent of black area on the photo image was then measured using image analysis software. Knowing the number of elements that were present in each image and the dimensions of the sample, the average coated element thickness was calculated. For each of Samples 1-6, the underlying uncoated element has a diameter of 0.0012 inch, so this amount was subtracted from the coated element diameter of column 4 to arrive at the average coating thickness of columns 5 and 6.

The PVD CrC coating of Sample 5 and the ink coating of Sample 4 are too thin to be reliably measured by this experimental technique. Based on the deposition technique, the coating of Sample 5 is estimated to be about 0.02 mils (0.5 μm). Because this coating and the ink coating are extremely thin, the percent black area for Samples 4 and 5 are roughly equivalent to the uncoated Sample 6.

The plurality of horizontal and vertical screen elements 80, 90 can be constructed and arranged to form a mesh where a horizontal screen element intersects a vertical screen element perpendicularly. The intersecting horizontal and vertical screen elements 80, 90 may be woven together. Optionally, the intersecting horizontal and vertical screen elements 80, 90 are bonded together at their intersections, as described in more detail below with respect to coating alternatives.

Materials for the Screen Mesh

In order to provide a material for the screening 30 that will withstand the handling that is associated with screen use, several factors are important, such as the screen element diameter and the ultimate tensile strength of the material. In addition, other factors are considered in selecting a material, such as the coefficient of thermal expansion, the brittleness, and the plasticity of a material. The coefficient of thermal expansion is significant because expansion or contraction of the screen elements due to temperature changes may alter the normal alignment of the horizontal and vertical screen elements, thereby leading to visible distortion of the screening.

In one embodiment, materials from the categories of glass fibers, metals or polymers meet the requirements for screen element strength at the desired diameters, such as steel, stainless steel, aluminum, aluminum alloy, polyethylene, ultra high molecular weight polyethylene, polyester, modified nylon, polyamide, polyaramid, and aramid. One material that is particularly suited for the screen elements is stainless steel. The high tensile strength of about 162 Ksi and low coefficient of thermal expansion of about $11\times10^{-6}K^{-1}$ for stainless steel are desirable.

Coating or Finish Alternatives

The surface 100 of the screen elements 70 is a dark, non-reflective, and preferably dull or matte finish. A dark non-reflective, dull or matte finish is defined herein to mean a finish that absorbs a sufficient amount of light such that the screen mesh 30 appears less obtrusive than a screen mesh 30 without such finish. The dark non-reflective or matte finish may be any color that absorbs a substantial amount of light, such as, for example, a black color. The dark non-reflective or matte finish can be applied to the screen element surface 100 by any means available such as, for example, physical vapor deposition, electroplating, anodizing, liquid coating, ion deposition, plasma deposition, vapor deposition, and the like. Liquid coating may be, for example, paint, ink, and the like.

For example, a PVD chromium carbide coating or black zinc coating may be applied to the screen elements in one embodiment. The black zinc coating is preferred to the CrC coating because it is rougher, more matte, and less shiny. Alternatively, glossy or flat black paint or black ink may be applied to the screen elements. The flat paint coating is preferred to the glossy paint coating because it is less reflective. Other carbides can also be used to provide a dark finish, such as titanium aluminum carbide or cobalt carbide.

The use of a coating on the screen elements may provide the additional advantage of forming a bond at the intersections of the screen elements. A coating of paint provides some degree of adhesion of the elements at the intersections. Some coatings such as black zinc create bonds at the intersections of the elements. The coating thickness and overall element diameter for Samples 1-3 and 5-6 are listed in Table 3 above.

The improved screening materials of the invention typically comprise a mesh of elements in a screening material. The elements comprise long fibers having a thin coating disposed uniformly around the fiber. The coating comprises the layer that is about 0.10 to 0.30 mils (about 0.00253 to 0.0076 mm), preferably about 0.15 mils (about 0.0038 mm). Virtually any material can be used in the coating of the invention that is stable to the influence of outdoor light, weather and the mechanical shocks obtained through coating manufacture, screen manufacture, window or door assembly, storage, distribution and installation. Such coatings typically have preferred formation technologies. The coatings of this invention, however, can be made using aqueous or solvent based electroplating, chemical vapor deposition techniques and the application of aqueous or solvent based coating compositions having the right proportions of materials that form the thin durable coatings of the invention. Both organic and inorganic coatings can be used. Examples of organic coatings include finely divided carbon, pigmented polymeric materials derived from aqueous or solvent based paints or coating compositions, chemical vapor deposited organic coatings and similar materials. Inorganic coating compositions can include metallic coatings comprising metals such as aluminum, vanadium, chromium, manganese, iron, nickel, copper, zinc, silver, tin, antimony, titanium, platinum, gold, lead and others. Such metallic coatings can be two or more layers covering the element and can include metal oxide materials, metal carbide materials, metal sulfide materials and other similar metal compounds that can form stable, hard coating layers.

Chemical vapor deposition techniques occur by placing the screening or element substrate in an evacuated chamber or at atmosphere and exposing the substrate to a source of chemical vapor that is typically generated by heating an organic or inorganic substance causing a substantial quantity of chemical vapor to fill the treatment chamber. Since the element or screening provides a low energy location for the chemical vapor, the chemical vapor tends to coat any uncoated surface due to the interaction between the element and the coating material formed within the chamber.

In electroplating techniques, the element or screening is typically placed in an aqueous or solvent based plating bath along with an anode structure and a current is placed through the bath so that the screen acts as the cathode. Typically, coating materials are reduced at the cathode and that electrochemical reduction reaction causes the formation of coatings on the substrate material.

Applications for the Insect Screen

The screening 30 can be used with or without a frame 20 in certain applications, such as in a screen porch or pool enclosure. The insect screen 10 can be used in conjunction with a fenestration unit 110, such as a window or door. The insect screen 10 may be used in any arrangement of components constructed and arranged to interact with an opening in a surface such as, for example, a building wall, roof, or a vehicle wall such as a recreational vehicle wall, and the like. The surface may be an interior or exterior surface. The fenestration unit 110 may be a window (i.e. an opening in a wall or building for admission of light and air that may be closed by casements or sashes containing transparent, translucent or opaque material and may be capable of being opened or closed), such as, for example, a picture window, a bay window, a double-hung window, a skylight, casement window, awning window, gliding window and the like. The fenestration unit 110 may be a doorway or door (i.e. a swinging or sliding barrier by which an entry may be closed and opened), such as, for example, an entry door, a patio door, a French door, a side door, a back door, a storm door, a garage door, a sliding door, and the like.

I. Enhancing Screen Invisibility at Small Wire Diameters by Increasing Mesh Density Several industries utilize screening with varying combinations of properties, such as reduced wire element diameters, increased mesh densities, or a combination thereof. However, these industry applications generally utilize such screens for specific tasks. For example, the sifting or seining art has a wide variety of screens with element diameters and mesh densities covering a wide gamut of values. In the sifting art, these screens generally are used in agglomerate or mixture separation applications to sift, seine, sort, or otherwise pass finer or smaller diameter materials through the screen, while retaining coarser or larger diameter materials in the screen. These screens can be vibrated to accelerate sifting and typically are selected based on application, strength, durability, or other characteristics of the screen elements.

Other industries that utilize screens include screen-printing, hosiery, fishing, and conventional insect screens used in fenestration units. In screen-printing, small diameter element size with varying mesh densities are used to create images. In hosiery, small diameter, high mesh density, colored screens are used to create leggings or other coverings, generally for women. Such hosiery typically includes uncoated elements with low, generally questionable screen element strength and low thresholds for rip-stop tearing. In fishing, netting generally involves larger screen element diameters at varying mesh densities. In conventional insect screens, wire elements generally are selected for strength, durability, and insect exclusion.

These prior applications have not provided a teaching or suggestion to use screening in a fenestration unit that combines smaller wire element diameters with higher mesh density to increase invisibility of the screen. This combination of smaller wire diameter at higher mesh density is a counter-intuitive result that was realized through rigorous testing. While attempting to improve on conventional screens and on the screens detailed in the disclosures that form the parent disclosures of the instant disclosure, it was discovered that, in addition to the known benefits provided by reduced wire element diameters, an increase of mesh density further enhances mesh invisibility. The present disclosure describes the testing procedures utilized to realize this discovery, defines a Dalquist Rating index to rate the clarity of an object or scene through the screening, and summarizes the balance between wire element diameter and mesh density for various applications.

In order to improve the screen described in the parent disclosures, rigorous testing was performed and the results were recorded and analyzed. Originally, it was expected to confirm the intuitive result that decreased mesh densities (i.e. more distance between screen elements) combined with small wire element diameters would result in increased invisibility of screens. However, it was found that, in addition to the benefits provided by reduced wire element diameters, an increase of mesh density (i.e. less distance between screen elements) increases mesh invisibility. As provided in detail herein, this result is counter-intuitive and thus surprising.

Several tests were performed in order to evaluate factors influencing invisibility of a screen. These tests focused on observations of a number of factors, including: mesh count, screen element (wire) diameter, subject lighting, screen lighting, and sight angle. The responses of the viewers were recorded on a scale of one to ten to record a Dalquist Rating, a Mesh Invisibility Distance, and a Grayscale Rating. Throughout the experiments, certain variables were held constant, including coating color, location of screens, standard frames, room lighting, and standard screen dimensions.

Certain terms used throughout this disclosure should be defined or interpreted as follows: "Screen element," "element," or "wire" define the individual strands of material of which the screen is formed. One of ordinary skill will understand that these terms are not limited to elements made of any particular material, encompass screens formed of any material or combination, and should not be limited to metal, plastic, polymers, or any other material or combination thereof. "Distance to Invisibility" or "Invisibility Distance" measures the minimum distance from the screen at which an observer can no longer discern the elements of the wire mesh. "Dalquist Rating" or "Dalquist Clarity" is a numerical rating for a screen derived through results of test observations under proscribed conditions, as discussed in more detail herein. While this rating is by nature somewhat subjective, it is believed to incorporate various factors such as, for instance, the perceived clarity of an object viewed through a screen, the perception, resolution, or contribution of the screen itself, and other factors. "Fenestration unit" is a window, door, screen, an insect screening in a frame, an insect screening in a frame disposed in a window or door, an opening in a building, or the like for use in buildings or other structures. "Grayscale" is the relative darkening or shading caused by a screen. "Mesh Density," "Mesh," or "Mesh Count" defines the number of elements per lineal inch measured in a direction perpendicular to the elements. Diameters of coated screen elements are referred to as "coated diameters" and diameters of uncoated screen elements are referred to as "uncoated diameters."

A. TEST PROCEDURE

An important aspect of screen visibility is the subjective perception of the visual effects seen by viewers. The visual effect produced by a screen placed in the line of sight between a viewer and an object being viewed depends not only on the properties of the screen itself but also on illumination conditions and the position of the screen relative to the viewer. In particular, the presence of a screen between the viewer and an object being viewed may produce different visual effects depending on whether the object is illuminated from the side of the screen nearest the viewer, or from the side of the screen nearest the object. As used herein, the front of the screen is the side of the screen nearest the viewer, with the term "front lighting" designating a situation where the object being viewed is illuminated from the same side of the screen as the viewer. In a front lighting situation, the light makes two passes through the screen before reaching the viewer. The back side of the screen is the side of the screen furthest from the viewer, with the term "back lighting" designating a situation where the object is illuminated from the same side of the screen as the object, i.e. the side opposite the viewer. In a back lighting situation, the light makes only one pass through the screen before reaching the viewer. Additionally, the visual effect of the screen depends on the distance between the screen and the viewer. The term "near screen" designates the situation in which the screen is relatively near to the viewer, while the term "far screen" designates the situation in which the screen is farther away from the viewer.

Testing on screens such as those detailed in the present disclosure revealed that several factors in combination influence the invisibility of a screen. These factors include: the particular window or door product, the setting, the interior light, the exterior light, the distance from viewer to screen, the distance from viewer to object being viewed through screen, the distance from screen to object being viewed, the angle of orientation to the screen, the height of the viewing angle, the contrast of the items seen through the screen in comparison to each other, the screen mesh density, the screen element diameter, the coated element diameter, the coating color, and the eyesight of the viewer (e.g. 20/20). This list of factors is not exhaustive and can encompass additional or fewer factors.

In order to determine which of the factors, including those listed above, most influenced the perceived invisibility of a screen, several tests, which emphasized selected screen parameters and how they influence human perception of a screen, were performed. In the tests, viewers were asked to analyze the clarity of an object through several individual screens in different lighting and environmental conditions. Throughout the tests, certain variables were held constant to create standard conditions in order to allow reproducibility and repeatability between viewers to allow evaluations of invisibility. These constants included: coating color, location of screen, standard frames, and screen type and size. Since the pupil diameter of the observer can have a strong effect on visual acuity and since pupil diameter is affected by the overall light levels during the test, room lighting levels were held constant during the course of the tests for each viewer. Additionally, to eliminate the effect of screen color as a variable, the screen test samples were all coated with a flat black coating. Surprisingly and unexpectedly, the tests revealed that higher mesh counts for given element diameters result in more transparent, less visible screens.

The screens rated in the tests cover a wide range of mesh densities and screen element diameters. For example, a conventional aluminum screen with a coated element diameter of 0.0126 inches was used as screen 1, a 20 mesh screen with a coated element diameter of 0.0042 inches was used as screen 4, a 40 mesh screen with a coated element diameter of 0.0047 inches was used as screen 7, and a frame without a screen was used as screen 10. The values for reference screens and test screens are shown in Table 4.

TABLE 4

A. Reference Screens:

| | Description | Mesh, M, Elements/inch | Coated Element Diameter, d, inches | Dalquist Reference Rating | Grayscale Reference Rating |
|---|---|---|---|---|---|
| A | Black aluminum screen | 18 | 0.0126 | 1 | 1 |
| B | Flat black painted stainless steel | 20 | 0.0042 | 4 | 7 |
| C | Flat black painted stainless steel | 40 | 0.0047 | 7 | 4 |
| D | No screen | NONE | N/A | 10 | 10 |

B. Test Screens:

| | Description | Mesh, M, Elements/inch | Coated Element Diameter, d, inches |
|---|---|---|---|
| 1 | Flat black painted steel | 18 | 0.0054 |
| 2 | Flat black painted stainless steel | 40 | 0.0039 |
| 3 | Fiberglass screen | 18 | 0.0164 |
| 4 | Flat black painted stainless steel | 50 | 0.0026 |
| 5 | Flat black painted stainless steel | 25 | 0.0028 |
| 6 | Flat black painted stained less | 20 | 0.00196 |
| 7 | Flat black painted stainless steel | 30 | 0.0037 |

Figure 26:
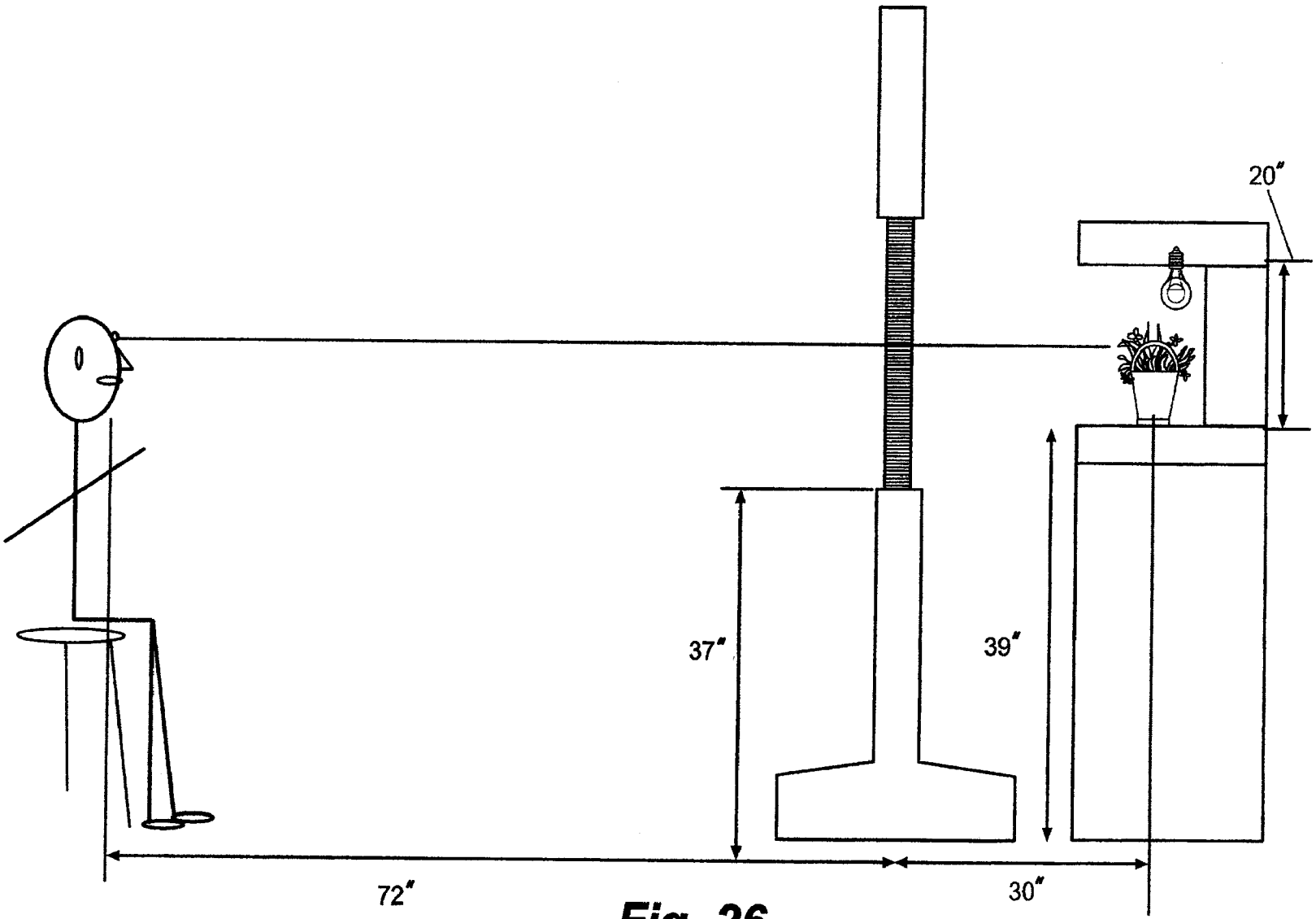
FIG. 26 shows an invisibility test set up with a viewer and a viewing station.

As shown in FIG. 26, the Dalquist Rating test involved each viewer being placed 72 inches (1.83 meters) from a screen to be tested with objects to be viewed placed 30 inches (0.76 meters) behind the test screen at a height of 39 inches. These measurements allowed repeatability (variations in results obtained for the same viewer) and reproducibility (variations from one viewer to another) of each viewer's perception of screen invisibility at a controlled location and environment to substantially replicate conditions for each tested viewer. The test shown in FIG. 26 included back lighting. A still life scene was placed in a light box and illuminated with a daylight illumination spectrum.

Figure 27:
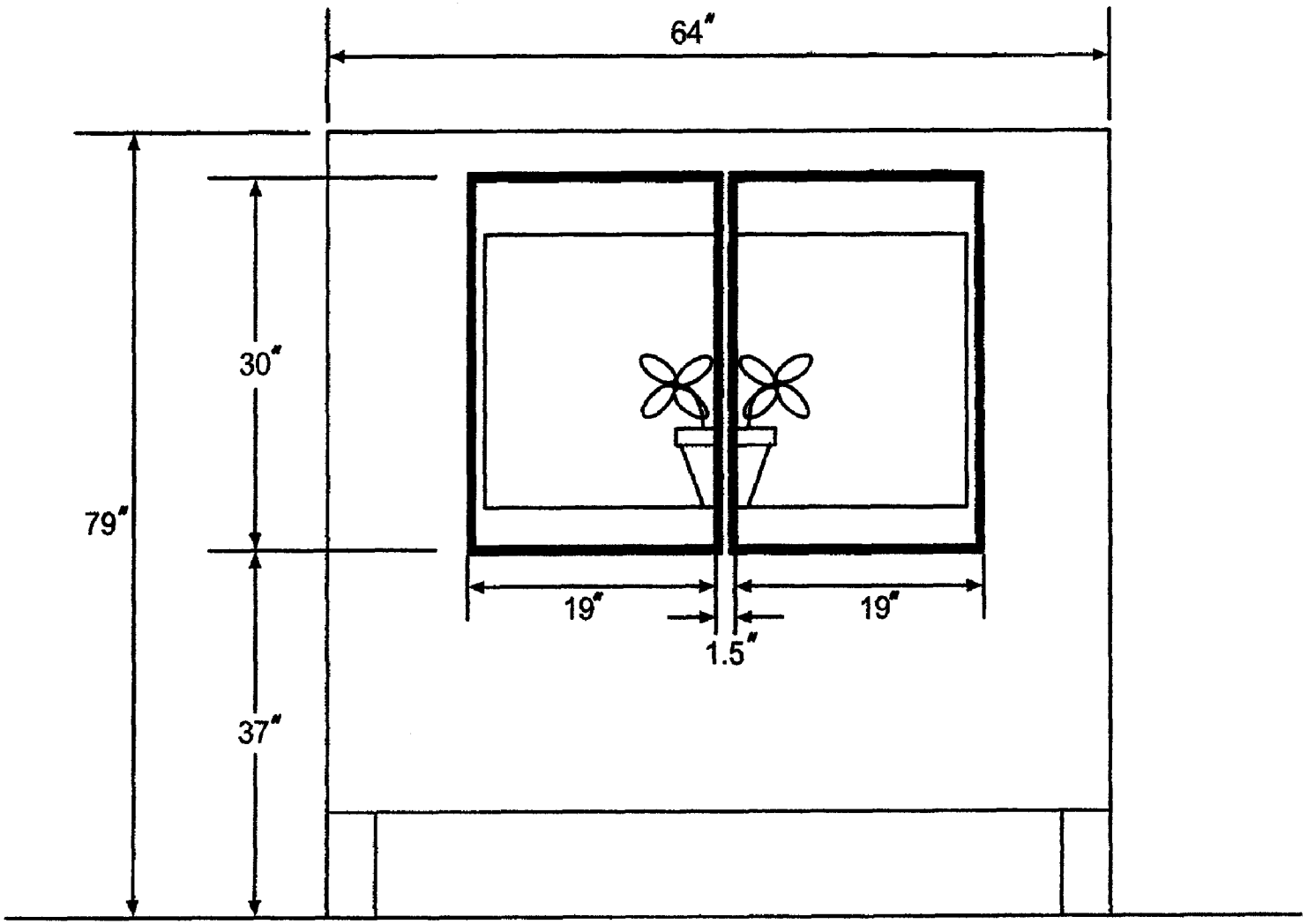
FIG. 27 shows side-by-side screens used in the invisibility test of FIG. 26.

FIG. 27 shows a front view of a testing station or buck in which test screens were placed beside a reference screen for comparison measurement. Each sample screen was 30 inches (0.76 meters) high and 19 inches (0.48 meters) wide. The panel area surrounding the test screens was coated with a layer of smooth white vinyl material. The screen test panels were placed at an approximate distance of 1.5 inches from one another, to facilitate easy comparison. Observers were shown various screen samples and asked to assign a transparency or invisibility rating on a 1 to 10 scale. The screens were compared to various reference screens from Table 4, with a conventional screen being deemed a 1 (screen 1), a more transparent screen being deemed a 4 (screen 4), an even more transparent screen being deemed a 7 (screen 7), and a frame with no screen at all being deemed a 10 (screen 10). Thus, for example, screen 4 was placed in the control section and a screen to be evaluated was placed in the test section. A viewer was then asked to compare the test screen to the reference screen. The viewer could then have the reference screen exchanged with another reference screen (e.g. screen 7 substituted for screen 4). The viewer then assigned an invisibility rating number from 1 to 10 through comparisons with the reference screen. This rating is deemed the Dalquist Rating for the tested screen.

B. DALQUIST INVISIBILITY

Figure 28:
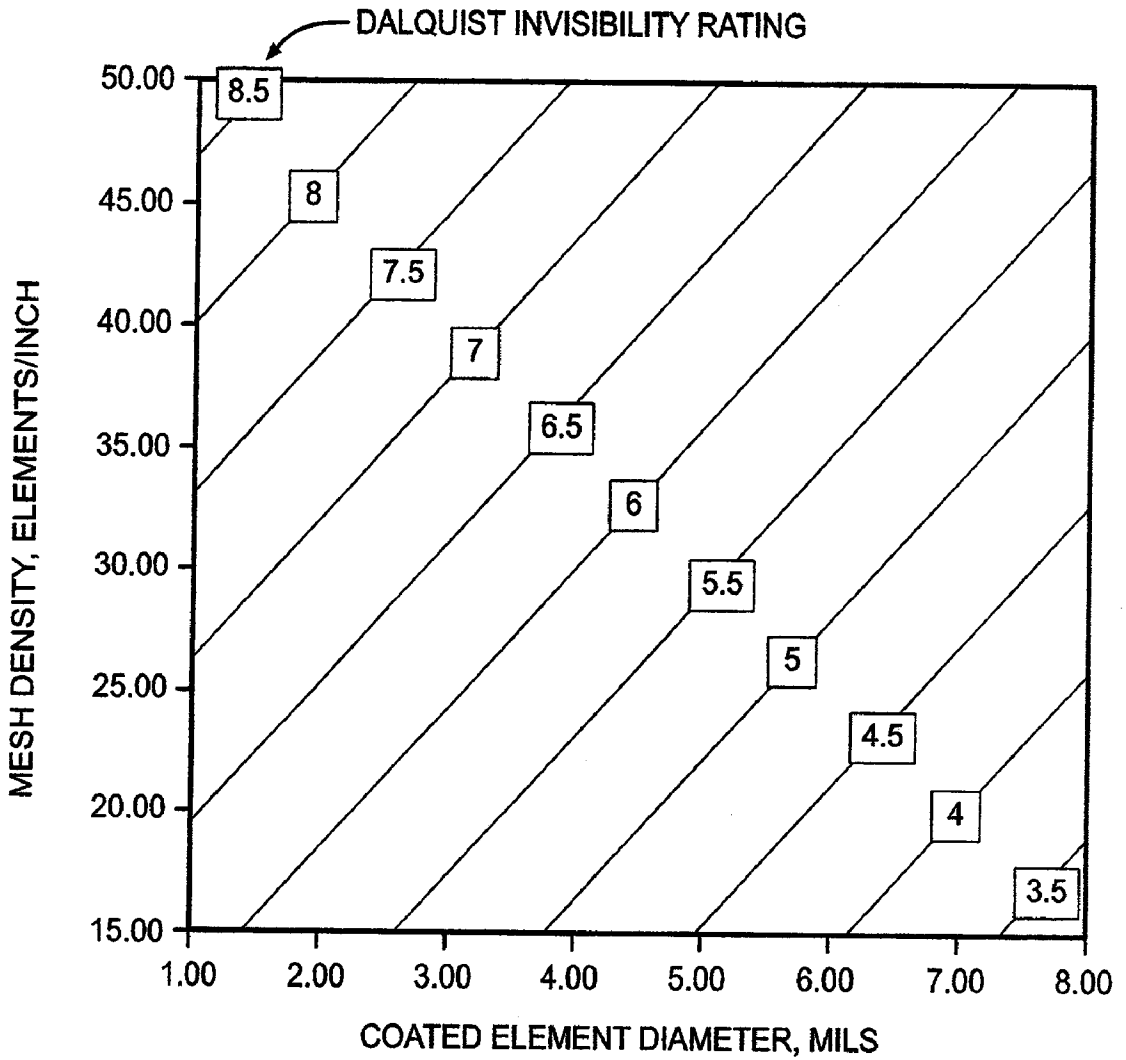
FIG. 28 is a graphical illustration of Dalquist Ratings.

The tests detailed herein included measurements on a Dalquist Invisibility Perception Scale (termed "Dalquist Rating"). "Dalquist Rating" is a tangible value of the clarity of an object through a screen to arrive at the perceived invisibility of a screen. As shown in FIG. 28, Dalquist Rating is derived from a statistical modeling of the test data and is plotted as a function of mesh density (elements/inch) and coated element diameter (mils). The plot in FIG. 28 is a topographic representation of a three dimensional surface having its base in the plane of the paper, with coated element diameter and mesh density being the coordinates in the plane of the paper and the Dalquist Rating represented by a coordinate extending perpendicular to the paper. In FIG. 28, the contour lines represent constant values of Dalquist Rating on the surface being represented. The three dimensional surface is portrayed, as a topographical map, in FIG. 28, by curves representing constant height on the surface (i.e. constant Dalquist Rating), with the numbers shown on each curve being the Dalquist Rating for that curve. FIG. 28 shows that for a given wire diameter, a higher mesh density screen with consequently smaller open area increases invisibility or transparency of the screen in comparison to a lower mesh density screen. Further, the Dalquist Rating increases (decreased visibility of the screen) with increased mesh density and decreased coated wire diameter.

The Dalquist Rating provides a means of quantifying the effects of increased mesh density, decreased coated wire diameter, or a combination of these factors. The Dalquist Rating is related directly to whether the mesh can be seen at a set distance and the clarity of an object as perceived by a viewer through the screen. The Dalquist Rating is influenced in large measure by the screen geometry, to a lesser measure by differences from observer to observer, and by an even lesser measure to the particular viewing environment, including lighting conditions and Grayscale.

C. INVISIBILITY DISTANCE

Figure 29:
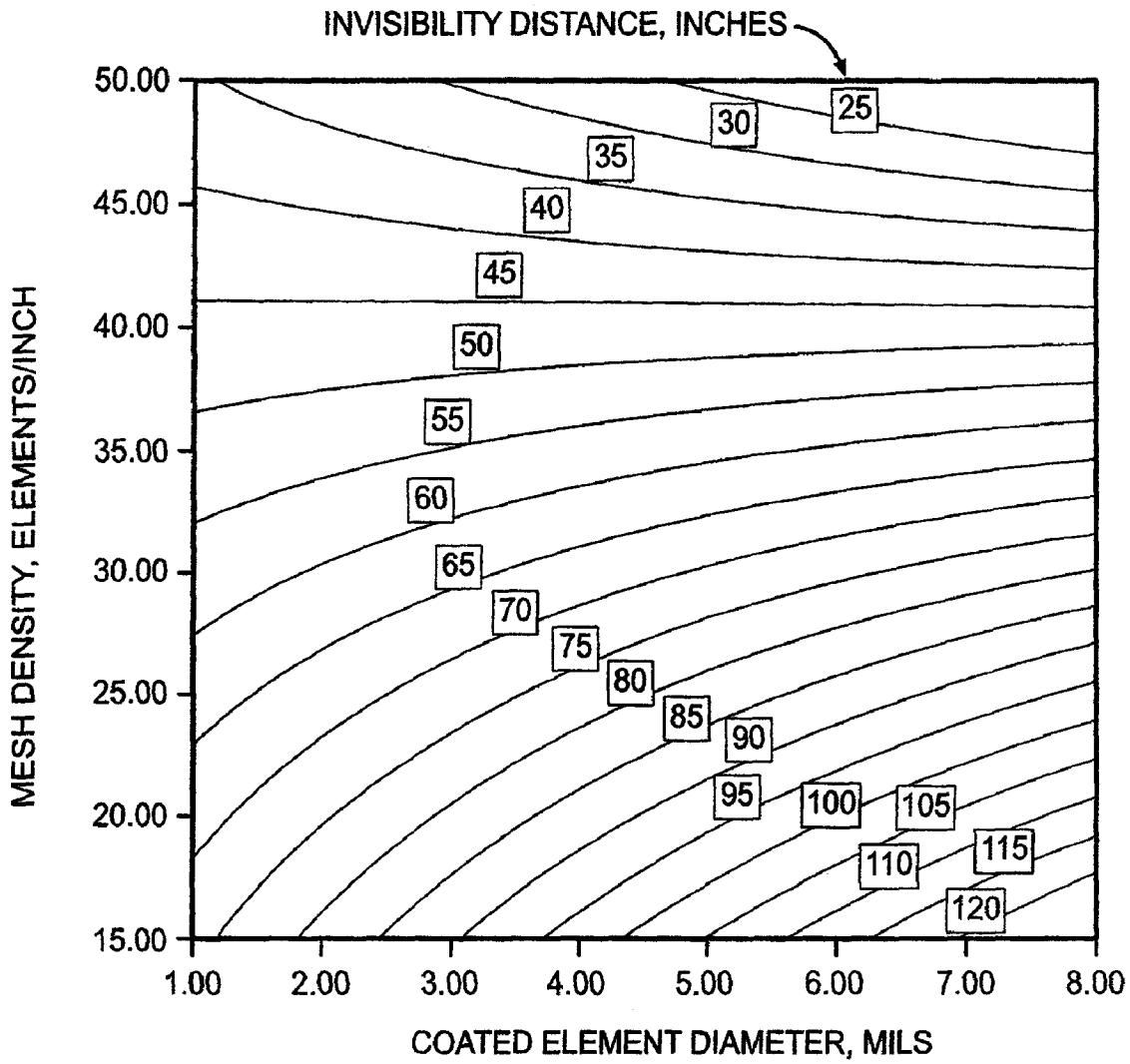
FIG. 29 is a graphical illustration of Invisibility Distance as a function of coated wire diameter and mesh density.

"Invisibility Distance" refers to the minimum distance from a screen at which individual screen elements are not discernable to a viewer. In order to evaluate the Invisibility Distance, a viewer starts in front of a screen and holds one end of a measuring tape, with the other end being attached to, or otherwise adjacent, a test screen. The viewer then backs away from the screen until the screen mesh becomes invisible, i.e. when the viewer can no longer resolve individual screen elements. This distance as measured from the viewer to the screen yields the Invisibility Distance measurement and can be a normalizer to the rating for invisibility. FIG. 29 shows the results of a statistical modeling of the Invisibility Distance tests plotted in terms of mesh density (elements/inch) and coated element diameter (mils). The results of these Invisibility Distance tests yield the counter-intuitive result that a higher mesh density makes the screen appear more invisible at closer distances, i.e. yields a smaller Invisibility Distance Value.

As shown in FIG. 29, Invisibility Distance is a function of both screen element diameter and mesh density. FIG. 29 shows that at lower mesh densities, in the range of about 15-20 elements/inch, and at lower coated element diameters, in the range of about 1-2 mils, the contour lines have a relatively high positive slope to point upwardly to the right. Such positive slope here indicates that both coated element diameter and mesh density have a significant effect on Invisibility Distance. However, at higher mesh densities, the contour lines become more horizontal, indicating a reduced influence of coated element diameter on Invisibility Distance. The contour lines shown in FIG. 29 are based on statistical modeling and should be considered only approximate in the graphical representation shown. Although it appears intuitive that reducing the element diameter and mesh densities (more open area) should result in improved invisibility, surprisingly, it was discovered that increasing mesh density (reducing open area) reduces the Invisibility Distance, i.e. invisibility increases with increased mesh density. Because the slope of the contour lines varies somewhat, becoming more horizontal as mesh density increases, mesh density can have a greater effect, in comparison to coated element diameter, at higher mesh densities.

Invisibility Distance measurements provide a means for quantifying perception value for screen mesh and the perception of the screen in a multiple strand, intersecting element construction. Invisibility Distance is influenced by equal measures by screen geometry and by differences between observers. Environmental factors provided a relatively minor percent of influence in Invisibility Distance ratings.

D. GRAYSCALE RATING

Figure 30A:
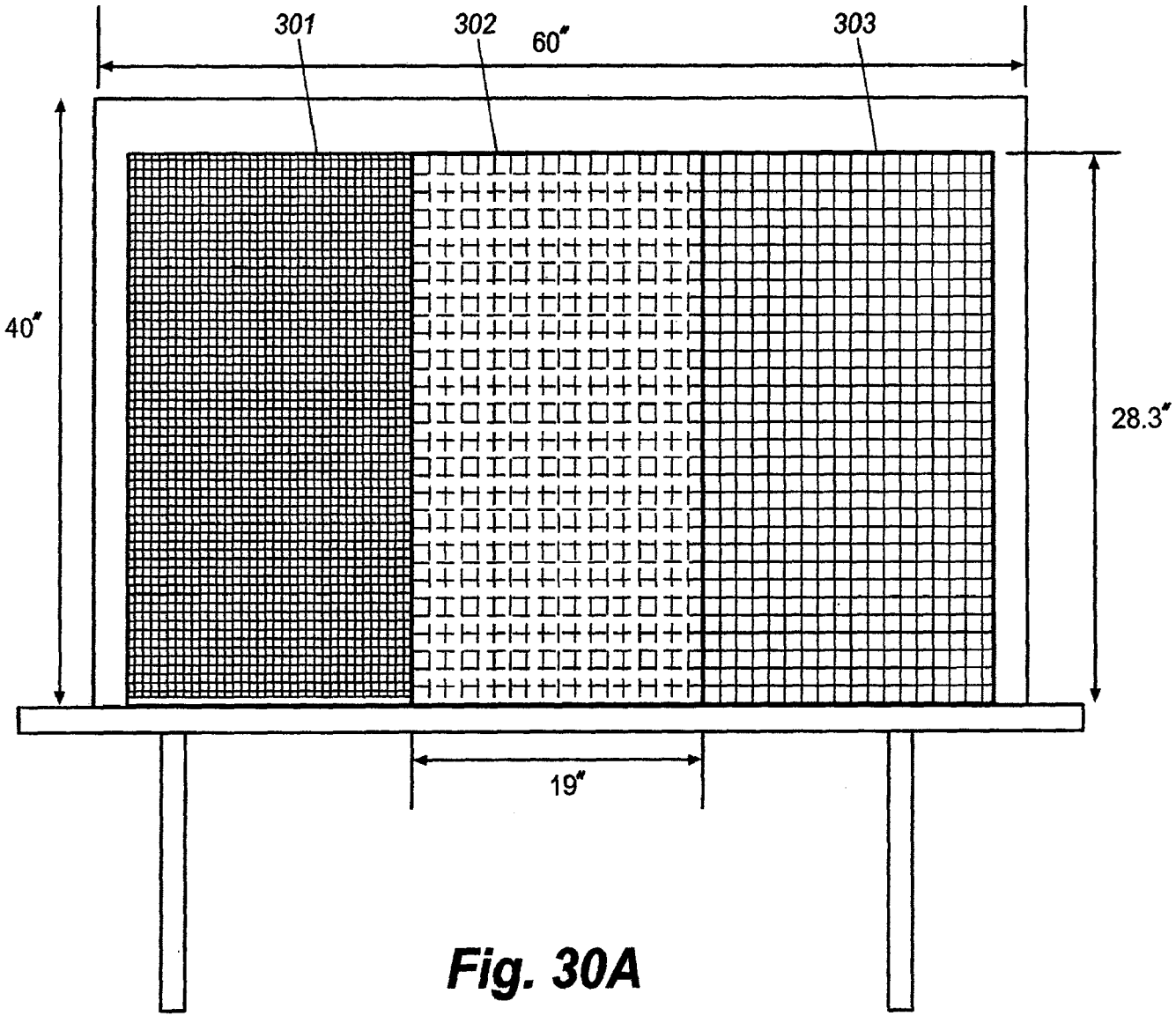
FIGS. 30A and 30B show an Easel Test setup for Grayscale measurement.
Figure 30B:
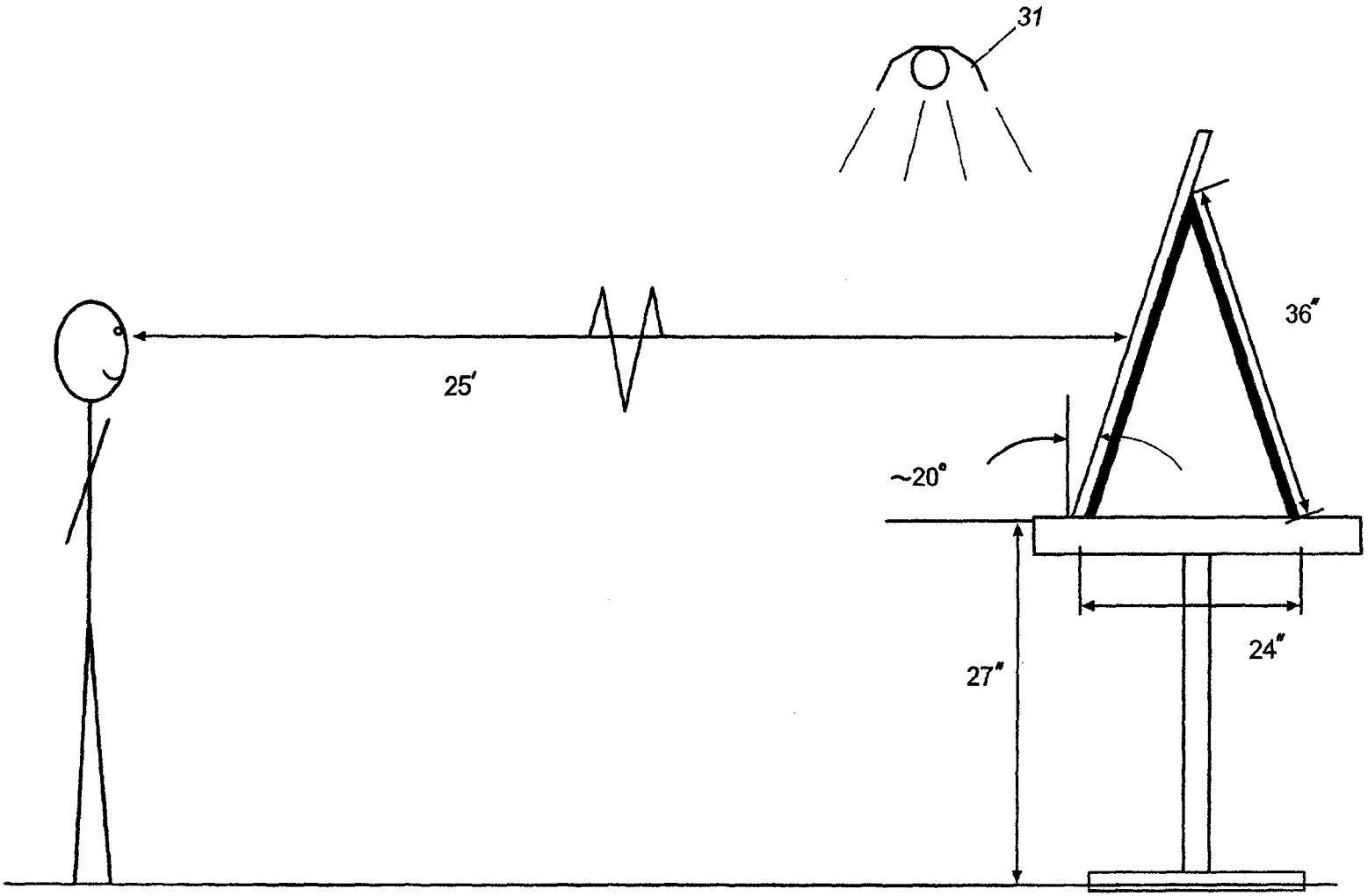

Generally, at distances outside a viewer's Invisibility Distance, some screens have a mesh that can be perceived as a gray or shady haze. In another set of tests, the perception of the dimming or shading effect of different screens was evaluated and assigned a Grayscale rating. This test quantifies the shade of graying perceived as a viewer looks through the screen. The screens used in the Dalquist Rating tests and Invisibility Distance tests were also used in the Grayscale testing. The Grayscale testing was performed with two setups, the Easel Test and the Light Box Test. First, in lieu of the test buck utilized in FIGS. 26 and 27, Grayscale was measured using a Grayscale Easel Test with a white background as shown in FIGS. 30A and 30B. Second, a test buck analogous to FIGS. 26 and 27 was utilized in a Grayscale Light Box Test as shown and described in FIGS. 33A and 33B.

The Easel Test shown in FIG. 30A includes positions for a test screen 302 to be placed between two reference or control screens 301, 303. The reference screens were selected from the four screens detailed above in the Dalquist Rating and Invisibility Distance tests, but with different reference values (See Table 4.A). As shown in FIG. 30B, viewers were placed 25 feet from the easel (beyond the Invisibility Distance for the majority of test or reference screens). The easel was disposed at an angle of about 20 degrees from vertical on a table having a height of 27 inches off the floor. The screens were illuminated by an array of daylight spectrum fluorescent overhead lights. As shown in FIG. 30A, a test screen is placed on the easel between screen 4 and screen 7 and viewers rated the test screen. At any time, the viewer could have one or both of the reference screens exchanged for different reference screens. The viewer then assigned a Grayscale Easel rating from 1 to 10 (with 1 corresponding to the most graying haze, such as from the reference 16×18 mesh black fiberglass screen, and 10 corresponding to no graying haze, such as from the reference frame with no screen).

Figure 31:
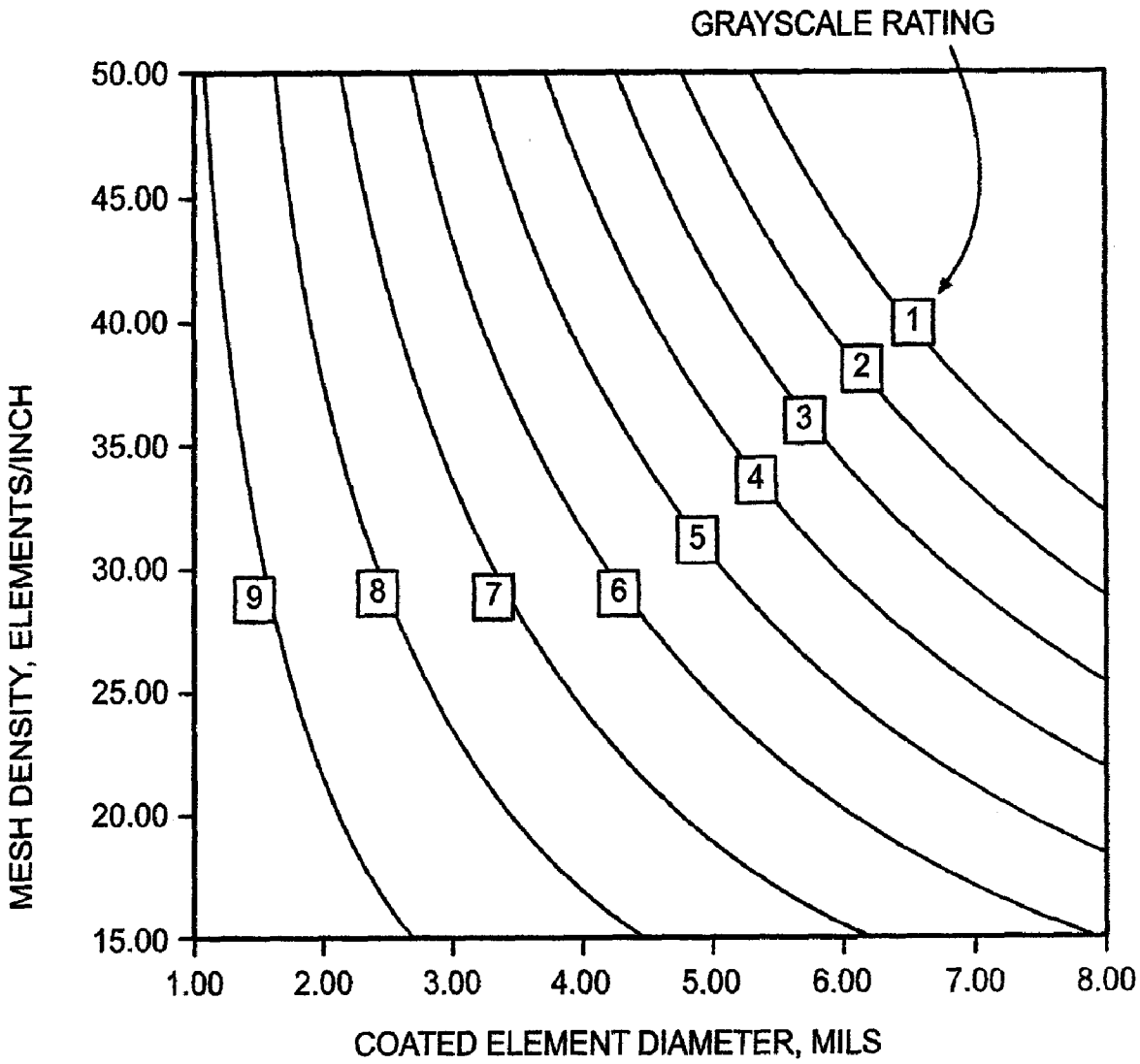
FIG. 31 shows the results of the Grayscale Easel Test plotted in terms of mesh density and coated wire diameter.

FIG. 31 shows the results of the Grayscale Easel Test plotted in terms of mesh density and coated element diameter and shows a significant dependency of Grayscale Rating on both of these parameters. The increased negative slope of the curves at lower coated element diameter suggests a stronger effect of coated element diameter at lower coated element diameter values in comparison to mesh density. However, at higher coated element diameter values, the less vertical slope shown suggests more equal contributions from the two parameters. A review of FIG. 31 reveals that the Grayscale test results generally were intuitive, with invisibility increasing as light transmission through the screen increased (i.e. smaller diameter wire at lower mesh density).

Figure 32:
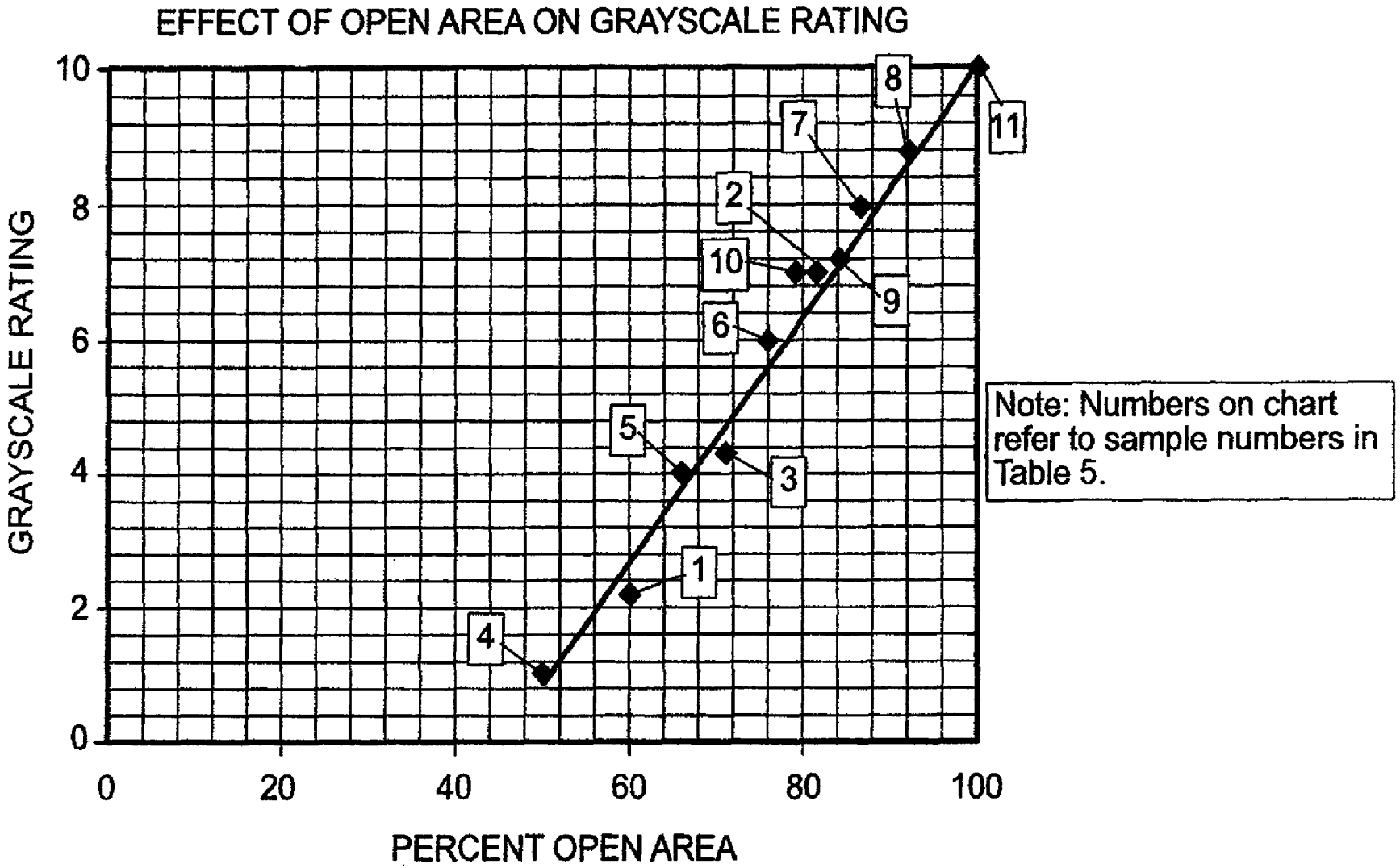
FIG. 32 is a graphical illustration of Grayscale Easel rating in terms of open area.

FIG. 32 shows another plotting of test data from Grayscale Easel testing. In FIG. 32, the Grayscale rating is shown in terms of percent open area of the screen. The Grayscale rating in FIG. 32 was noticeably dependent on open area, with a greater than 60% open area producing a slight improvement in Grayscale rating. For example, a noticeable improvement in invisibility for screens having an open area of 65% or more was realized. This improvement also yielded ratings of 4 or better, compared to conventional screens having an open area of 50% or less, which yielded ratings of 2 or less. Grayscale Rating was hypothesized to be primarily a function of light transmittance of the screen and that light transmittance should, in turn, depend primarily on the percent open area of the screen. The close fit of the data to a single curve appears to justify the hypothesis.

Figure 33A:
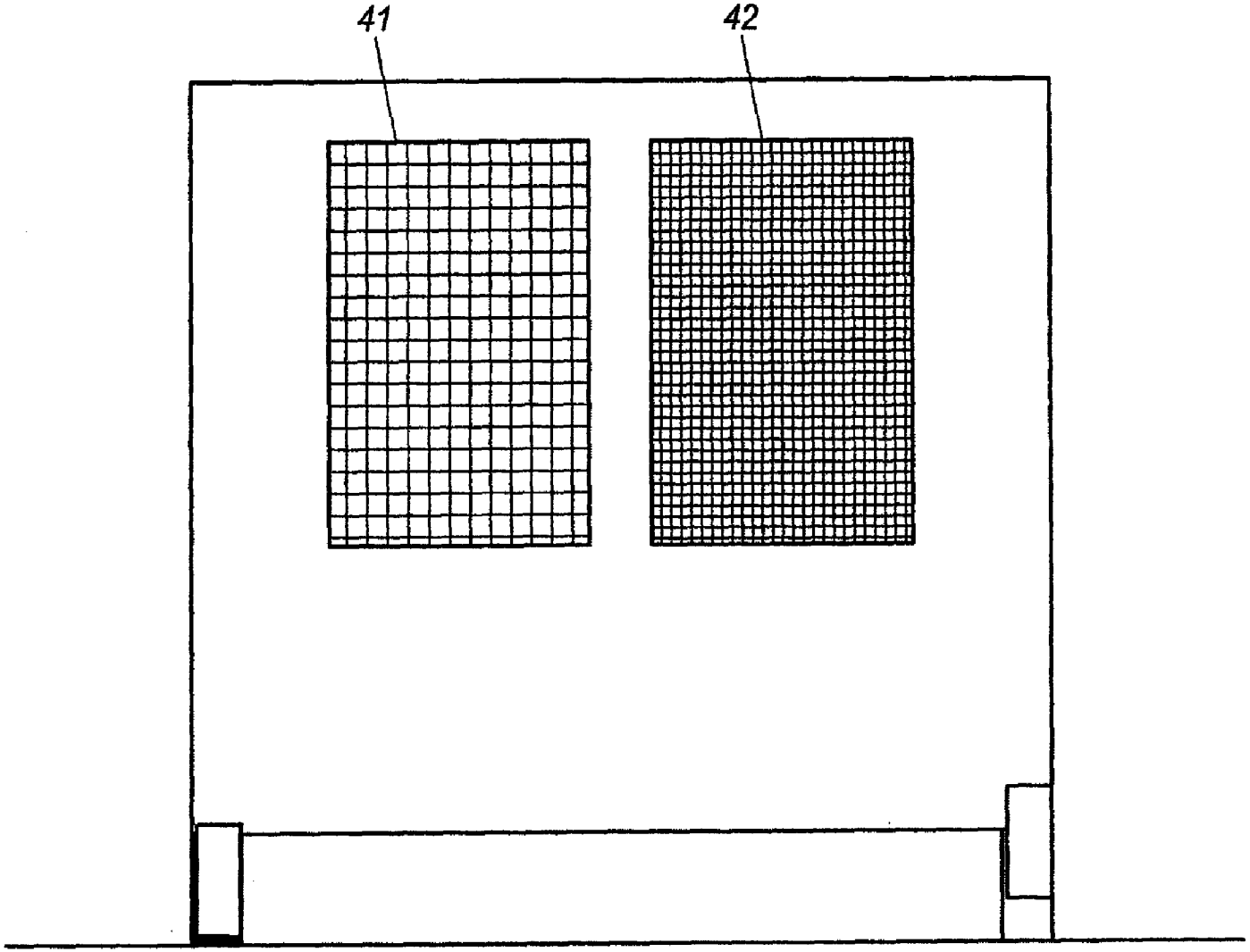
FIGS. 33A and 33B show a test setup for Grayscale measurement analogous to the setup in FIGS. 26 and 27.
Figure 33B:
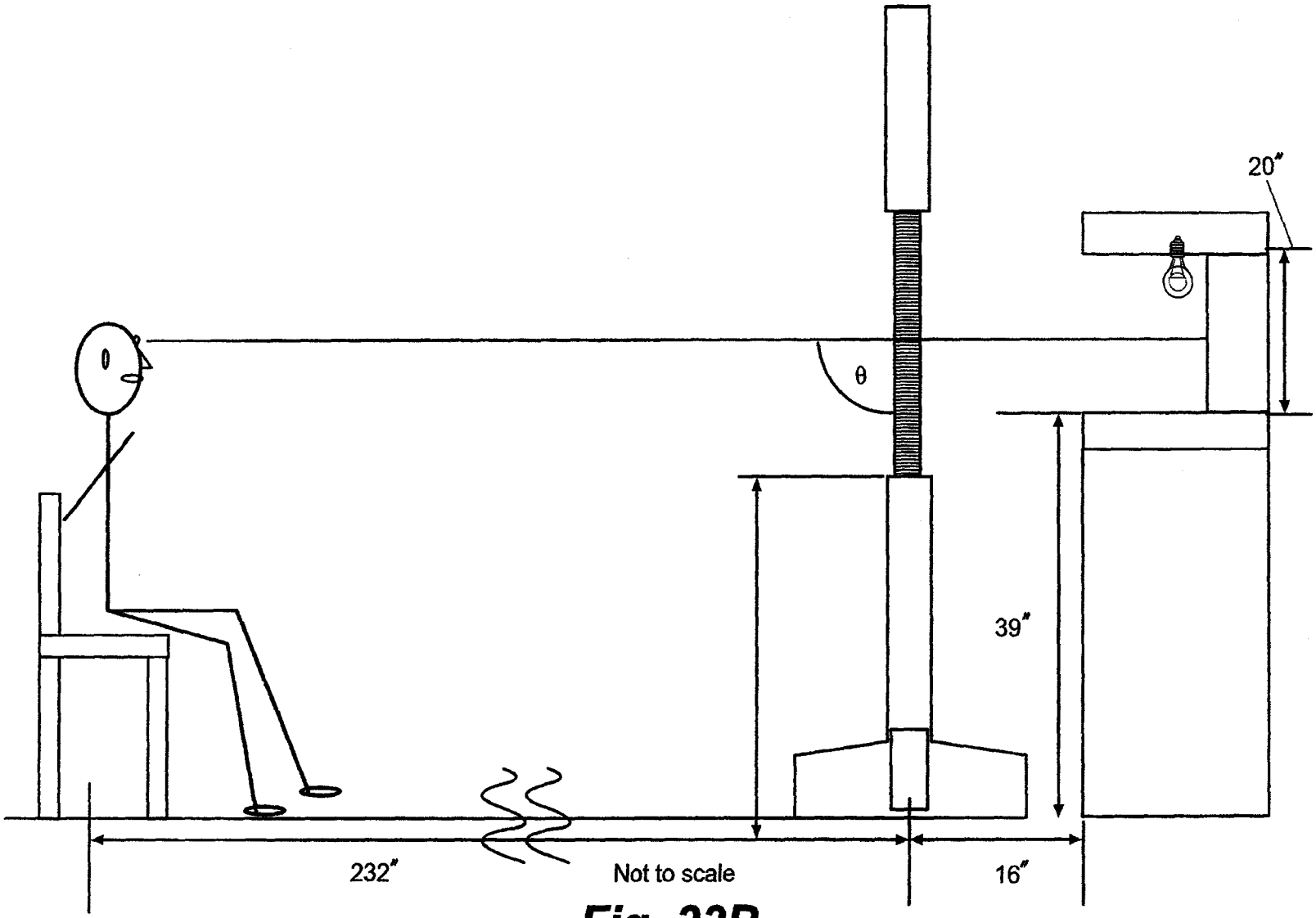

The perceived light attenuation effect produced by screens was measured in both the back lit viewing mode and in the front lit viewing mode. As shown in FIG. 33A for the Grayscale Light Box, reference and test screens were placed side by side, shown at 41 and 42. Test subjects compared test screens with reference screens then rated the invisibility, based on lightness or darkness of the view, on a scale of 1 to 10. The same reference screens were used as in FIGS. 30A and 30B. Here, screen 1 had an open area of 50%, screen 4 had a 70.6% open area, and screen 7 had an 85% open area. Referring to FIG. 33B, the Grayscale in the back lit mode was measured using the light box and buck used for the Dalquist Rating and Invisibility Distance tests, but without the still life scene in the light box. Test subjects were a distance of approximately 232 inches from the screen being tested. This distance was chosen as being outside the Invisibility Distance of most viewers.

Figure 34:
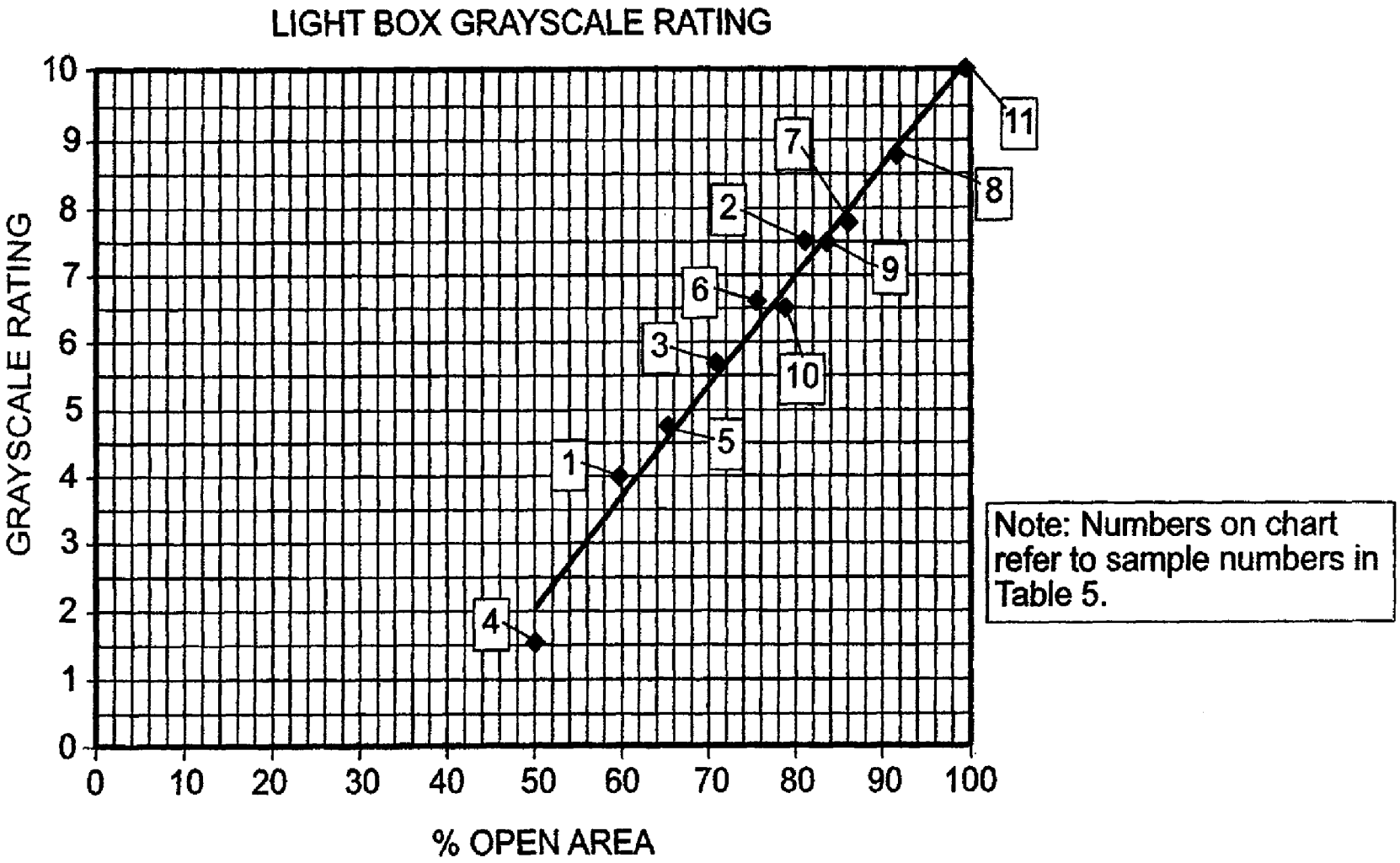
FIG. 34 shows the results of the Grayscale Light Box test of FIGS. 33A and 33B plotted in terms of open area.

FIG. 34 shows a correlation between the percent open area of the screen and the Grayscale Light Box rating, as measured by the light box in the back lit mode. Here, FIG. 34 shows that higher Grayscale ratings can be achieved by increasing the open area of the screen.

Figure 35:
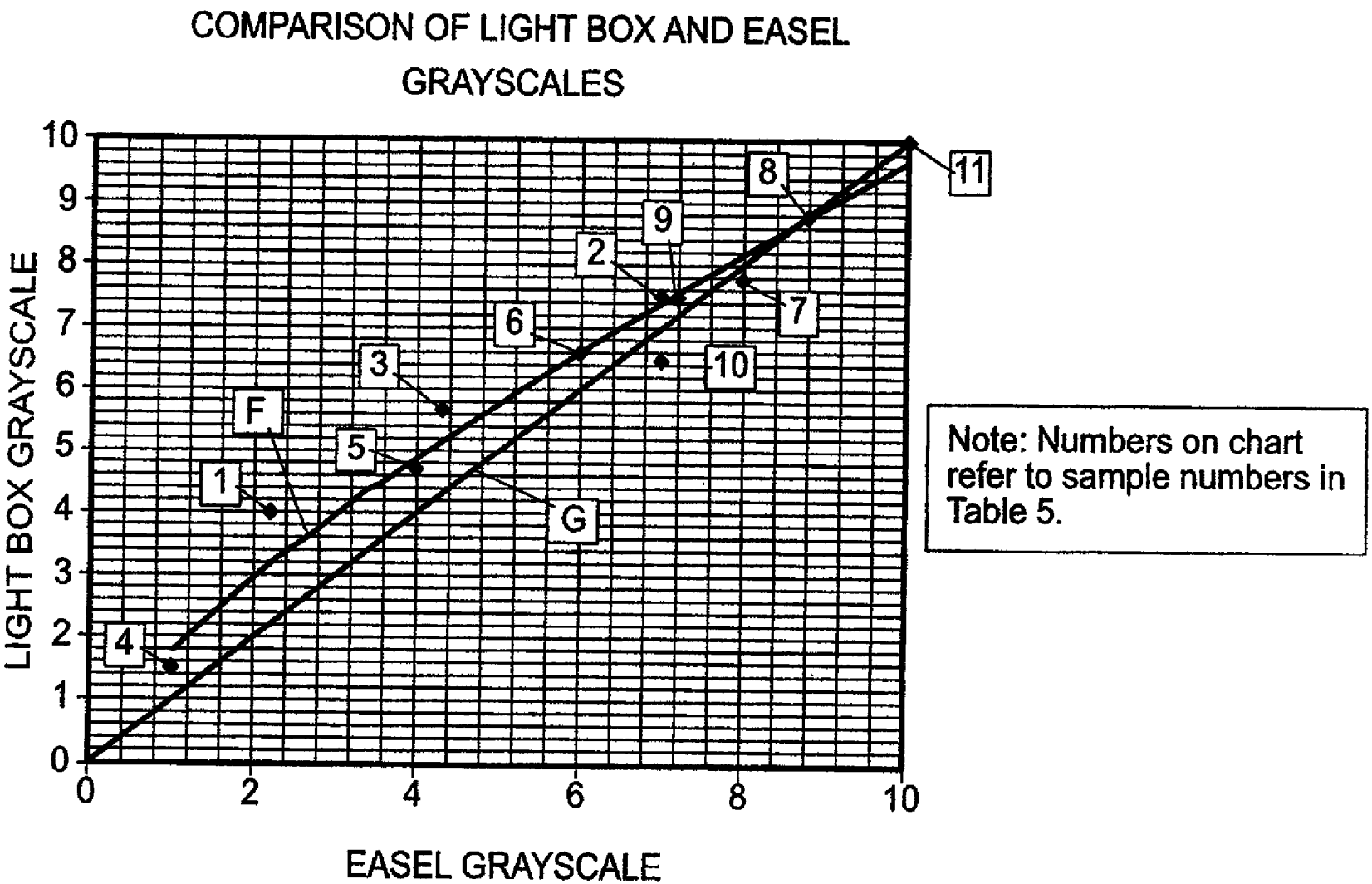
FIG. 35 is a graphical illustration of the Grayscale Light Box rating from the light box test with the Grayscale Easel rating from the easel test.

Referring to FIG. 35, the Grayscale Light Box rating obtained using the light box in a back lit mode is shown compared with the Grayscale Easel rating using the easel test apparatus in the front lit mode. Curve F is a power function fit of the data obtained for the two tests, while curve G is the curve that would be obtained if the back lit and front lit modes yielded exactly the same ratings. As shown in FIG. 35, the Grayscale in the back lit mode is somewhat higher than the Grayscale in the front lit mode. While the inventors do not wish to be bound by any particular theory as to this difference, it seems reasonable that the effect might be related to the fact that in the back lit mode, the light passes through the screen only once before reaching the viewer, while in the front lit mode, the light passes through the screen twice before reaching the viewer; thus amplifying the attenuation effect of the screen.

Grayscale rating is a measure of the shading as perceived by a viewer. Grayscale is influenced in large percent by screen geometry and only in minor percent both by observer differences and viewing environment. For Grayscale, as coated wire diameter and mesh density decrease, the screen yields increasing lightness and thus increased invisibility. Therefore, higher Grayscale ratings are preferred over lower Grayscale ratings.

E. TEST RESULTS

The results from the various tests can be displayed in a number of formats. Viewer perception test data was analyzed by two different methods. The first, or empirical, method involved using statistical polynomial regression analysis of the data, without physical or optical assumptions, with generation of contour plots of the resulting statistically derived mathematical models to aid in their interpretation and understanding. FIGS. 28-29, 31, and 41-42 show the results of this first method of analysis.

The second method of analysis involved graphical plotting of the data and fitting of curves and mathematical models to the data, with the plotted variables chosen on the basis of physical considerations of hypothesized optical phenomena to lead to the observed invisibility effects. The second method also allowed for modifications of the hypotheses based upon the results of the analysis. FIGS. 32, 34-38, and 40 show the results of this second method of analysis.

Despite the fundamental differences between the two approaches to the data analysis, the conclusions reached by the two methods as to the preferred screen configurations were substantially the same. Moreover, the methods of analysis showed that the various invisibility effects depend upon both screen mesh density and coated element diameter. Since screen color was held constant, namely flat black, color did not appear as a variable in the tests.

Figure 36:
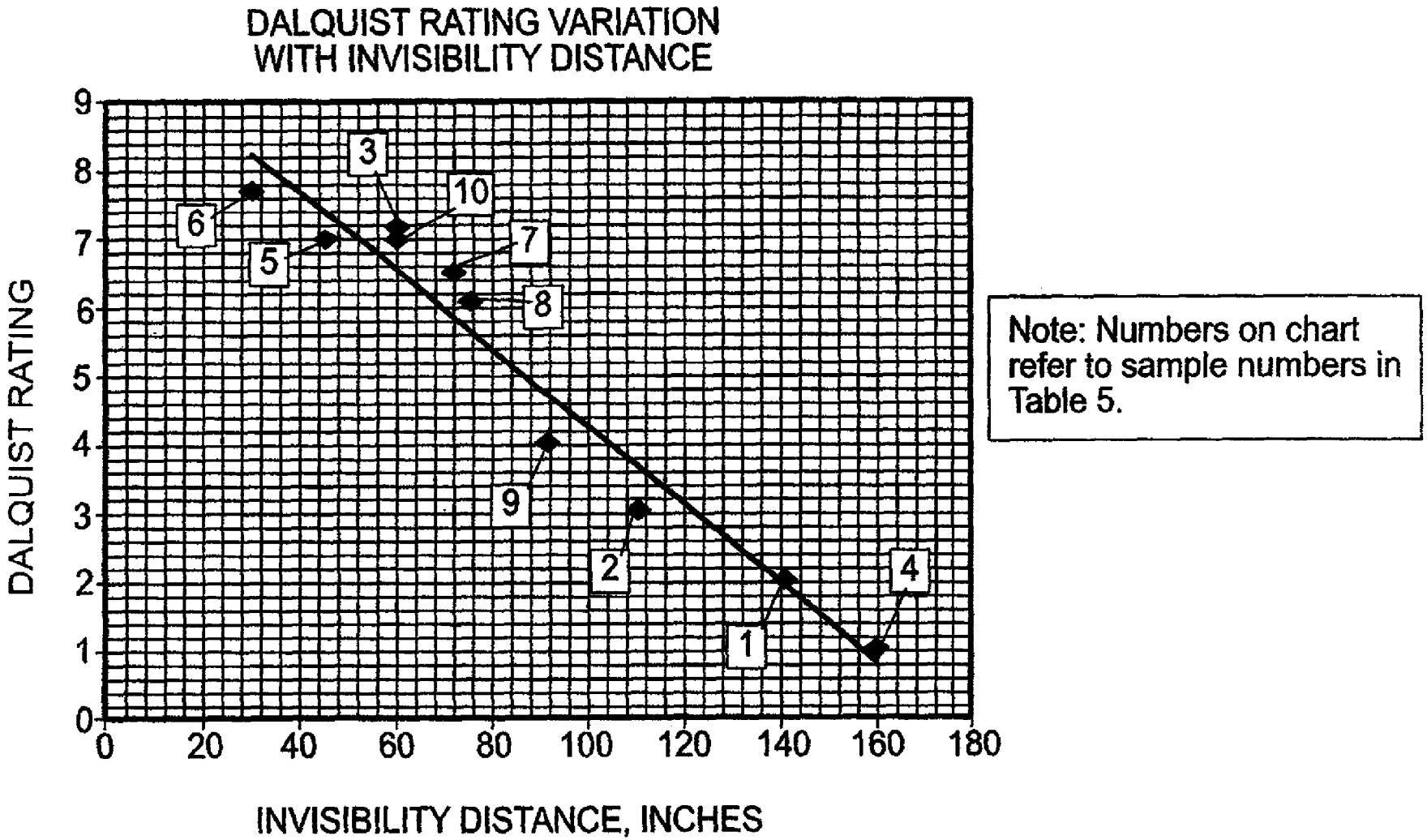
FIG. 36 shows Dalquist Ratings for various invisibility distances.

The Dalquist Rating was hypothesized to be closely related to Invisibility Distance, since the two parameters generally appear to measure optical effects seen in the near-screen viewing mode. Referring to FIG. 36, the close fit of the data from the tests to a single curve appears to justify this hypothesis by showing a strong correlation between the Dalquist Rating and the Invisibility Distance. A difference of 1 on the Dalquist scale represents an approximation to the smallest noticeable difference between two different screen samples. As shown in FIG. 36, a difference of 1 on the Dalquist scale represents a difference of 20 inches in Invisibility Distance. Thus, shortening the Invisibility Distance by about 20 inches, e.g. by increasing the mesh density or reducing the coated element diameter, produces a discernible improvement in screen invisibility.

Figure 37:
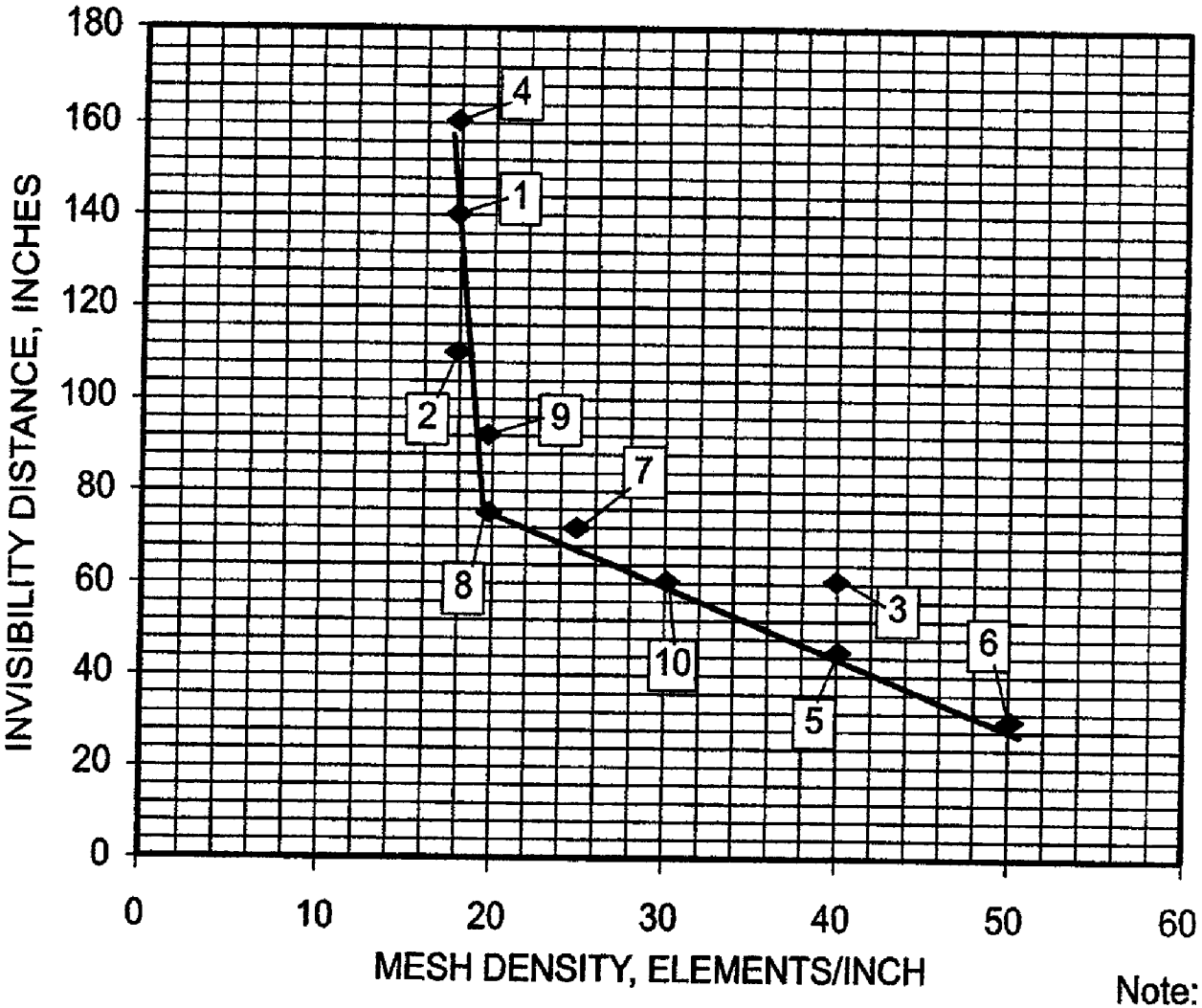
FIG. 37 is a graphical illustration of mesh density's effect on invisibility distance at several wire element diameters.

Invisibility Distance was hypothesized to be a function of mesh density. Referring to FIG. 37, a plot of Invisibility Distance as a function of mesh density shows that Invisibility Distance changes in relationship to mesh count and element diameter. Sample numbers, shown plotted in FIG. 37, displayed an orderly progression at coated mesh counts of 20 elements/inch or below, but showed a pronounced change in Invisibility Distance at mesh counts greater than 20 elements per inch. A mesh count below 20 elements per inch showed a strong effect of element diameter. Further, for a mesh count above 20 elements per inch, Invisibility Distance appears to depend primarily on mesh count, rather than on element diameter. Thus, Invisibility Distance is affected in different ways at higher mesh densities than at lower mesh densities.

Figure 38:
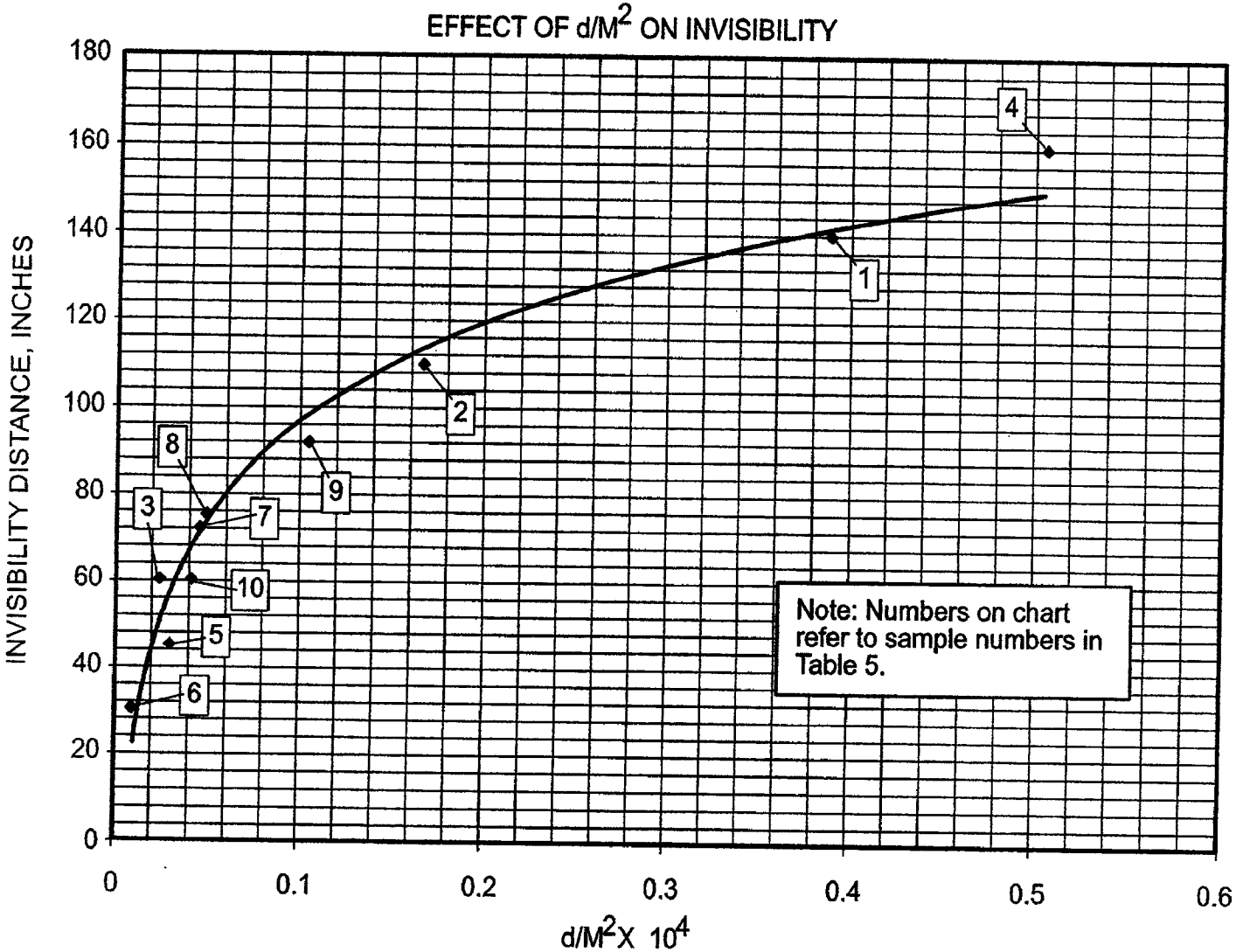
FIG. 38 is a graphical illustration of the ratio of element diameter to the square of mesh count or density as a function of Invisibility Distance.

Since Invisibility Distance appears to depend on coated element diameter, measured in inches, and mesh density, measured in elements/inch, these two parameters were hypothesized to produce a functional relationship between element diameter (d), mesh diameter (M), and Invisibility Distance. Referring to FIG. 38, the test data for Invisibility Distance is plotted as a function of the ratio of element diameter to the square of mesh density ($d/M^2$). The use of $d/M^2$ in FIG. 38 provides a slightly better fit for the data on a single curve. The curve shown in FIG. 38 can therefore be used to calculate values of mesh density and coated element diameter to produce a given value of Invisibility Distance in inches, which is shown as ID in FIG. 39. This calculation is performed by selecting the desired Invisibility Distance from FIG. 38, reading the value of $d/M^2\times10^4$, and calculating as a function of M for the selected value. The curve of Invisibility Distance, ID, in inches, as a function of $d/M^2\times10^4$ has the equation:

$$ID=172+75.3\ \mathrm{Log}_{10}(d/M^2\times10^4)$$

Solving this equation for d, and letting a=[(ID−172)/75.3]−4, results in:

$$d=M^2\times10^a$$

Figure 39:
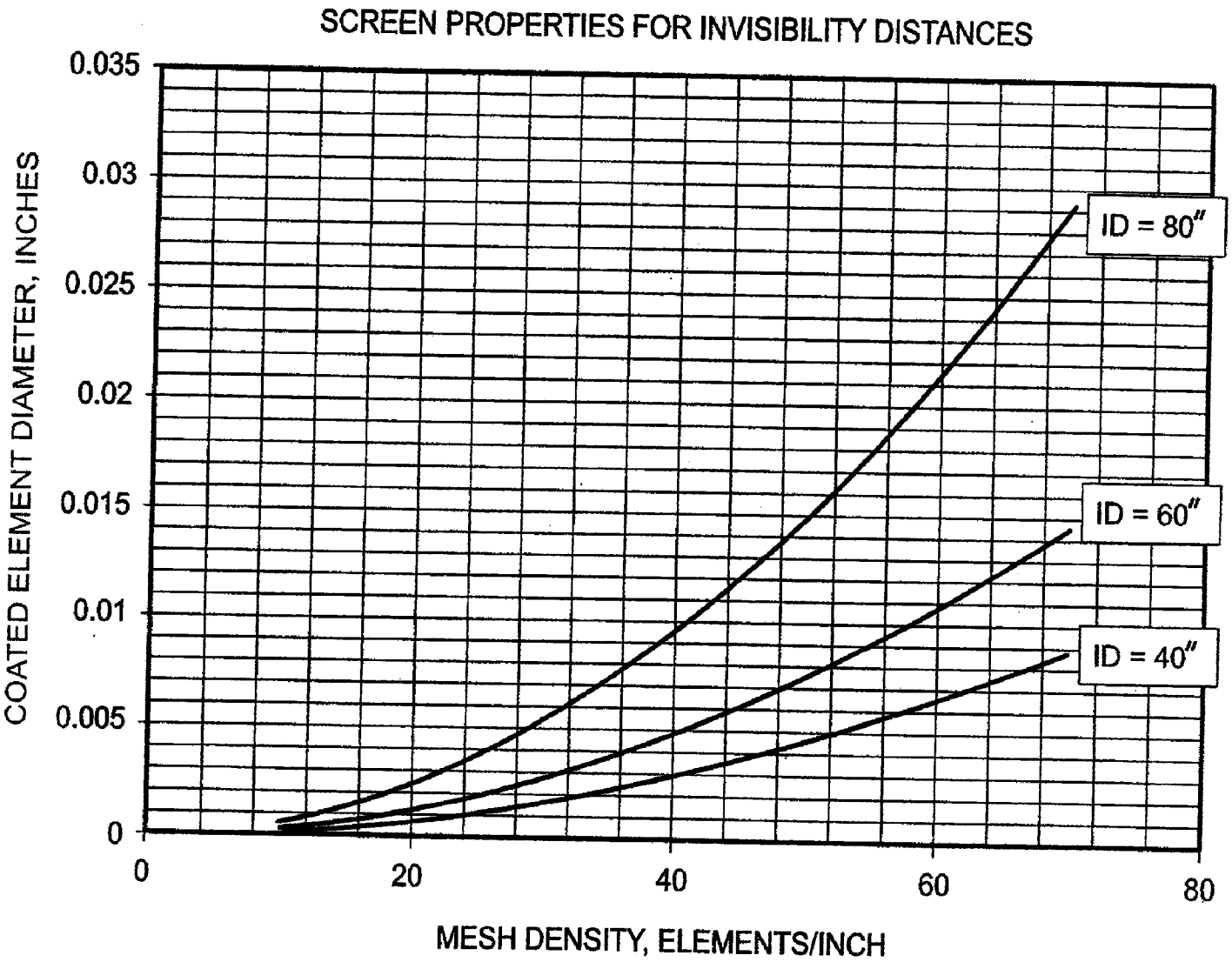
FIG. 39 shows calculated values of coated element diameters as a function of mesh density at various invisibility distances.

FIG. 39 shows exemplary values of coated element diameter as a function of mesh density for values of Invisibility Distance of ID=40", ID=60", and ID=80".

Figure 40:
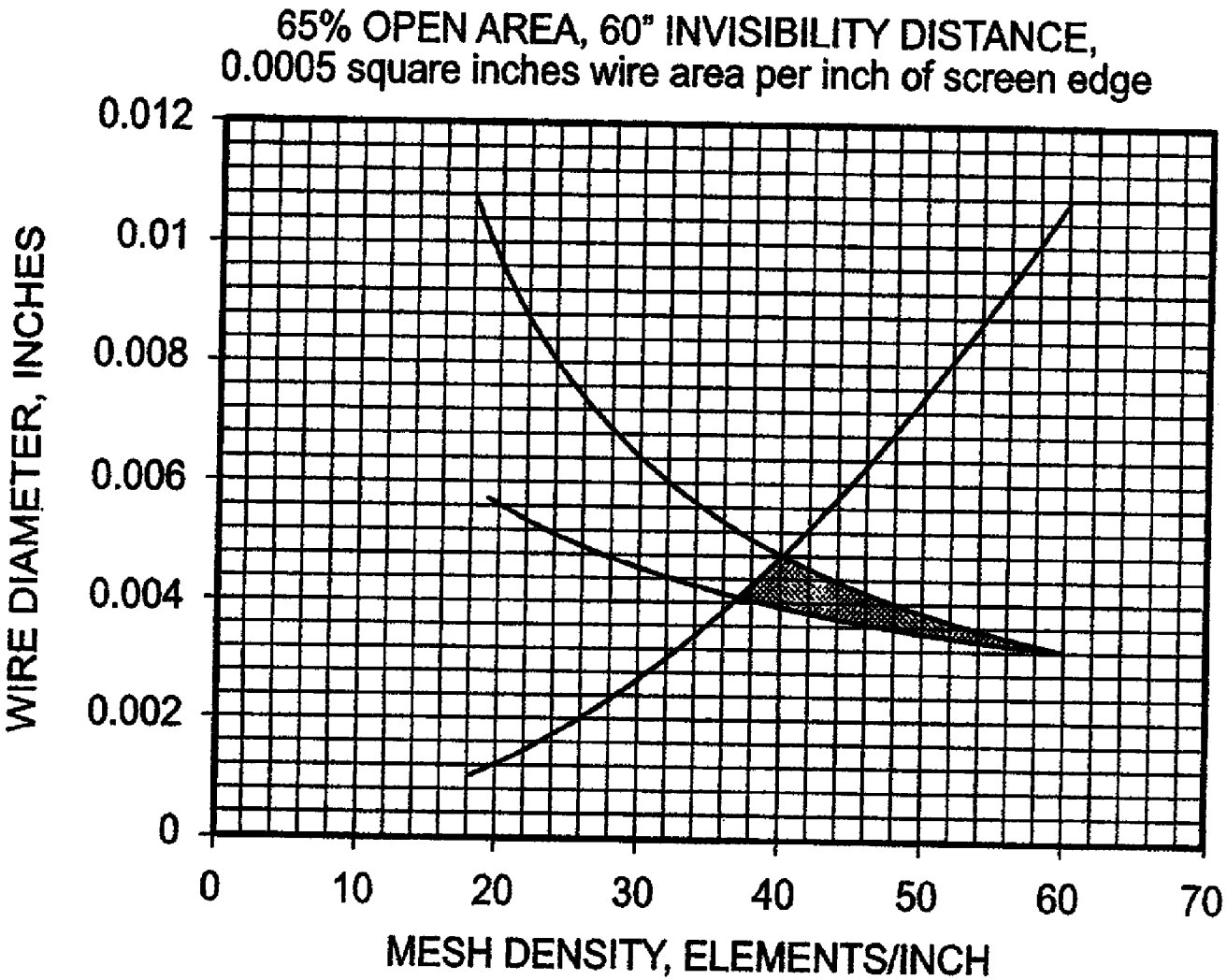
FIG. 40 is an overlay plot of element diameter versus mesh density, the ratio of element diameter to the square of mesh density, and the percent open area of the screen.

Referring to FIG. 40, values of percent open area (labeled curve POA, 65% open area), Invisibility Distance (labeled curve ID, 60 inches), and element cross section (labeled curve ECS, 0.0005 square inches per inch of screen) were plotted on the same graph to define an example set of wire diameter/mesh density configurations, S. A value of 0.0005 square inches per inch of screen length was selected as a practical value to achieve adequate screen strength, based on screen puncture tests. Interestingly, this "sweet spot" found in the second method appears quite similar to the sweet spot found by the empirical polynomial regression analysis of the data in the first method. Higher mesh densities equate to an increased total element cross sectional area per unit length of screen (hereinafter termed "$A_E$"). $A_E$ is calculated by the following formula:

$$A_E=\pi D^2M/4$$

where D=uncoated element diameter, measured in inches, and, M=mesh density, measured in elements per inch. Higher $A_E$ values contribute to improved puncture resistance of the screen, but also make the screen more difficult to stretch, thereby placing greater bending stress on the screen frame. High stresses on the screen frame necessitate pre-bending on the sides of the screen frame, a condition termed "camber."

The graphical representations of mesh density and coated wire diameter can also incorporate additional factors if desired. For example, to further define the sweet spot for given screen parameters, values for screen puncture strength and frame camber can be included that place lower and upper limits on wire diameter. Thus, for example, in terms of Invisibility Distance, as a practical consideration, a screen should become more invisible at a likely viewing or appropriate distance in a typical room size. Since Invisibility Distance also is largely influenced by an increase in mesh density at given element diameters, a distance of approximately 60 inches was chosen as optimal for use in a normal sized room. This distance can be increased or decreased per application to a room, but has been selected as 60 inches in FIG. 41 for example purposes.

Figure 41:
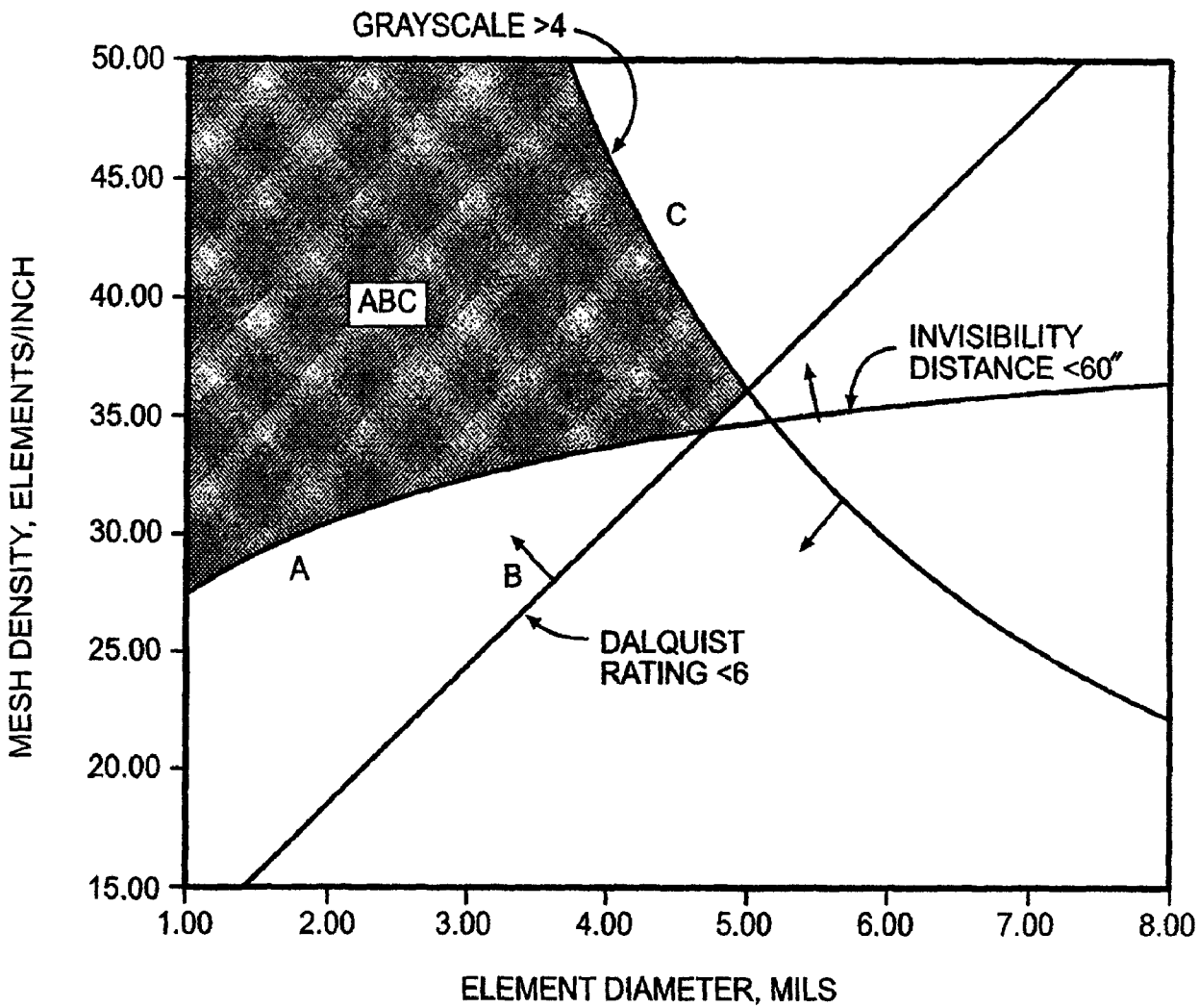
FIG. 41 shows an overlay plot with a region of increased mesh density at a close invisibility distance, at high Dalquist Rating, and at high Grayscale rating.

Referring to FIG. 41, values of Dalquist Rating, Invisibility Distance, and Grayscale Rating are plotted. A Dalquist Rating greater than 6 (labeled curve B) represents a screen showing a significant improvement over conventional screens. An Invisibility Distance of 60 inches (labeled curve A) represents a likely viewing distance in a room. A Grayscale Rating of 4 (labeled curve C) represents a significant improvement over conventional screens. When these curves are combined, the resulting area ABC represents a combination of coated element diameter and mesh density of screens that exhibit a noticeable improvement over conventional screens. As shown in the example overlay plot of FIG. 41, the Dalquist Rating, Invisibility Distance, and Grayscale define sweet spot ABC, generally limited by coated element diameters less than 5 mils and mesh densities greater than about 28 elements per inch.

While screen invisibility is generally improved by increased mesh density and reduced element diameter, there are practical limits to both parameters. In particular, higher mesh densities tend to increase the cost of the screen, due to increased cost of materials and increased time to weave or otherwise form the screen.

1. Test Result Interpretation

Several interpretations of the results follow from the testing and evaluations performed on the screens. For instance, for a fixed element diameter, the more wire elements in a mesh, the greater the perceived invisibility of the screen. Within obvious limits (i.e. a screen mesh that includes a too tightly packed mesh with a very large number of elements eventually appears more as a sheet of elements than a screen), an increase in screen invisibility occurs at higher mesh count for all measured element diameters. Further, smaller element diameters at higher mesh counts yield high Dalquist Ratings and shorter, or closer, Invisibility Distance measurements. Thus, a combination of higher mesh count and smaller element diameter makes the screen less visible to viewers.

In fact, the tests revealed, quite surprisingly and unexpectedly, a "sweet spot" of a combination of high mesh density and small screen diameter where invisibility is optimized. This combination yielded increased screen transparency or invisibility, which is counter-intuitive and heretofore has not been measured or contemplated. In fact, it normally would be expected that higher mesh counts would result in a more visible screen. However, as detailed herein, this expectation has been demonstrated to be erroneous through the present testing.

Differences from observer to observer for Dalquist Rating and Invisibility Distance are to some degree subjective per individual, with considerable differences between different individuals possible. However, the Grayscale ratings appear to be affected little from observer to observer.

2. The Effects of Lighting

Overall, the effects of the three lighting factors of sight or aspect angle, subject lighting, and auxiliary front screen lighting added to a back lit test setup have nominal effect on Dalquist Rating and Invisibility Distance. In aspect angle variance from 45° to 90° as tested, the Dalquist Rating at a 45° aspect angle is slightly better than at 90° aspect angle. This discovery is unexpected and surprising. Further, Invisibility Distance improves with decreasing aspect angle. Another interesting result of the testing is that at a 45° aspect angle, a viewer can be almost five inches closer to the screen on average before the mesh can be resolved. In terms of Grayscale shading, at 45° aspect angle, there was a slight darkening on average.

For lighting of the subject, the testing demonstrates that mid-day lighting provides slightly better clarity on average in comparison to horizon light. For Invisibility Distance, in mid-day light a viewer can be over two inches closer on average before resolving the screen elements in comparison to horizon light. In terms of Grayscale, the lighting of the object had little effect on average.

The Dalquist Rating was slightly higher if an interior spotlight is directed onto the screen. This result is unexpected, since one would imagine the screen would be easier to see if light projected directly onto the screen. The surprising result continued for Invisibility Distance, where the observer had to be on average almost one and a half inches closer to the screen to resolve the mesh. There was no overall effect on Grayscale with the spotlight directed on the screen.

The mesh density result for screen geometry, where at a given wire diameter, the mesh density increases, the perceived invisibility increase was controlling and dominant for the Dalquist Rating and for the mesh Invisibility Distance. As a corollary to the results of increasing mesh density, for a given wire diameter, as the mesh density increases, the perceived clarity of an object seen through the screen also increases. However, a higher mesh density decreases the Grayscale.

F. ADDITIONAL SCREEN PROPERTIES/FACTORS

Figure 42:
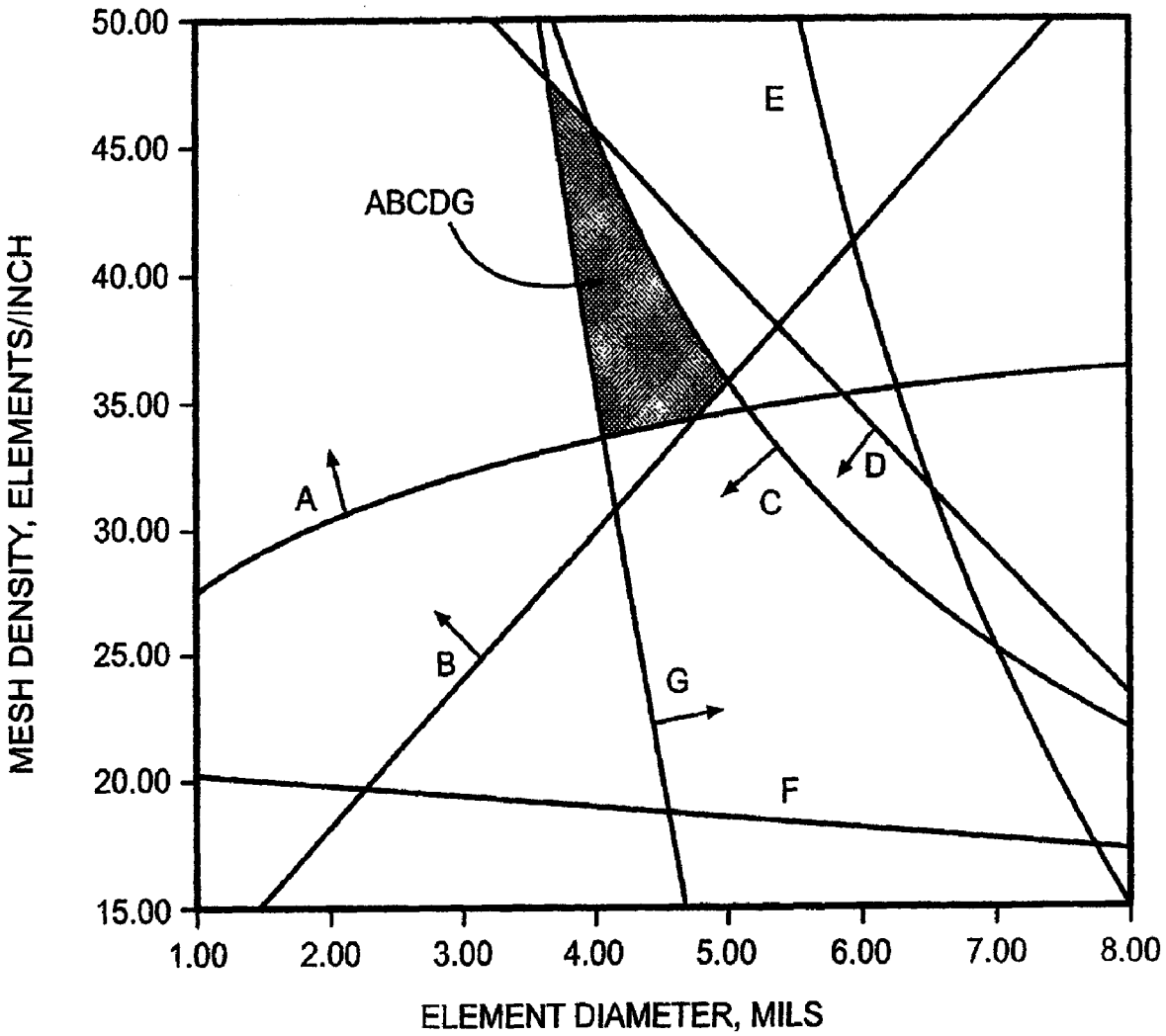
FIG. 42 shows the overlay plot of FIG. 41 including several optional factors to further define the sweet spot region.

Several additional factors can be considered to further define the sweet spot range in addition to the combination of small wire element diameter and high mesh density. Some of these factors include: strength testing, puncture resistance, snag resistance, push-out, aperture area, open area, frame camber, and attachment of the screen to the frame. FIG. 42 includes four of these factors as an example of an even further defined sweet spot. In addition to an Invisibility Distance of 60 inches (labeled A), a Grayscale of 4 or greater (labeled B), a Dalquist Rating of 6 or greater (labeled C), FIG. 42 includes an open area of or greater than 65 percent (labeled D), a frame camber of approximately 4.2 (labeled E), defining lines for aperture open areas over $2.5\times10^{-3}$ square inches (labeled F), and pounds force to break (puncture resistance) greater than 14 lbs. (shown at 14.9 lbs.) (labeled G). The inclusion of these parameters narrows the area ABC from FIG. 41 to area ABCDG in FIG. 42.

1. Strength Testing

In order to measure screen mechanical failure, four tests were performed. These included dent tests to measure if the screen sustained deformation after contact, penetration tests to measure puncture due to biaxial loading, abrasion tests to measure wire movement and coating loss, and snag tests to measure wire breaks from lateral loads. The wire elements and meshes were tested to failure with the results of such tests quantified electronically and through viewer perceptions of such forced failures. In other words, the screens were punctured, torn, or otherwise manipulated past failure with the element and mesh failure rates noted. The screens with failed sections were then presented to viewers for rating to arrive at acceptable dent data and evaluate what effect denting, penetration, abrasion, or snagging had on invisibility.

The screens were tested for failure at several points around the screen as stretched in the frame. These points of failure were repeated for each screen mesh as detailed above and then rated by viewers. For example, the screens were punctured to failure at a distance of approximately 1.5 inches, which corresponds to the approximate distance a person's fingers contact the screen when handling the frame during installation and/or transport. The screens were subjected to puncture testing that was performed with a 11/16-inch smooth hardened steel ball at a denting velocity of 0.6 inches/second. The denting was performed approximately 7.5 inches from the screen frame corners and 1 inch from the frame sides. This testing output force versus displacement information is analogous to that detailed in FIGS. 21-25 described above.

Several results of the strength testing included: that the dent and snag testing is capable of differentiating between screens detailed herein, that powder coatings yield stronger wire intersection strength than E-coatings, and that the screens detailed herein are stronger than expected.

2. Puncture Resistance

Another useful feature of insect screens is durability, in particular resistance to puncture due to handling or impact of objects. A puncture test was run on various screens, and it was found that coating of screens with materials that provided bonding between elements at the element intersections provided significant improvement in puncture strength capable of overcoming the reduced strength resulting from smaller element diameters. It was also found that increased mesh density improved puncture strength.

Increased mesh density is useful for screen strength and near screen invisibility, while increased open area, and hence decreased mesh density, is useful for far screen invisibility, as indicated by the desirable Grayscale ratings. The test results detailed herein provide pathways through these conflicting property requirements and provide improvements in both far screen and near screen invisibility while preserving or improving screen puncture strength.

3. Screen Attachment to Screen Frame

The American National Standards Institute (ANSI) has a test procedure for attachment of screening to a frame and push out data at ANSI/SMA SMT-31 1990. The screens as detailed herein were tested under and meet this ANSI standard of 50 inch-lbs average (with no value less than 40 inch-lbs). This ANSI standard is incorporated herein as if repeated in its entirety.

4. Additional Factors

Several factors that can influence the invisibility of a screen include: variances in the subjective perception of a viewer looking at an invisible screen, the difference between the nominal and measured element diameters from a wire manufacturer, and variances in mesh size between woven, fused, or otherwise constructed screen fabric, and the like. As should be obvious, eyesight and perception from human to human can vary. Thus, these variances should be considered in screen design and in Dalquist Ratings.

Variances in the screens themselves result from imprecise manufacture or measurement of the nominal and measured element diameters. In the tests as detailed herein, the screen elements of each of the eight screen samples were measured against the nominal wire element diameters provided by the manufacturers.

A large variance between these measured values is shown in Table 5. These measured wire diameters are displayed in mils and are shown in comparison to the nominal wire diameters as provided by the manufacturer. Table 5 shows that the measured wire diameter variance from the nominal wire diameter is, or could be, a significant factor depending on the diameter variance. Thus, if the variance in nominal and measured element diameters is minimal, the Dalquist Rating does not appear to differ markedly from a screen with the nominal diameter. However, if the measured wire diameter varies greatly from the nominal wire diameter, the Dalquist Rating can vary greatly and result in improper Dalquist Ratings. Additionally, if the measured wire diameter differs from the nominal wire diameter, open area increases or decreases as a result. These changes or variances also can result in misvalues of Invisibility Distance and Grayscale and should be considered as additional factors that may influence invisibility.

TABLE 5

| Screen Samples | Nominal Wire Diameter Mils | Measured Wire Diameter Mils |
|---|---|---|
| 1 | 2.00 | 3.88 |
| 2 | 11.00 | 16.40 |
| 3 | 4.00 | 4.71 |
| 4 | 2.00 | 2.60 |
| 5 | 2.36 | 2.79 |
| 6 | 1.50 | 1.96 |
| 7 | 4.00 | 4.24 |
| 8 | 3.00 | 3.67 |

The screen parameters can also vary depending on the particular types of coatings used on the screen. These coating options are discussed in more detail above in reference to the parent applications. Coatings are incorporated with the present screening as desired.

Another factor that may influence invisibility is the aspect angle at which the screen is viewed. Most tests detailed herein were performed with the viewer directly in front of the screen (aspect angle of 90°), looking directly at the screen. However, some tests included evaluation with the screen oriented at a 45° aspect angle. As an additional surprising and unexpected result, increasing the mesh density of the screen not only increases the invisibility of the screen, but, at non-normal aspect angles, the increased mesh density lowers the Invisibility Distance measurement. Thus, a screen viewed at an aspect angle of approximately 45° becomes invisible at a closer distance than a screen viewed at an aspect angle of 90°. Other factors to consider in evaluating invisibility of a screen include, but are not limited to: inside illumination, e.g. darkness of a room; outside illumination, e.g. darkness outside; direct sunlight on a screen; the effect of glass on perception; shading effect of "curb appeal" as viewed from the exterior of the house and/or window; the interaction of the screen color as applied through the coating or from the natural elements of the wire or other substance as used in the manufacture of the screen; the realistic nature of outside objects; the methods of attaching the screen to the window, door, or other fenestration unit; or other factors not included herein but contemplated in the invention as detailed in the present disclosure and in the claims.

G. CONCLUSIONS

The tests surprisingly revealed that screen invisibility depends on two visual effects, namely darkening and texturing. When the viewer is relatively far from a front-lit, dark colored screen, the primary visual effect observed by the viewer is a darkening or attenuation of the light coming from the object. This viewing situation can arise, for example, in daylight viewing from a distance from the exterior of a house with screened windows. This viewing situation is referred to herein as the front lit, far-screen viewing mode.

On the other hand, when the screen is nearer to the viewer, with back lighting, the screen can be seen as having a texturing or veil effect on the image viewed. Image texturing can occur whether the object is close to the screen or farther away, provided the viewer is sufficiently close to the screen to at least partially discern the screen elements. This situation corresponds to a person standing near a screened window and viewing an outdoor scene through the screen, in daylight, from inside a house. This viewing situation is referred to hereinafter as the back lit, near screen viewing mode.

In the far screen, front lit viewing mode, invisibility can be improved by increasing the percent open area of the screen, by, for example, reducing the diameter of the elements while keeping the aperture size constant. Surprisingly, however, in the near screen, back lit mode, increasing the mesh density, which reduced the open area, improved invisibility.

Figure 43:
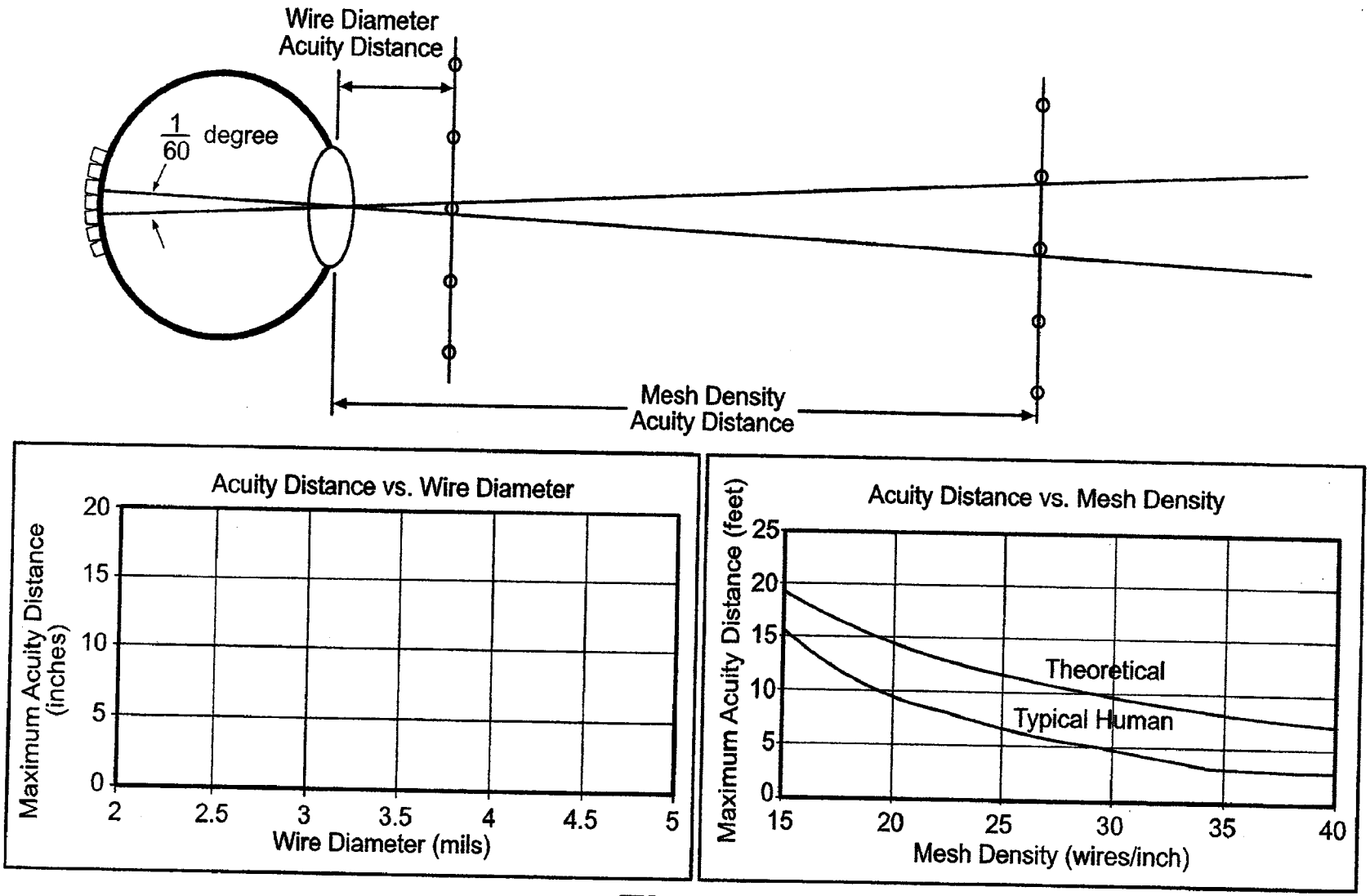
FIG. 43 illustrates a subtended angle as viewed from a human eye evaluating wire diameter and mesh density.

FIG. 43 shows a human eye and a subtended angle projecting from the human eye as defined by the resolution of the eye past a wire diameter shown at its maximum acuity distance and continuing to the maximum acuity distance for the mesh density. Here, the wire can be perceived along the subtended angle from the eye at a certain distance and continues to be viewed up to the brink of resolvability at the acuity distance of the mesh density. Further, if the screen proceeds past this acuity distance of the measured density, the individual wire and the mesh are unresolvable to the human eye. This focal acuity is dependent upon the human eye, which has a limited number of receptors capable of taking in light—120 per degree. The eye has a theoretical resolution of 1/60°, which controls the distance at which diameter and mesh density can be seen by an observer. Although this distance ratio is theoretically about 1/5000, the typical distance ratio is normally less than 1/3000 and typically more in the range of 1/2000-1/3000.

Figure 44:
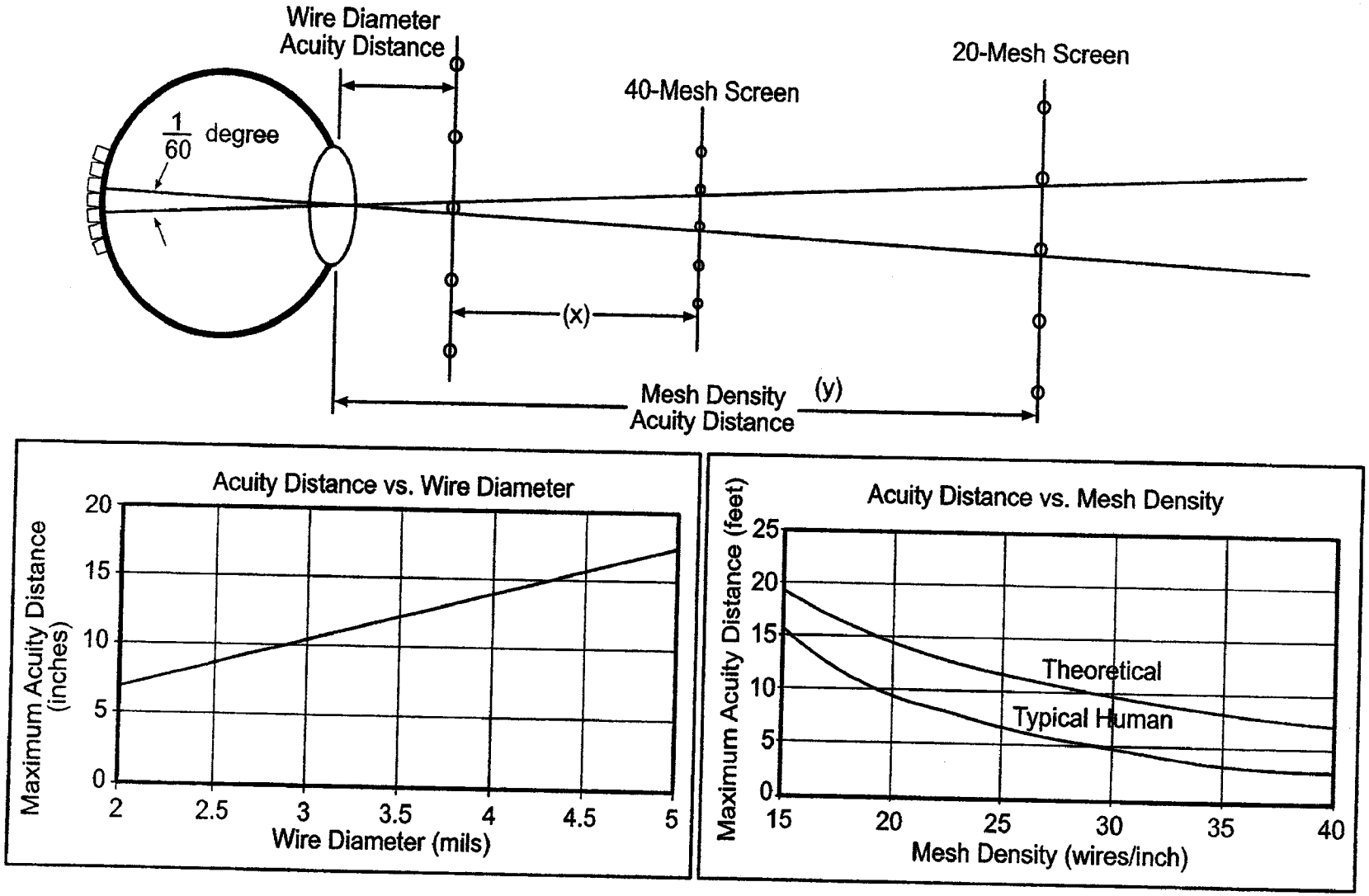
FIG. 44 illustrates the subtended angle of FIG. 43 and including a second screen with twice the mesh density.

For illustration purposes, one surprising result detailed herein can be shown in FIG. 44. FIG. 44 shows another view of the subtended angle of FIG. 43 with elements of a given element diameter, but with two mesh screens, one with twice the mesh density of the other (as shown in FIG. 44, one screen has a mesh density of 20 and the other has a mesh density of 40). In FIGS. 43 and 44, the mesh is resolvable to a certain distance from the eye and is not resolvable further than that distance from the eye. The resolvability of the screen with mesh density 20 is at mesh density acuity distance y, while resolvability of the screen with mesh density 40 is at mesh density acuity distance x. The 40-mesh screen is not resolvable at distances greater than the distance x from the eye and thus becomes unresolvable at a closer distance (with consequently higher Dalquist Rating and Invisibility Distance ratings) than the 20-mesh screen.

A significant improvement in screen invisibility for screens having a mesh density of greater than 20 elements per inch was indicated. Further, at mesh densities below 20 elements per inch, improvements in invisibility with decreasing element diameter were realized. While the inventors do not wish to be bound by any particular theory of screen invisibility, it is suspected that at lower mesh densities, individual elements are more discernible, thereby making element diameter a more important factor, while at higher mesh densities, the images of the screen apertures on the retinas of the observers begin to overlap, thereby reducing the screen texture seen by the eye.

The tests performed herein lead to a number of surprising results, which are counter-intuitive. These results include the surprising conclusion that for a fixed wire diameter, an increase of the mesh density of the screen results in an increased invisibility of the screen. Thus, an increase in the mesh density results in an increase in the Dalquist Rating and a closer Invisibility Distance. These results demonstrate that there is a "sweet spot" at which a mesh density at a certain wire diameter provides a screen that is less visible and yet still provides the strength, durability, and quality of screens desired. In summary, the results from the testing were surprising in that an increased mesh count or density increased the perceived invisibility of the screen.

The factors of screen coating color and coating gloss can affect the Dalquist Rating, the Invisibility Distance, and the Grayscale Rating. For a given wire diameter and mesh density combination, a screen with a coating color and gloss that provides contrast to the background against which the screen is viewed, can decrease the Dalquist Rating and can increase the Invisibility Distance (i.e., the screen can be seen at a greater distance). Further, for a given wire diameter and mesh density combination, a screen with a darker color can decrease the Grayscale rating (i.e. increase the relative darkness of the screen) since Grayscale is evaluated against a white background. In view of the possible effects of color and gloss on testing, the tests performed and detailed herein utilized a constant screen color of flat black.

The above specification, examples, and data represent the best mode known to the inventors of carrying out the invention. Since many modifications of the invention can be made without departing from the spirit and scope of the invention, the breadth and depth of the invention resides in the claims hereinafter appended.

We claim:

1. A method of forming an insect screen, the method comprising:

providing an insect screen comprising a mesh of intersecting elements each having a diameter between 0.0025 and 0.0075 inch, the insect screen having a mesh density greater than 25 elements per inch, and disposing the insect screen in a fenestration unit that permits ventilation therethrough.

2. The method of claim 1 wherein the diameter of the elements is 0.004-inch.

3. The method of claim 1, wherein the insect screen has an area, with the area comprising an open area and mesh of the insect screen elements, and wherein the open area is greater than 60 percent of the area of the insect screen.

4. The method of claim 3, wherein the mesh density is less than 50 elements per inch and the open area is less than 75 percent.

5. The method of claim 1 wherein the elements are coated.

6. A method of forming an insect screen, the method comprising:

providing an insect screen comprising a mesh of intersecting elements each having a diameter between 0.0025 and 0.0075 inch, the insect screen having a mesh density greater than 25 elements per inch, and disposing the insect screen in a frame in a fenestration unit that permits ventilation therethrough.

7. The method of claim 6 wherein the diameter of the elements is 0.004-inch.

8. The method of claim 6, wherein the insect screen has an area, with the area comprising an open area and mesh of the insect screen elements, and wherein the open area is greater than 60 percent of the area of the insect screen.

9. The method of claim 8, wherein the mesh density is less than 50 elements per inch and the open area is less than 75 percent.

10. The method of claim 6 wherein the elements are coated.

11. A method of forming an insect screen, the method comprising:

providing an insect screen comprising a mesh of intersecting elements each having a diameter between 0.0025 and 0.0075 inch, the insect screen having a mesh density greater than 25 elements per inch, and disposing the insect screen across an opening of a building structure, the opening permitting ventilation therethrough.

12. The method of claim 11 wherein the diameter of the elements is 0.004-inch.

13. The method of claim 11, wherein the insect screen has an area, with the area comprising an open area and mesh of the insect screen elements, and wherein the open area is greater than 60 percent of the area of the insect screen.

14. The method of claim 13, wherein the mesh density is less than 50 elements per inch and the open area is less than 75 percent.

15. The method of claim 11 wherein the elements are coated.

16. A method of forming an insect screen, the method comprising:

providing an insect screen comprising a mesh of intersecting elements each having a diameter greater than 0.004-inch, the insect screen having a mesh density of 25 elements per inch, and disposing the insect screen in a first fenestration unit that permits ventilation therethrough.

17. The method of claim 16, wherein the insect screen has an area, with the area comprising an open area and mesh of the insect screen elements, and wherein the open area is greater than 60 percent of the area of the insect screen.

18. The method of claim 17, wherein the mesh density is less than 50 elements per inch and the open area is less than 75 percent.

19. The method of claim 16 wherein the elements are coated.

20. A method of forming an insect screen, the method comprising:

providing an insect screen comprising a mesh of intersecting elements each having a diameter greater than 0.004-inch, the insect screen having a mesh density of 25 elements per inch, and disposing the insect screen in a frame in a fenestration unit that permits ventilation therethrough.

21. The method of claim 20, wherein the insect screen has an area, with the area comprising an open area and mesh of the insect screen elements, and wherein the open area is greater than 60 percent of the area of the insect screen.

22. The method of claim 21, wherein the mesh density is less than 50 elements per inch and the open area is less than 75 percent.

23. The method of claim 20 wherein the elements are coated.

24. A method of forming an insect screen, the method comprising:

providing an insect screen comprising a mesh of intersecting elements each having a diameter greater than 0.004-inch, the insect screen having a mesh density of 25 elements per inch, and disposing the insect screen across an opening of a building structure, the opening permitting ventilation therethrough.

25. The method of claim 24, wherein the insect screen has an area, with the area comprising an open area and mesh of the insect screen elements, and wherein the open area is greater than 60 percent of the area of the insect screen.

26. The method of claim 25, wherein the mesh density is less than 50 elements per inch and the open area is less than 75 percent.

27. The method of claim 24 wherein the elements are coated.

* * * * *